US007901855B2

(12) United States Patent
Ogaki et al.

(10) Patent No.: US 7,901,855 B2
(45) **Date of Patent: *Mar. 8, 2011**

(54) ELECTROPHOTOGRAPHIC PHOTOSENSITIVE MEMBER, PROCESS CARTRIDGE AND ELECTROPHOTOGRAPHIC APPARATUS

(75) Inventors: Harunobu Ogaki, Suntou-gun (JP); Hiroki Uematsu, Suntou-gun (JP); Atsushi Ochi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/640,466

(22) Filed: Dec. 17, 2009

(65) Prior Publication Data

US 2010/0092209 A1 Apr. 15, 2010

Related U.S. Application Data

(63) Continuation of application No. PCT/JP2009/063229, filed on Jul. 16, 2009.

(30) Foreign Application Priority Data

Jul. 18, 2008 (JP) ..... 2008-187180

(51) Int. Cl.
*G03G 5/05* (2006.01)

(52) U.S. Cl. ..... 430/58.2; 430/59.6; 399/159

(58) Field of Classification Search ..... 430/58.2, 430/59.6; 399/159

See application file for complete search history.

(56) References Cited

U.S. PATENT DOCUMENTS

| | | | | |
|---|---|---|---|---|
| 5,208,127 | A | 5/1993 | Terrell et al. | 430/59 |
| 5,208,128 | A | 5/1993 | Terrell et al. | 430/59 |
| 5,876,888 | A * | 3/1999 | Anayama et al. | 430/58.2 |
| 6,093,515 | A | 7/2000 | Yoshida et al. | 430/96 |
| 6,146,800 | A | 11/2000 | Yoshida et al. | 430/67 |
| 2002/0018948 | A1* | 2/2002 | Takeshima et al. | 430/58.2 |
| 2006/0035161 | A1* | 2/2006 | Kawamura et al. | 430/59.6 |

FOREIGN PATENT DOCUMENTS

| | | | |
|---|---|---|---|
| JP | 03-185451 | | 8/1991 |
| JP | 08-234468 | | 9/1996 |
| JP | 08234468 | A * | 9/1996 |
| JP | 11-143106 | | 5/1999 |
| JP | 11-194522 | | 7/1999 |
| JP | 2000-075533 | | 3/2000 |
| JP | 2002-128883 | | 5/2002 |
| JP | 2002-214807 | | 7/2002 |
| JP | 2002244314 | A * | 8/2002 |
| JP | 2002251022 | A * | 9/2002 |
| JP | 2003262968 | A * | 9/2003 |
| JP | 2003-302780 | | 10/2003 |
| JP | 2005250029 | A * | 9/2005 |
| JP | 2007-199688 | | 8/2007 |

OTHER PUBLICATIONS

English langauge machine translation of JP 2005-251022 (Sep. 2002).*

English langauge machine translation of JP 2003-262968 (Sep. 2003).*

English langauge machine translation of JP 2002-214807 (Jul. 2002).*

English langauge machine translation of JP 2003-302780 (Oct. 2003).*

Diamond, Arthur S & David Weiss (eds.) Handbook of Imaging Materials, 2nd ed.. New York: Marcel-Dekker, Inc. (Nov. 2001) pp. 145-164.*

International Search Report issued in the corresponding International Application PCT/JP2009/063229 dated Oct. 6, 2009 (11 Pages).

* cited by examiner

*Primary Examiner* — Christopher RoDee

(74) *Attorney, Agent, or Firm* — Fitzpatrick, Cella, Harper & Scinto

(57) ABSTRACT

A charge transport layer serving as a surface layer of an electrophotographic photosensitive member contains a polyester resin having a repeating structural unit represented by the following formula (1) and a repeating structural unit represented by the following formula (2), as a binder resin; the content of a siloxane moiety of the polyester resin is not less than 5% by mass and not more than 30% by mass relative to the total mass of the polyester resin; and the content of the polyester resin in the charge transport layer is not less than 60% by mass relative to the total mass of the whole binder resin in the charge transport layer.

(1)

(2)

8 Claims, 4 Drawing Sheets

ELECTROPHOTOGRAPHIC PHOTOSENSITIVE MEMBER, PROCESS CARTRIDGE AND ELECTROPHOTOGRAPHIC APPARATUS

CROSS-REFERENCE TO RELATED APPLICATIONS

This application is a continuation of International Application No. PCT/JP2009/063229, filed Jul. 16, 2009, which claims the benefit of Japanese Patent Application No. 2008-187180, filed Jul. 18, 2008.

BACKGROUND OF THE INVENTION

1. Field of the Invention

The present invention relates to an electrophotographic photosensitive member, a process cartridge having an electrophotographic photosensitive member and an electrophotographic apparatus.

2. Description of the Related Art

Recently, as a photoconductive substance (a charge generating material and a charge transporting material) used in an electrophotographic photosensitive member, which is installed in an electrophotographic apparatus, development of organic photoconductive substances have been aggressively performed.

The electrophotographic photosensitive member (organic electrophotographic photosensitive member) using an organic photoconductive substance usually has a photosensitive layer, which is formed by applying a coating solution obtained by dissolving and/or dispersing an organic photoconductive substance and a binder resin in a solvent, onto a support, and drying it. Furthermore, as the layer structure of a photosensitive layer, a laminate type (successive layer type) is generally employed, which is formed by stacking a charge generation layer and a charge transport layer successively in this order on a support.

An electrophotographic photosensitive member using an organic photoconductive substance does not always satisfy all characteristics required for an electrophotographic photosensitive member at high levels. In the electrophotographic process, various types of members such as a developer, a charging member, a cleaning blade, a paper sheet and a transfer member (hereinafter referred also to as "contact members") come into contact with the surface of the electrophotographic photosensitive member. As a characteristic required for an electrophotographic photosensitive member, reducing image deterioration caused by contact stress with these contact members may be mentioned. Particularly, as the durability of an electrophotographic photosensitive member improves in recent years, it has been desired to maintain the effect of reducing image deterioration caused by the contact stress.

As to mitigating the contact stress, it has been proposed to add a siloxane modified resin, which has a siloxane structure in a molecular chain, to the surface layer of an electrophotographic photosensitive member to be in contact with the contact members. For example, Japanese Patent Application Laid-Open No. H11-143106 (Patent Document 1) and Japanese Patent Application Laid-Open No. 2007-199688 (Patent Document 2) disclose a resin having a siloxane structure integrated into a polycarbonate resin. Japanese Patent Application Laid-Open No. H03-185451 (Patent Document 3) discloses a resin having a siloxane structure integrated into a polyester resin. Japanese Patent Application Laid-Open No. H11-194522 (Patent Document 4) discloses a resin having a cyclic siloxane structure integrated into a polyester resin. Japanese Patent Application Laid-Open No. 2000-075533 (Patent Document 5) discloses a resin having a branched siloxane structure integrated therein. Japanese Patent Application Laid-Open No. 2002-128883 (Patent Document 6) discloses a resin having a siloxane structure integrated at an end of a polyester resin. Japanese Patent Application Laid-Open No. 2003-302780 (Patent Document 7) discloses a technique for adding a polyester resin having a siloxane structure and a compound having a polymerizable functional group to the surface layer of an electrophotographic photosensitive member.

However, the polycarbonate resins disclosed in Patent Documents 1 and 2, are inferior in mechanical strength compared to the polyester resin, in particular, an aromatic polyester resin. Therefore, they may not be sufficient in order to satisfy durability improvement recently required in balance. Furthermore, in the resins disclosed in Patent Documents 1 and 2, there is a polycarbonate resin having a siloxane structure integrated therein migrating to the surface of a surface layer when a plurality of types of resins is used in combination in the surface layer. This is an effective approach in mitigating the contact stress in the beginning of use of an electrophotographic photosensitive member; however, this approach may not be sufficient in view of persistency of the effect.

Furthermore, a compound having a benzidine skeleton serving as a charge transporting material contained in the charge transport layer, is one of the materials having high electrophotographic characteristics. However, some of the resins disclosed in Patent Documents 1 and 2 cause aggregation of the compound having a benzidine skeleton in the resin, thereby decreasing potential stability during repeated use.

Furthermore, the polyester resin disclosed in Patent Document 3 is a resin obtained by block copolymerization of a siloxane structure and an aromatic polyester structure. However, a charge transporting material tends to aggregate in this resin, decreasing potential stability during repeated use.

Furthermore, the resin disclosed in Patent Document 4 is excellent in mechanical strength; however, the effect of mitigating the contact stress may not be sufficient.

Furthermore, the resin disclosed in Patent Document 5 is excellent in mitigating the contact stress; however, a charge transporting material tends to be aggregated in the resin and potential stability during repeated use may decrease in some cases.

Furthermore, in the resin disclosed in Patent Document 6, the effect of mitigating the contact stress is not sufficient. Furthermore, when a plurality of resins is used in combination in the surface layer, the resin disclosed in Patent Document 6 tends to migrate to the surface of the surface layer. Therefore, it is not sufficient in view of persistency of the effect.

Furthermore, the resin disclosed in Patent Document 7 is not sufficient in view of mitigation of the contact stress and, in addition, a charge transporting material tends to aggregate in the resin and potential stability decreases during repeated use in some cases.

SUMMARY OF THE INVENTION

It is an object of the present invention is to provide an electrophotographic photosensitive member capable of persistently exerting an effect of mitigating contact stress with contact members and excellent also in potential stability during repeated use, and to provide a process cartridge and electrophotographic apparatus having the electrophotographic photosensitive member.

The present invention provides an electrophotographic photosensitive member having a support, a charge generation layer provided on the support, and a charge transport layer containing a charge transporting material and a binder resin and formed on the charge generation layer, the charge transport layer serving as a surface layer of the electrophotographic photosensitive member, wherein; the charge transport layer contains a polyester resin having a repeating structural unit represented by the following formula (1) and a repeating structural unit represented by the following formula (2), as a binder resin, the content of a siloxane moiety in the polyester resin is not less than 5% by mass and not more than 30% by mass relative to the total mass of the polyester resin, and the content of the polyester resin in the charge transport layer is not less than 60% by mass relative to the total mass of the whole binder resin in the charge transport layer, (1)

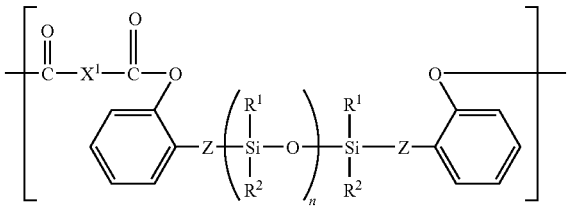

where, in formula (1), $X^1$ represents a divalent organic group; $R^1$ and $R^2$ each independently represent a substituted or unsubstituted alkyl group or a substituted or unsubstituted aryl group; Z represents a substituted or unsubstituted alkylene group having 1 or more and 4 or less carbon atoms; and n represents an average number of repetitions of a structure within the brackets, ranging from 20 or more and 80 or less, (2)

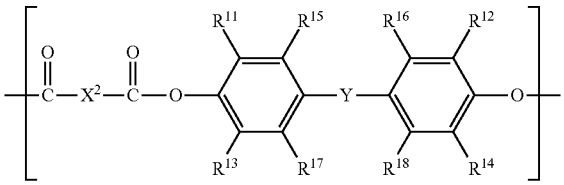

where, in formula (2), $R^{11}$ to $R^{18}$ each independently represent a hydrogen atom, a substituted or unsubstituted alkyl group, a substituted or unsubstituted aryl group or a substituted or unsubstituted alkoxy group; $X^2$ represents a divalent organic group; and Y represents a single bond, a substituted or unsubstituted alkylene group, a substituted or unsubstituted arylene group, an oxygen atom or a sulfur atom.

Furthermore, the present invention provides a process cartridge comprising the above mentioned electrophotographic photosensitive member and at least one device selected from the group consisting of a charging device, a developing device, a transfer device and a cleaning device, wherein the electrophotographic photosensitive member and the at least one device are integrally supported and detachably mountable to a main body of an electrophotographic apparatus.

Furthermore, the present invention provides an electrophotographic apparatus having the above mentioned electrophotographic photosensitive member, a charging device, an exposure device, a developing device and a transfer device.

According to the present invention, it is possible to provide an electrophotographic photosensitive member capable of persistently exerting an effect of mitigating contact stress with contact members and excellent in potential stability during repeated use, and to provide a process cartridge and electrophotographic apparatus having the electrophotographic photosensitive member.

Further features of the present invention will become apparent from the following description of exemplary embodiments with reference to the attached drawings.

DESCRIPTION OF THE EMBODIMENTS

Figure 1:
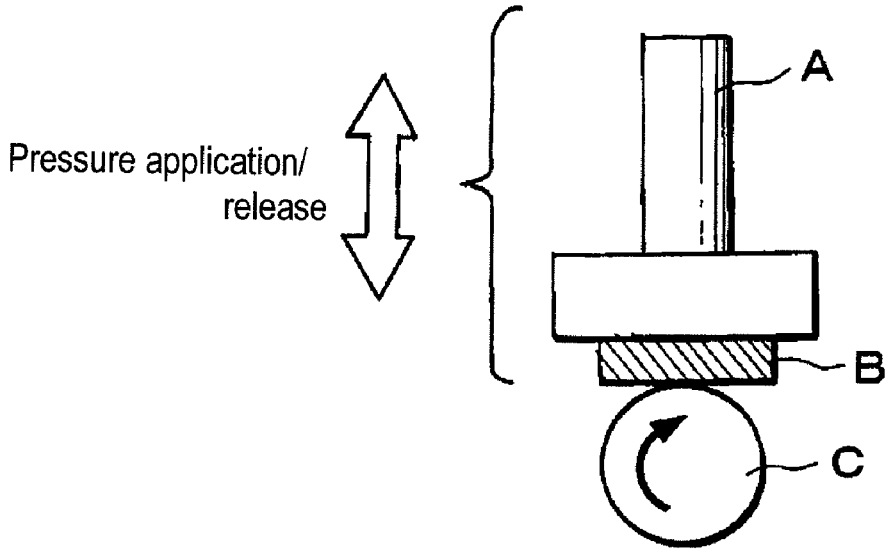
FIG. 1 is a view schematically illustrating a press-contact shape transfer/processing apparatus by a mold.

The electrophotographic photosensitive member of the present invention is an electrophotographic photosensitive member having a support, a charge generation layer provided on the support and a charge transport layer containing a charge transporting material and a binder resin and formed on the charge generation layer, the charge transport layer serving as a surface layer, as described above. Furthermore, the charge transport layer contains a polyester resin having a repeating structural unit represented by the following formula (1) and a repeating structural unit represented by the following formula (2), as a binder resin. Furthermore, the content of a siloxane moiety in the polyester resin is not less than 5% by mass and not more than 30% by mass relative to the total mass of the polyester resin. Furthermore, the content of the polyester resin in the charge transport layer is not less than 60% by mass relative to the total mass of the whole binder resin in the charge transport layer.

(1)

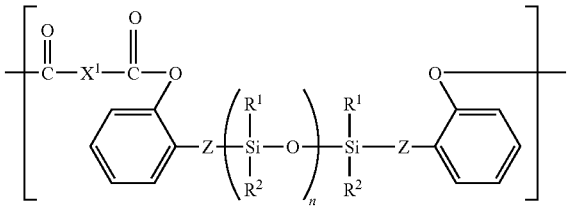

In the above formula (1), $X^1$ represents a divalent organic group; $R^1$ and $R^2$ each independently represent a substituted or unsubstituted alkyl group or a substituted or unsubstituted aryl group; Z represents a substituted or unsubstituted alkylene group having 1 or more and 4 or less carbon atoms; and n represents an average value of the number of repetitions of a structure within the brackets, ranging from 20 or more and 80 or less.

(2)

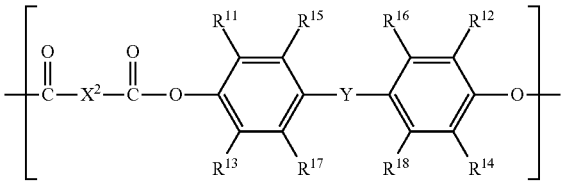

In the above formula (2), $R^{11}$ to $R^{18}$ each independently represent a hydrogen atom, a substituted or unsubstituted alkyl group, a substituted or unsubstituted aryl group or a substituted or unsubstituted alkoxy group; $X^2$ represents a divalent organic group; and Y represents a single bond, a substituted or unsubstituted alkylene group, a substituted or unsubstituted arylene group, an oxygen atom or a sulfur atom.

In the above formula (1), $X^1$ represents a divalent organic group.

As the divalent organic group, for example, a substituted or unsubstituted alkylene group, a substituted or unsubstituted cycloalkylene group, a substituted or unsubstituted arylene group, a substituted or unsubstituted biphenylene group or a divalent group having a plurality of phenylene groups bonded via an alkylene group, an oxygen atom or a sulfur atom may be mentioned. Of these, a substituted or unsubstituted alkylene group, a substituted or unsubstituted arylene group, a divalent group having a plurality of phenylene groups bonded via an alkylene group, an oxygen atom or a sulfur atom is preferable.

As the alkylene group, an alkylene group having 3 or more and 10 or less carbon atoms constituting the main chain can be used. Examples thereof include a propylene group, a butylene group, a pentylene group, a hexylene group, a heptylene group, an octylene group, a nonylene group and decylene group. Of these, a butylene group and a hexylene group are preferable.

As the cycloalkylene group, a cycloalkylene group having 5 or more and 10 or less carbon atoms constituting the ring can be used. Examples thereof include a cyclopentylene group, a cyclohexylene group, a cycloheptylene group, a cyclooctylene group, a cyclononylene group and a cyclodecylene group. Of these, a cyclohexylene group is preferable.

As the arylene group, for example, a phenylene group (an o-phenylene group, an m-phenylene group and a p-phenylene group) and a naphthylene group may be mentioned. Of these, an m-phenylene group and a p-phenylene group are preferable.

As the divalent phenylene group having a plurality of phenylene groups bonded via an alkylene group, an oxygen atom or a sulfur atom, an o-phenylene group, an m-phenylene group and a p-phenylene group may be mentioned. Of these, a p-phenylene group is preferable. As the alkylene group for binding a plurality of phenylene groups, substituted or unsubstituted alkylene group having 1 or more and 4 or less carbon atoms constituting the main chain can be used. Of these, a methylene group and an ethylene group are preferable.

As the substituents that the aforementioned groups may have, for example, an alkyl group, an alkoxy group and an aryl group may be mentioned. Examples of the alkyl group include a methyl group, an ethyl group, a propyl group and a butyl group. Examples of the alkoxy group include a methoxy group, an ethoxy group, a propoxy group and a butoxy group. Examples of the aryl group include a phenyl group. Of these, a methyl group is preferable.

Now, specific examples of $X^1$ in the above formula (1) will be shown below.

(3-1) $-(CH_2)_3-$ (3-2) $-(CH_2)_4-$ (3-3) $-(CH_2)_5-$ (3-4) $-(CH_2)_6-$ (3-5) $-(CH_2)_7-$ (3-6) $-(CH_2)_8-$ (3-7) $-(CH_2)_9-$ (3-8) $-(CH_2)_{10}-$ (3-9)

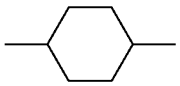

(3-10)

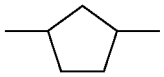

(3-11)

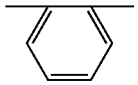

(3-12)

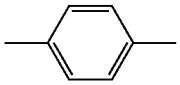

(3-13)

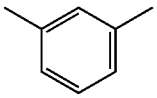

(3-14)

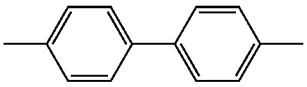

-continued (3-15)

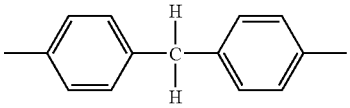

(3-16)

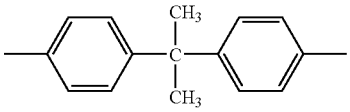

(3-17)

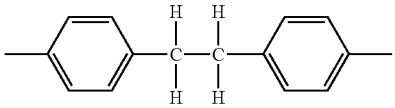

(3-18)

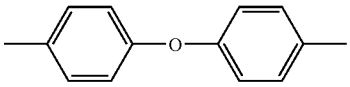

(3-19)

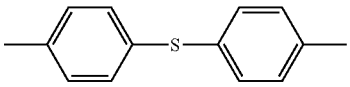

Of these, groups represented by the above formulas (3-2), (3-4), (3-12), (3-13) and (3-18) are preferable.

In the above formula (1), $X^1$ is not necessarily a kind of group. To improve the solubility and mechanical strength of a polyester resin, two or more groups may be used as $X^1$. For example, in the case where a group represented by the above formula (3-12) or (3-13) is used, use of another group in combination is preferable to single use in view of improvement of the solubility of a resin. When a group represented by the above formula (3-12) and a group represented by the above formula (3-13) are used in combination, the ratio (molar ratio) of a group represented by the above formula (3-12) relative to a group represented by the above formula (3-13) in a polyester resin is preferably 1:9 to 9:1 and more preferably 3:7 to 7:3.

In the above formula (1), $R^1$ and $R^2$ each independently represent a substituted or unsubstituted alkyl group or a substituted or unsubstituted aryl group.

Examples of the alkyl group include a methyl group, an ethyl group, a propyl group and a butyl group.

Examples of the aryl include a phenyl group.

Of these, $R^1$ and $R^2$ are preferably a methyl group in order to mitigate the contact stress.

In the above formula (1), Z represents substituted or unsubstituted alkylene group having 1 or more and 4 or less carbon atoms.

Examples of the alkylene group having 1 or more and 4 or less carbon atoms include a methylene group, an ethylene group, a propylene group and a butylene group. Of these, a propylene group is preferable in view of compatibility of a polyester resin with a charge transporting material (degree of resistance to aggregation of the charge transporting material in the polyester resin, the same applies to the following).

In the above formula (1), n represents an average number of repetitions of a structure (—$SiR^1R^2$—O—) within the brackets and ranges from 20 or more and 80 or less. When n is 20 or more and 80 or less, the compatibility of a polyester resin with a charge transporting material increases, aggregation of the charge transporting material in the polyester resin (a resin having a siloxane structure) can be suppressed. Particularly, it is preferred that n is 25 or more and 70 or less.

Specific examples of the repeating structural unit represented by the above formula (1) will be shown below.

(1-1)

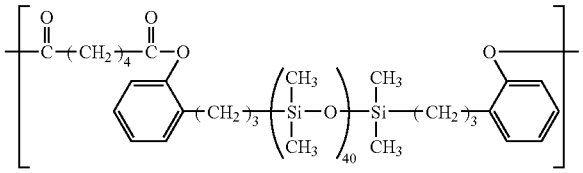

(1-2)

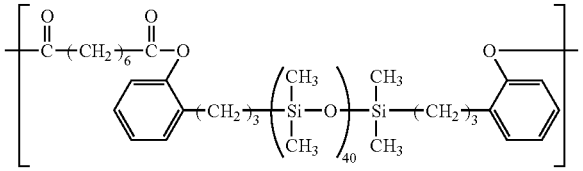

(1-3)

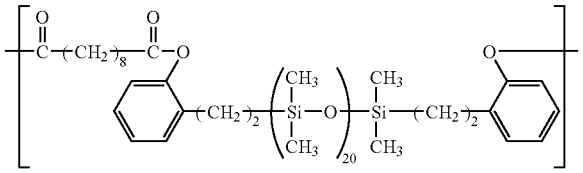

(1-4)

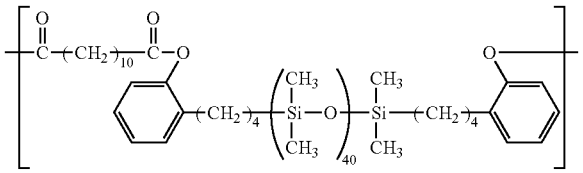

(1-5)

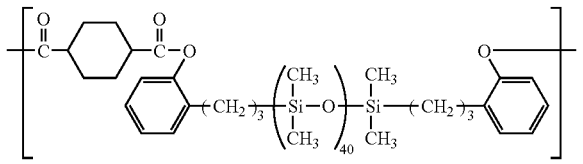

(1-6)

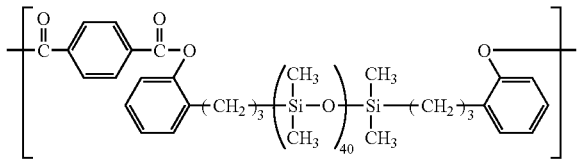

(1-7)

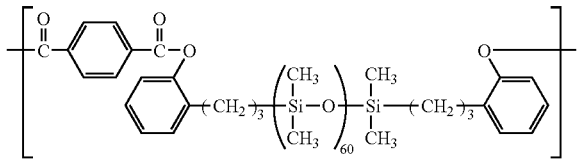

-continued
(1-8)
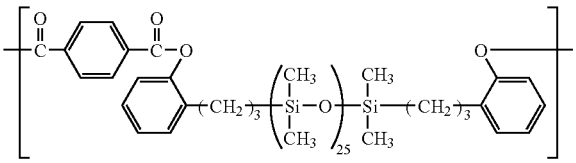
(1-9)
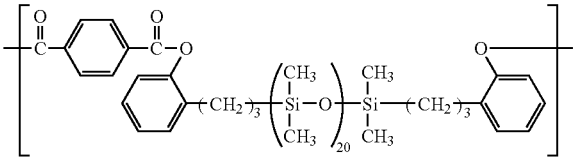
(1-10)
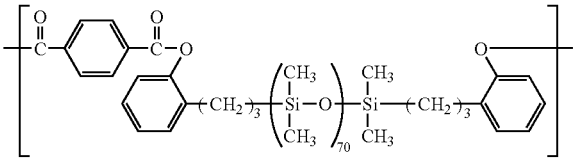
(1-11)
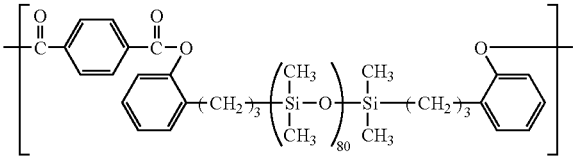
(1-12)
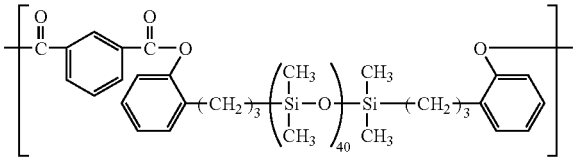
(1-13)
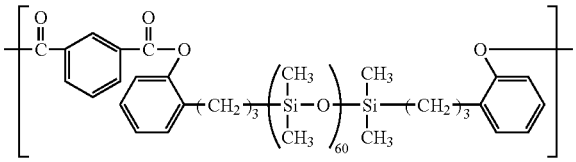
(1-14)
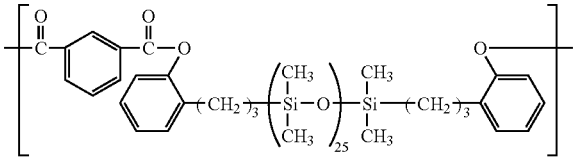
(1-15)
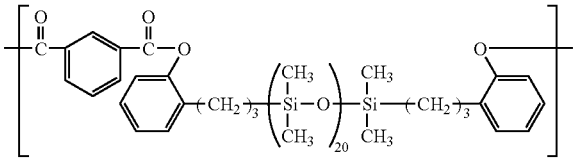
-continued
(1-16)
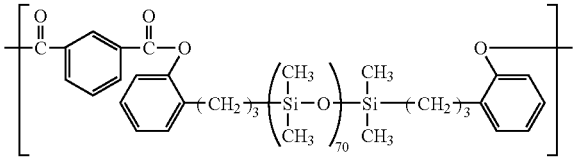
(1-17)
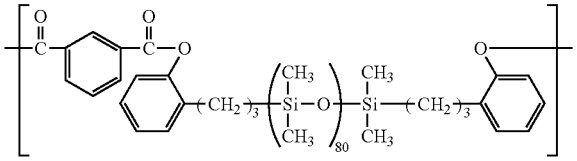
(1-18)
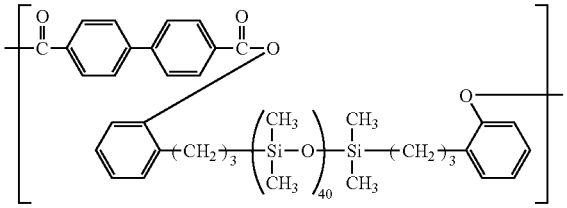
(1-19)
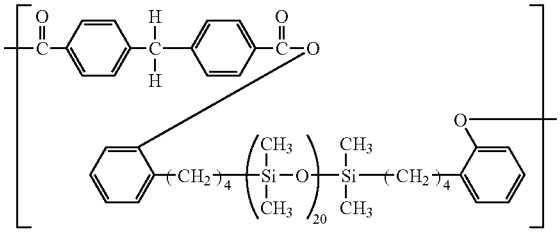
(1-20)
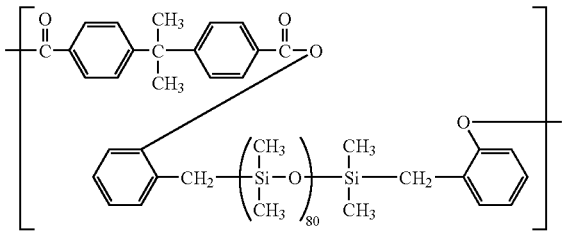
(1-21)
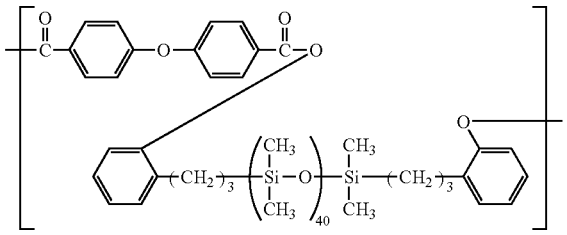

-continued (1-22)

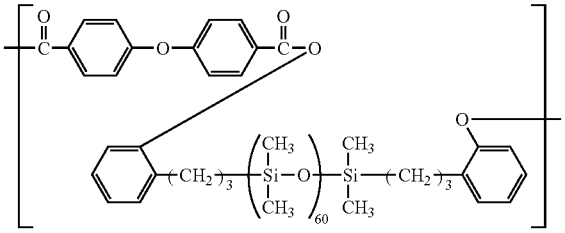

(1-23)

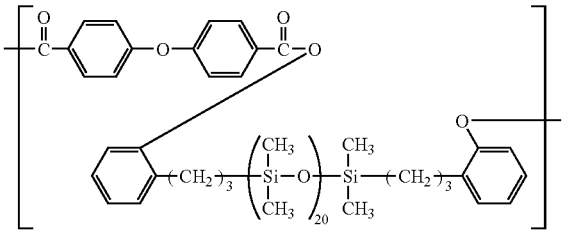

(1-24)

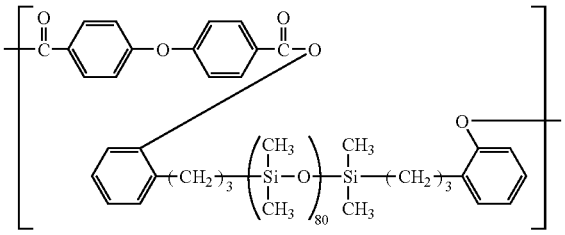

(1-25)

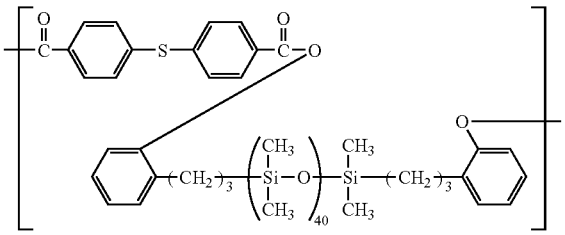

(1-26)

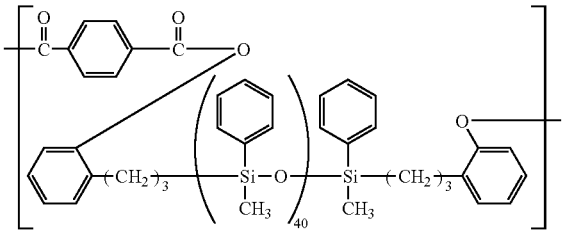

(1-27)

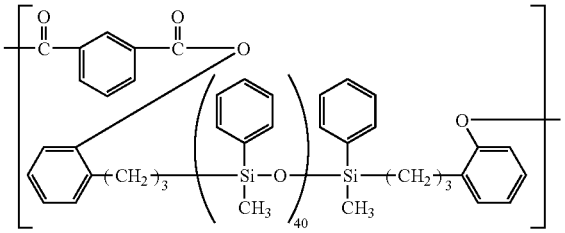

Of these, the repeating structural units represented by the above formulas (1-6), (1-7), (1-8), (1-10), (1-12), (1-13), (1-14), (1-16), (1-21) and (1-22) are preferable.

In the above formula (2), $R^{11}$ to $R^{18}$ each independently represent a hydrogen atom, a substituted or unsubstituted alkyl group, a substituted or unsubstituted aryl group or a substituted or unsubstituted alkoxy group.

As the alkyl group, for example, a methyl group, an ethyl group, a propyl group and a butyl group may be mentioned. As the aryl group, for example, a phenyl group and a naphthyl group may be mentioned. As the alkoxy group, for example, a methoxy group, an ethoxy group, a propoxy group, and a butoxy group may be mentioned. Of these, in view of compatibility of a polyester resin with a charge transporting material, a methyl group, an ethyl group, a methoxy group, an ethoxy group and a phenyl group are preferable, and a methyl group is more preferable.

In the above formula (2), $X^2$ represents a divalent organic group.

As the divalent organic group, a substituted or unsubstituted alkylene group, a substituted or unsubstituted cycloalkylene group, a substituted or unsubstituted arylene group, a substituted or unsubstituted biphenylene group or a divalent group having a plurality of phenylene groups bonded via an alkylene group, an oxygen atom or a sulfur atom may be mentioned. Of these, a substituted or unsubstituted alkylene group, a substituted or unsubstituted arylene group, and a divalent group having a plurality of phenylene groups bonded via an alkylene group, an oxygen atom or a sulfur atom are preferable.

As the alkylene group, an alkylene group having 3 or more and 10 or less carbon atoms constituting the main chain is preferable. Examples thereof include a propylene group, a butylene group, a pentylene group, a hexylene group, a heptylene group, an octylene group, a nonylene group and a decylene group. Of these, a butylene group and a hexylene group are preferable.

As the cycloalkylene group, a cycloalkylene group having 5 or more and 10 or less carbon atoms constituting the ring is preferable. Examples thereof include a cyclopentylene group, a cyclohexylene group, a cycloheptylene group, a cyclooctylene group, a cyclononylene group and a cyclodecylene group. Of these, a cyclohexylene group is preferable.

As the arylene group, for example, a phenylene group (an o-phenylene group, an m-phenylene group and a p-phenylene group) and a naphthylene group may be mentioned. Of these, an m-phenylene group and a p-phenylene group are preferable.

As the phenylene groups of the divalent group having a plurality of phenylene groups bonded via an alkylene group, an oxygen atom or a sulfur atom, an o-phenylene group, an m-phenylene group and a p-phenylene group may be mentioned. Of these, a p-phenylene group is preferable. As the alkylene group for binding a plurality of phenylene groups, a substituted or unsubstituted alkylene group having 1 or more and 4 or less carbon atoms constituting the main chain is preferable. Of these, a methylene group and an ethylene group are preferable.

As the substituents that the aforementioned groups may each have, for example, an alkyl group, an alkoxy group and an aryl group may be mentioned. As the alkyl group, for example, a methyl group, an ethyl group, a propyl group and a butyl group may be mentioned. As the alkoxy group, for example, a methoxy group, an ethoxy group, a propoxy group and a butoxy group may be mentioned. As the aryl group, for example, a phenyl group may be mentioned. Of these, a methyl group is preferable.

In the above formula (2), as the specific examples of $X^2$, the same examples as those for $X^1$ in the above formula (1) may be mentioned. Of them, groups represented by the above formulas (3-2), (3-4), (3-12), (3-13) and (3-18) are preferable.

In the above formula (2), Y represents a single bond, a substituted or unsubstituted alkylene group, a substituted or unsubstituted arylene group, an oxygen atom or a sulfur atom.

As the alkylene group, an alkylene group having 1 or more and 4 or less carbon atoms constituting the main chain is preferable. Examples thereof include a methylene group, an ethylene group, a propylene group and a butylene group may be mentioned. Of these, a methylene group is preferable in view of mechanical strength.

As the arylene group, for example, a phenylene group (an o-phenylene group, an m-phenylene group and a p-phenylene group), a biphenylene group and a naphthylene group may be mentioned.

As the substituents that the aforementioned groups may each have, for example, an alkyl group, an alkoxy group and an aryl may be mentioned. As the alkyl group, for example, a methyl group, an ethyl group, a propyl group and a butyl group may be mentioned. As the alkoxy group, for example, a methoxy group, an ethoxy group, a propoxy group and a butoxy group may be mentioned. As the aryl group, for example, a phenyl group may be mentioned.

In the above formula (2), Y is preferably a substituted or unsubstituted methylene group. Of them, a group represented by the following formula (5) is more preferable.

(5)

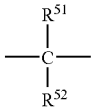

In the above formula (5), $R^{51}$ and $R^{52}$ each independently represent a hydrogen atom, a substituted or unsubstituted alkyl group, a substituted or unsubstituted aryl group or a substituted or unsubstituted alkoxy group; or $R^{51}$ and $R^{52}$ are joined to form a substituted or unsubstituted cycloalkylidene group or fluorenylidene group.

As the alkyl group, for example, a methyl group, an ethyl group, a propyl group and a butyl group may be mentioned. Of these, a methyl group is preferable. Furthermore, of the alkyl groups, as a substituted alkyl group, for example, fluoroalkyl groups such as a trifluoromethyl group and a pentafluoroethyl group may be mentioned.

As the aryl group, for example, a phenyl group and a naphthyl group may be mentioned.

As the alkoxy group, for example, a methoxy group, an ethoxy group, a propoxy group and a butoxy group may be mentioned.

As the cycloalkylidene group, for example, a cyclopentylidene group, a cyclohexylidene group and a cycloheptylidene group may be mentioned. Of these, a cycloheptylidene group is preferable.

Specific examples of the group represented by the above formula (5) are shown below.

(5-1)

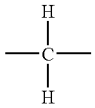

-continued (5-2)

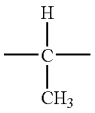

(5-3)

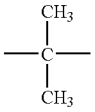

(5-4)

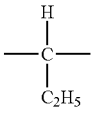

(5-5)

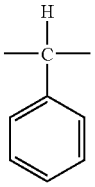

(5-6)

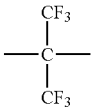

(5-7)

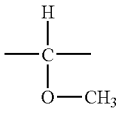

(5-8)

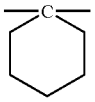

Of these, the groups represented by the above formula (5-1), (5-2), (5-3) and (5-8) are preferable.

Specific examples of the repeating structural unit represented by the above formula (2) are shown below.

(2-1)

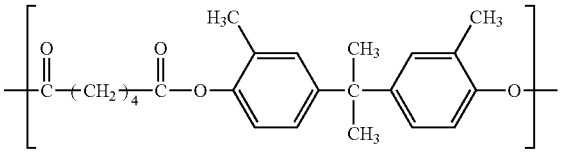

(2-2)

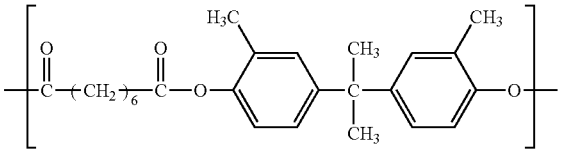

-continued
(2-3)
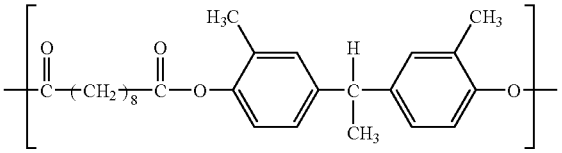
(2-4)
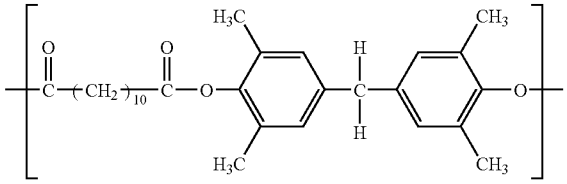
(2-5)
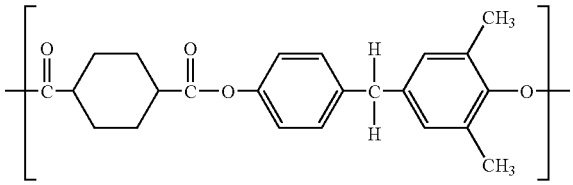
(2-6)
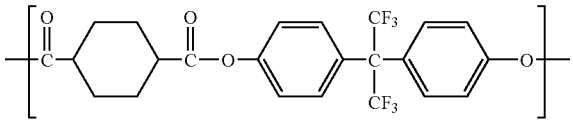
(2-7)
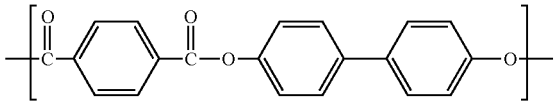
(2-8)
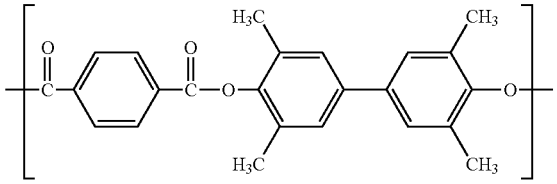
(2-9)
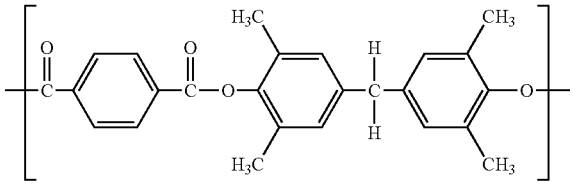
(2-10)
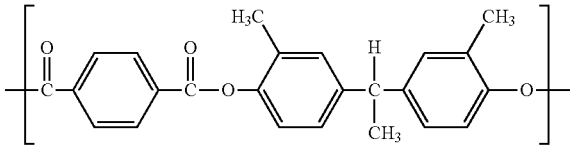
-continued
(2-11)
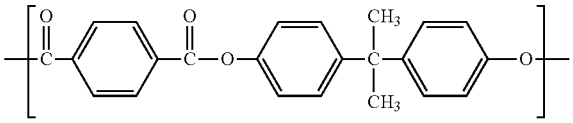
(2-12)
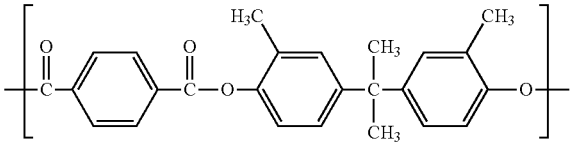
(2-13)
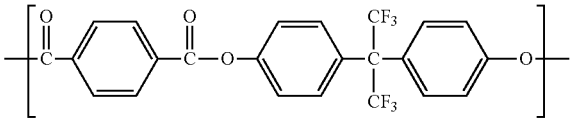
(2-14)
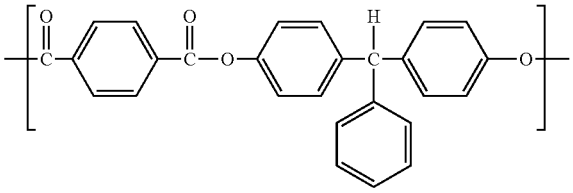
(2-15)
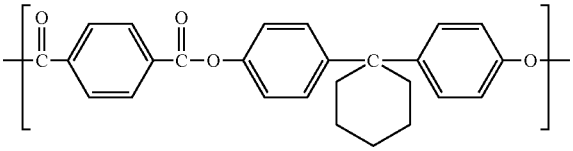
(2-16)
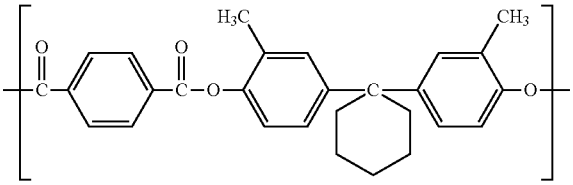
(2-17)
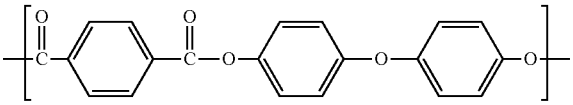
(2-18)
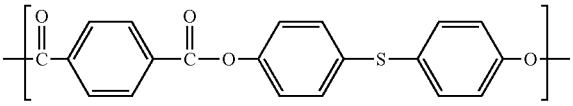
(2-19)
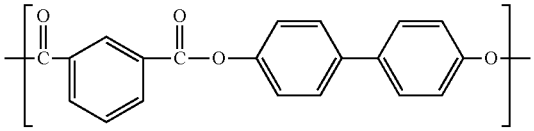

-continued
(2-20)
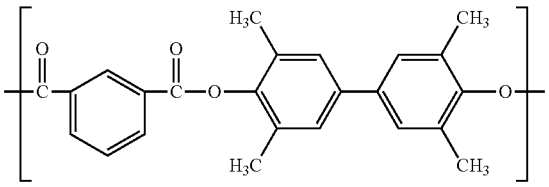
(2-21)
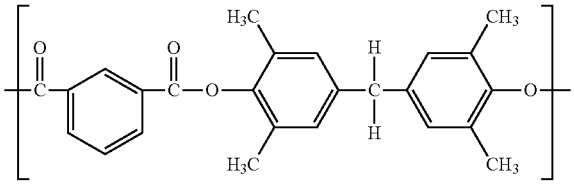
(2-22)
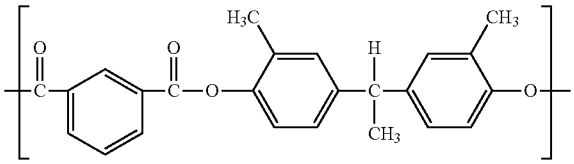
(2-23)
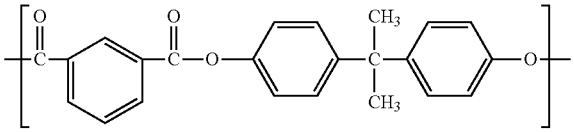
(2-24)
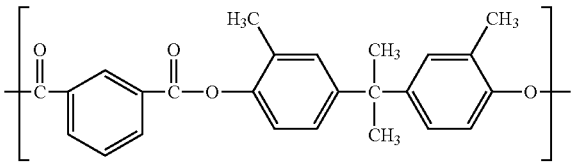
(2-25)
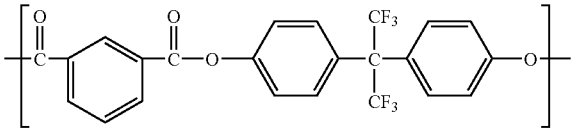
(2-26)
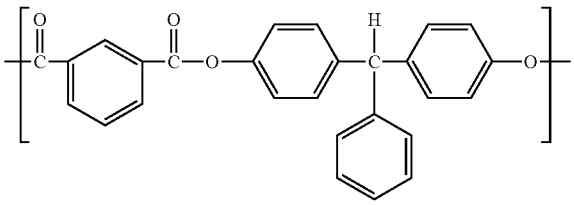
(2-27)
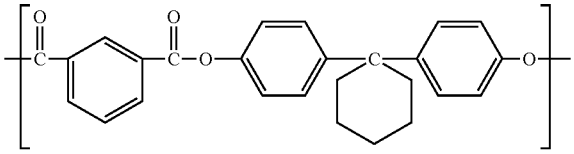
-continued
(2-28)
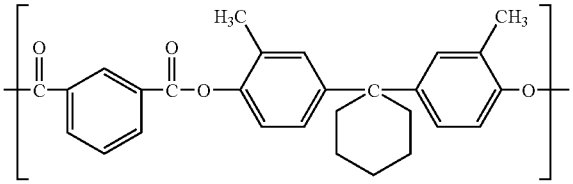
(2-29)
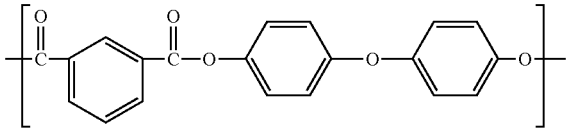
(2-30)
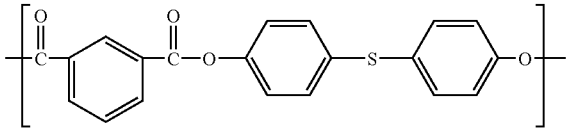
(2-31)
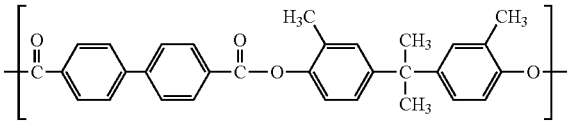
(2-32)
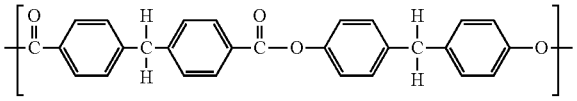
(2-33)
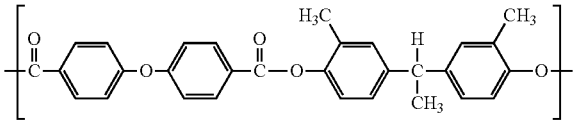
(2-34)
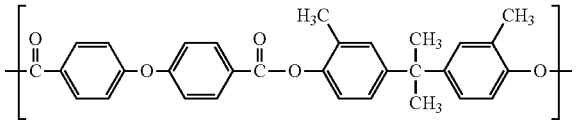
(2-35)
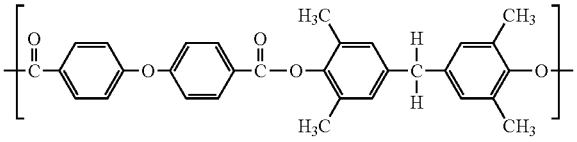
(2-36)
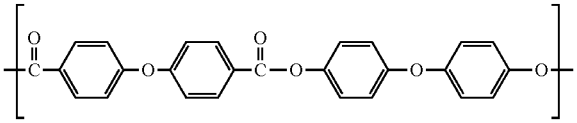
(2-37)
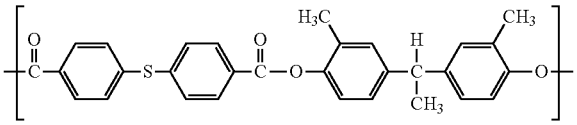

-continued (2-38)

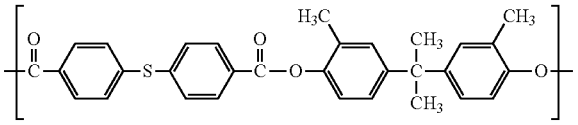

(2-39)

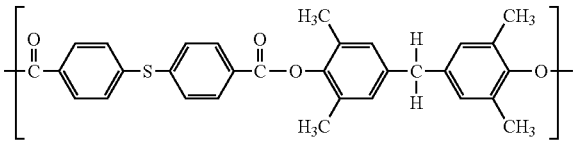

(2-40)

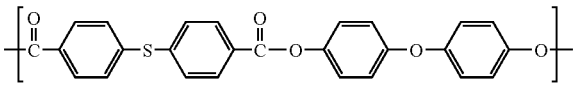

Of these, the repeating structural units represented by the above formulas (2-1), (2-2), (2-8), (2-9), (2-10), (2-12), (2-17), (2-20), (2-21), (2-22), (2-24), (2-29), (2-33), (2-34) and (2-35) are preferable.

Furthermore, in the present invention, of the polyester resins having a repeating structural unit represented by the above formula (1) and a repeating structural unit represented by the above formula (2), a polyester resin having a content of a siloxane moiety of not less than 5% by mass and not more than 30% by mass relative to the total mass of the polyester resin may be used. In particular, the content is preferably not less than 10% by mass and not more than 25% by mass.

In the present invention, the siloxane moiety refers to a moiety containing silicon atoms at both ends constituting a siloxane moiety and the groups binding to them, an oxygen atom sandwiched by the silicon atoms at the both ends, the silicon atoms and the groups binding to them. More specifically, the siloxane moiety in the present invention, for example, in the case of the repeating structural unit represented by the following formula (1-6-s), refers to the site surrounded by the broken line shown below.

(1-6-s)

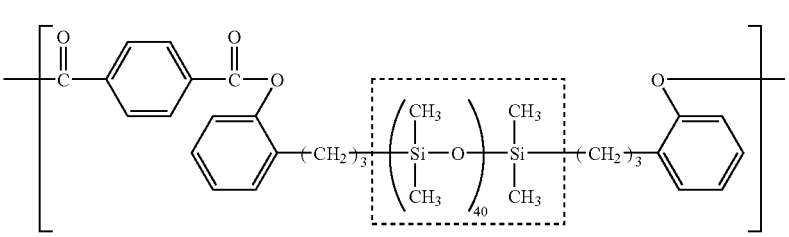

When the content of the siloxane moiety relative to the total mass of the polyester resin having a repeating structural unit represented by the above formula (1) and a repeating structural unit represented by the above formula (2) is not less than 5% by mass, the effect of mitigating contact stress is persistently exerted. Furthermore, when the content of the siloxane moiety is not more than 30% by mass, aggregation of a charge transporting material in the polyester resin is suppressed and potential stability during repeated use is improved.

The content of the siloxane moiety relative to the total mass of the polyester resin having a repeating structural unit represented by the above formula (1) and a repeating structural unit represented by the above formula (2) can be analyzed by a general analysis method. Examples of the analysis method are shown below.

After the charge transport layer serving as the surface layer of an electrophotographic photosensitive member is dissolved in a solvent, various types of materials contained in the charge transport layer serving as the surface layer are separated by a separation apparatus capable of separating and recovering components, such as size exclusion chromatography and high performance liquid chromatography. The polyester resin thus separated is hydrolyzed in the presence of alkali and decomposed into a carboxylic acid portion and a bisphenol portion. The bisphenol portion obtained is subjected to nuclear magnetic resonance spectrum analysis and mass spectrometry to calculate the number of repetitions in the siloxane portion and a molar ratio thereof, and computationally convert them into a content (mass ratio).

The above polyester resin to be used in the present invention is a copolymer formed of a repeating structural unit represented by the above formula (1) and a repeating structural unit represented by the above formula (2). The copolymerization form may be any one of block copolymerization, random copolymerization and alternating copolymerization. Particularly, random copolymerization is preferable.

The weight average molecular weight of the above polyester resin to be used in the present invention is preferably 80,000 or more, and more preferably 90,000 or more, in view of mechanical strength of the polyester resin and durability of an electrophotographic photosensitive member. On the other hand, in view of solubility and productivity of an electrophotographic photosensitive member, the weight average molecular weight is preferably 400,000 or less, and more preferably 300,000 or less.

In the present invention, the weight average molecular weight of a resin refers to a weight average molecular weight converted in terms of polystyrene measured according to a customary method as shown below.

More specifically, the resin to be measured was put in tetrahydrofuran and allowed to stand still for several hours. Thereafter, the resin to be measured and tetrahydrofuran were sufficiently mixed while stirring and allowed to stand further for 12 hours or more. Thereafter, the mixture was passed through a sample treatment filter (My-Shori Disc H-25-5, manufactured by Tohso Corporation) to obtain a sample for GPC (gel permeation chromatography).

Subsequently, a column was stabilized in a heat chamber of 40° C. To the column of this temperature, tetrahydrofuran was poured as a solvent at a flow rate of 1 ml per minute, and the GPC sample (10 μl) obtained above was poured. As the column, the column, TSKgel Super HM-M (manufactured by Tohso Corporation) was used.

In measuring the weight average molecular weight of the resin to be measured, the molecular weight distribution of the resin to be measured was calculated based on the relationship between a logarithmic value of a calibration curve, which is prepared by using a plurality of monodispersed polystyrene standard samples, and a count number. As the polystyrene standard samples used in preparing the calibration curve, ten monodispersed polystyrene samples (manufactured by Aldrich) having a molecular weight of 3,500, 12,000, 40,000, 75,000, 98,000, 120,000, 240,000, 500,000, 800,000 and 1,800,000 in total were used. As a detector, an RI (refractive index) detector was used.

The copolymerization ratio of the aforementioned polyester resin to be used in the present invention can be confirmed by a general method, that is, a conversion method based on the peak area ratio of hydrogen atoms (hydrogen atoms constituting the resin) obtained by 1H-NMR measurement of a resin.

The above polyester resin to be used in the present invention can be synthesized, for example, by a transesterification method between a dicarboxylic ester and a diol compound. Alternatively, the polyester resin can be synthesized by a polymerization reaction between a divalent acid halide such as dicarboxylic acid halide and a diol compound.

Synthesis Examples of the above polyester resin to be used in the present invention will be described below.

SYNTHESIS EXAMPLE 1

Synthesis of Polyester Resin A1 Having Repeating Structural Units Represented by the Above Formulas (1-6), (1-12), (2-12) and (2-24)

Dicarboxylic acid halide (24.6 g) represented by the following formula (6-1):

(6-1)

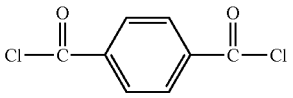

and dicarboxylic acid halide (24.6 g) represented by the following formula (6-2):

(6-2)

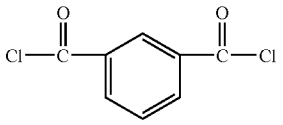

were dissolved in dichloromethane to prepare an acid halide solution.

Furthermore, separately from the acid halide solution, a diol (21.7 g) having a siloxane structure represented by the following formula (7-1):

(7-1)

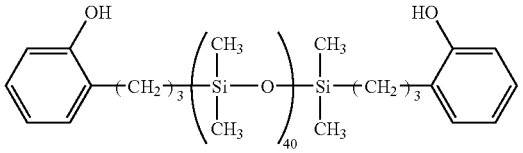

and a diol (43.9 g) represented by the following formula (8-1):

(8-1)

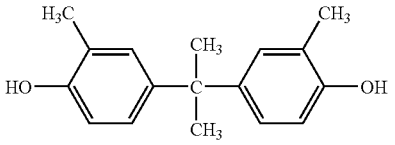

were dissolved in a 10% aqueous sodium hydroxide solution. Furthermore, tributylbenzyl ammonium chloride was added as a polymerization catalyst and stirred to prepare a diol compound solution.

Next, the above acid halide solution was added to the above diol compound solution while stirring to initiate polymerization. The polymerization was performed for 3 hours with stirring while the reaction temperature was maintained at 25° C. or less.

Thereafter, acetic acid was added to terminate the polymerization reaction. Washing with water was repeated until the water phase was neutralized. After washing, the resultant solution was added dropwise to methanol under stirring to precipitate a polymer. The polymer was dried under vacuum to obtain polyester resin A1 (80 g) having repeating structural units represented by the above formulas (1-6), (1-12), (2-12) and (2-24). This is shown in Table 1.

As the content of the siloxane moiety in polyester resin A1 was calculated as described above, it was 20% by mass. Furthermore, the weight average molecular weight of polyester resin A1 was 130,000.

SYNTHESIS EXAMPLES 2 TO 8

Synthesis of polyester resins A2 to A8 having repeating structural units represented by the above formulas (1-6), (1-12), (2-12) and (2-24)

Use amounts of dicarboxylic acid halides (6-1) and (6-2) and the diol compounds (7-1) and (8-1) used in Synthesis Example 1 in synthesizing were controlled to synthesize polyester resins A2 to A8 shown in Table 1.

Furthermore, the contents of the siloxane moieties in polyester resins A2 to A8 were calculated in the same manner as in Synthesis Example 1 and shown in Table 1.

Furthermore, the weight average molecular weights of the polyester resins A2 to A8 were measured in the same manner as in Synthesis Example 1. The weight average molecular weights were respectively:

polyester resin A2: 120,000
polyester resin A3: 100,000
polyester resin A4: 80,000
polyester resin A5: 130,000
polyester resin A6: 150,000
polyester resin A7: 120,000
polyester resin A8: 100,000.

SYNTHESIS EXAMPLE 9

Synthesis of polyester resin B1 having repeating structural units represented by the above formulas (1-7), (1-13), (2-12) and (2-24).

Dicarboxylic acid halide (24.4 g) represented by the above formula (6-1) and dicarboxylic acid halide (24.4 g) represented by the above formula (6-2) were dissolved in dichloromethane to prepare an acid halide solution.

Furthermore, separately from the acid halide solution, using diol (21.0 g) having the siloxane structure represented by the following formula (7-2):

(7-2)

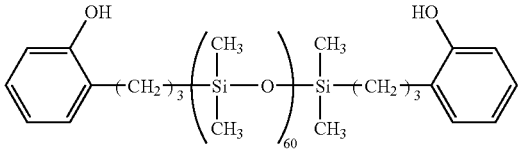

and diol (44.2 g) represented by the above formula (8-1), the same operation as in Synthesis Example 1 was performed to obtain polyester resin B1 (70 g) having repeating structural units represented by, the above formulas (1-7), (1-13), (2-12) and (2-24). This is shown in Table 1.

Furthermore, the content of the siloxane moiety of polyester resin B1 was calculated in the same manner as in Synthesis Example 1 and shown in Table 1.

Furthermore, the weight average molecular weight of polyester resin B1 was measured in the same manner as in Synthesis Example 1. The weight average molecular weight of polyester resin B1 was 125,000.

SYNTHESIS EXAMPLES 10 TO 12

Synthesis of polyester resins B2 to B4 having repeating structural units represented by the above formulas (1-7), (1-13), (2-12) and (2-24).

Use amounts of dicarboxylic acid halides (6-1) and (6-2) and the diol compounds (7-2) and (8-1) used in Synthesis Example 9 in synthesizing were controlled to synthesize polyester resins B2 to B4 shown in Table 1.

Furthermore, the contents of siloxane moieties of polyester resins B2 to B4 were calculated in the same manner as in Synthesis Example 1, and shown in Table 1.

Furthermore, the weight average molecular weights of polyester resin B2 to B4 were measured in the same manner as in Synthesis Example 1. The weight average molecular weights were respectively:

polyester resin B2: 130,000 polyester resin B3: 90,000 polyester resin B4: 140,000

SYNTHESIS EXAMPLE 13

Synthesis of polyester resin C z structural units represented by the above formulas (1-8), (1-14), (2-9) and (2-21).

Dicarboxylic acid halide (24.9 g) represented by the above formula (6-1) and dicarboxylic acid halide (24.9 g) represented by the above formula (6-2) were dissolved in dichloromethane to prepare an acid halide solution.

Furthermore, separately from the acid halide solution, using diol (21.8 g) having the siloxane structure represented by the following formula (7-3):

(7-3)

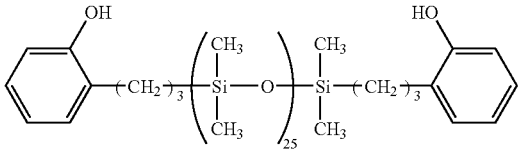

and diol (43.5 g) represented by the following formula (8-2):

(8-2)

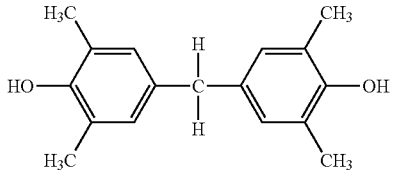

the same operation as in Synthesis Example 1 was performed to obtain polyester resin C (70 g) having repeating structural units represented by the above formulas (1-8), (1-14), (2-9) and (2-21). This is shown in Table 1.

Furthermore, the content of the siloxane moiety in polyester resin C was calculated in the same manner as in Synthesis Example 1 and shown in Table 1.

Furthermore, weight average molecular weight of polyester resin C was measured in the same manner as in Synthesis Example 1. The weight average molecular weight was 120,000.

SYNTHESIS EXAMPLE 14

Synthesis of polyester resin D having repeating structural units represented by the above formulas (1-9), (1-15), (2-15) and (2-27).

Dicarboxylic acid halide (24.0 g) represented by the above formula (6-1) and dicarboxylic acid halide (24.0 g) represented by the above formula (6-2) were dissolved in dichloromethane to prepare an acid halide solution.

Furthermore, separately from the acid halide solution, using diol (23.5 g) having the siloxane structure represented by the following formula (7-4):

(7-4)

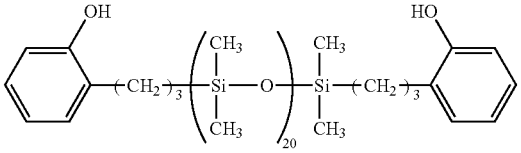

and diol (44.5 g) represented by the following formula (8-3):

(8-3)

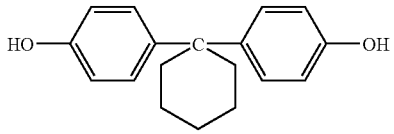

the same operation as in Synthesis Example 1 was performed to obtain polyester resin D (70 g) having repeating structural units represented by the above formulas (1-9), (1-15), (2-15) and (2-27). This is shown in Table 1.

Furthermore, the content of a siloxane moiety in polyester resin D was calculated in the same manner as in Synthesis Example 1 and shown in Table 1.

Furthermore, the weight average molecular weight of polyester resin D was measured in the same manner as in Synthesis Example 1. The weight average molecular weight was 100,000.

SYNTHESIS EXAMPLE 15

Synthesis of Polyester resin E having repeating structural units represented by the above formulas (1-10), (1-16), (2-7) and (2-19.

Dicarboxylic acid halide (28.0 g) represented by the above formula (6-1) and dicarboxylic acid halide (28.0 g) represented by the above formula (6-2) were dissolved in dichloromethane to prepare an acid halide solution.

Furthermore, separately from the acid halide solution, using diol (21.3 g) having the siloxane structure represented by the following formula (7-5):

(7-5)

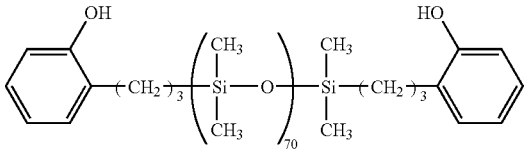

and diol (38.4 g) represented by the following formula (8-4):

(8-4)

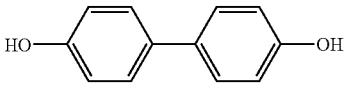

the same operation as in Synthesis Example 1 was performed to obtain polyester resin E (60 g) having repeating structural units represented by the above formulas (1-10), (1-16), (2-7) and (2-19). This is shown in Table 1.

Furthermore, the content of a siloxane moiety in polyester resin E was calculated in the same manner as in Synthesis Example 1 and shown in Table 1.

Furthermore, the weight average molecular weight of polyester resin E was measured in the same manner as in Synthesis Example 1. The weight average molecular weight was 150,000.

SYNTHESIS EXAMPLE 16

Synthesis of polyester resin F having repeating structural units represented by the above formulas (1-11), (1-17), (2-12) and (2-24).

Dicarboxylic acid halide (24.3 g) represented by the above formula (6-1) and dicarboxylic acid halide (24.3 g) represented by the above formula (6-2) were dissolved in dichloromethane to prepare an acid halide solution.

Furthermore, separately from the acid halide solution, using diol (20.6 g) having the siloxane structure represented by the following formula (7-6):

(7-6)

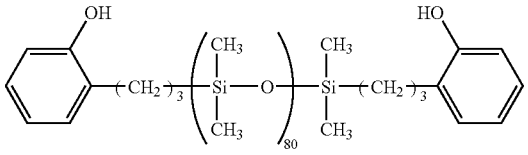

and diol (44.3 g) represented by the above formula (8-1), the same operation as in Synthesis Example 1 was performed to obtain polyester resin F (60 g) having repeating structural units represented by the above formulas (1-11), (1-17), (2-12) and (2-24). This is shown in Table 1.

Furthermore, the content of a siloxane moiety in polyester resin F was calculated in the same manner as in Synthesis Example 1 and shown in Table 1.

Furthermore, the weight average molecular weight of polyester resin F was measured in the same manner as in Synthesis Example 1. The weight average molecular weight was 140,000.

SYNTHESIS EXAMPLE 17

Synthesis of polyester resin G having repeating structural units represented by the above formulas (1-26), (1-27), (2-12) and (2-24).

Dicarboxylic acid halide (24.4 g) represented by the above formula (6-1) and dicarboxylic acid halide (24.4 g) represented by the above formula (6-2) were dissolved in dichloromethane to prepare an acid halide solution.

Furthermore, separately from the acid halide solution, using diol (21.3 g) having the siloxane structure represented by the following formula (7-7):

(7-7)

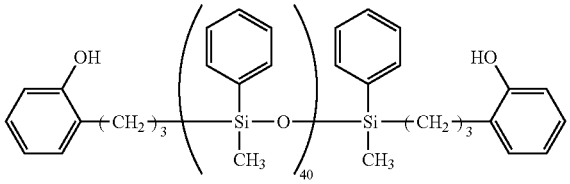

and diol (44.2 g) represented by the above formula (8-1), the same operation as in Synthesis Example 1 was performed to obtain polyester resin G (65 g) having repeating structural units represented by the above formulas (1-26), (1-27), (2-12) and (2-24). This is shown in Table 1.

Furthermore, the content of a siloxane moiety in polyester resin G was calculated in the same manner as in Synthesis Example 1 and shown in Table 1.

Furthermore, the weight average molecular weight of polyester resin G was measured in the same manner as in Synthesis Example 1. The weight average molecular weight was 120,000.

SYNTHESIS EXAMPLE 18

Synthesis of polyester resin H having repeating structural units represented by the above formulas (1-21) and (2-33).

Dicarboxylic acid halide (51.7 g) represented by the following formula (6-3):

(6-3)

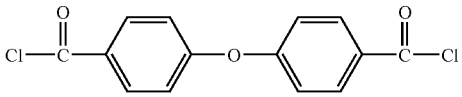

was dissolved in dichloromethane to prepare an acid halide solution.

Furthermore, separately from the acid halide solution, using diol (21.7 g) having a siloxane structure and represented by the above formula (7-1) and diol (40.6 g) represented by the following formula (8-5):

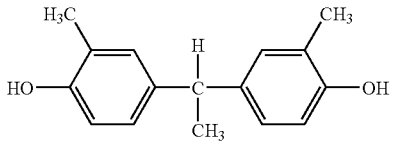

(8-5)

the same operation as in Synthesis Example 1 was performed to obtain polyester resin H (70 g) having repeating structural units represented by the above formulas (1-21) and (2-33). This is shown in Table 1.

Furthermore, the content of a siloxane moiety in polyester resin H was calculated in the same manner as in Synthesis Example 1 and shown in Table 1.

Furthermore, the weight average molecular weight of polyester resin H was measured in the same manner as in Synthesis Example 1. The weight average molecular weight was 120,000.

SYNTHESIS EXAMPLE 19

Synthesis of polyester resin I having repeating structural units represented by the above formulas (1-22) and (2-33).

Dicarboxylic acid halide (51.4 g) represented by the above formula (6-3) was dissolved in dichloromethane to prepare an acid halide solution.

Furthermore, separately from the acid halide solution, using diol (21.0 g) having a siloxane structure and represented by the above formula (7-2) and diol (41.2 g) represented by the above formula (8-5), the same operation as in Synthesis Example 1 was performed to obtain polyester resin I (65 g) having repeating structural units represented by the above formulas (1-22) and (2-33). This is shown in Table 1.

Furthermore, the content of a siloxane moiety in polyester resin I was calculated in the same manner as in Synthesis Example 1 and shown in Table 1.

Furthermore, the weight average molecular weight of polyester resin I was measured in the same manner as in Synthesis Example 1. The weight average molecular weight was 130,000.

SYNTHESIS EXAMPLE 20

Synthesis of polyester resin J having repeating structural units represented by the above formulas (1-23) and (2-33).

Dicarboxylic acid halide (52.7 g) represented by the above formula (6-3) was dissolved in dichloromethane to prepare an acid halide solution.

Furthermore, separately from the acid halide solution, using diol (23.5 g) having a siloxane structure and represented by the above formula (7-4) and diol (40.2 g) represented by the above formula (8-5), the same operation as in Synthesis Example 1 was performed to obtain polyester resin J (60 g) having repeating structural units represented by the above formulas (1-23) and (2-33). This is shown in Table 1.

Furthermore, the content of a siloxane moiety in polyester resin J was calculated in the same manner as in Synthesis Example 1 and shown in Table 1.

Furthermore, the weight average molecular weight of polyester resin J was measured in the same manner as in Synthesis Example 1. The weight average molecular weight was 110,000.

SYNTHESIS EXAMPLE 21

Synthesis of polyester resin K having repeating structural units represented by the above formulas (1-24) and (2-33).

Dicarboxylic acid halide (51.2 g) represented by the above formula (6-3) was dissolved in dichloromethane to prepare an acid halide solution.

Furthermore, separately from the acid halide solution, using diol (20.6 g) having a siloxane structure and represented by the above formula (7-6) and diol (41.3 g) represented by the above formula (8-5), the same operation as in Synthesis Example 1 was performed to obtain polyester resin K (60 g) having repeating structural units represented by the above formulas (1-23) and (2-33). This is shown in Table 1.

Furthermore, the content of a siloxane moiety in polyester resin K was calculated in the same manner as in Synthesis Example 1 and shown in Table 1.

Furthermore, the weight average molecular weight of polyester resin K was measured in the same manner as in Synthesis Example 1. The weight average molecular weight was 160,000.

SYNTHESIS EXAMPLE 22

Synthesis of polyester resin L having repeating structural units represented by the above formulas (1-21), (1-12), (2-34) and (2-24).

Dicarboxylic acid halide (34.6 g) represented by the above formula (6-3) and dicarboxylic acid halide (15.4 g) represented by the above formula (6-2) were dissolved in dichloromethane to prepare an acid halide solution.

Furthermore, separately from the acid halide solution, using diol (21.7 g) represented by the above formula (7-1) and diol (42.7 g) represented by the above formula (8-1), the same operation as in Synthesis Example 1 was performed to obtain polyester resin L (65 g) having repeating structural units represented by the above formulas (1-21), (1-12), (2-34) and (2-24). This is shown in Table 1.

Furthermore, the content of a siloxane moiety in polyester resin L was calculated in the same manner as in Synthesis Example 1 and shown in Table 1.

Furthermore, the weight average molecular weight of polyester resin L was measured in the same manner as in Synthesis Example 1. The weight average molecular weight was 120,000.

SYNTHESIS EXAMPLE 23

Synthesis of polyester resin M having repeating structural units represented by the above formulas (1-22), (1-13), (2-34) and (2-24).

Dicarboxylic acid halide (34.3 g) represented by the above formula (6-3) and dicarboxylic acid halide (15.1 g) represented by the above formula (6-2) were dissolved in dichloromethane to prepare an acid halide solution.

Furthermore, separately from the acid halide solution, using diol (21.0 g) having a siloxane structure and represented by the above formula (7-2) and diol (43.0 g) represented by the above formula (8-1), the same operation as in Synthesis Example 1 was performed to obtain polyester resin M (60 g) having repeating structural units represented by the above formulas (1-22), (1-13), (2-34) and (2-24). This is shown in Table 1.

Furthermore, the content of a siloxane moiety in polyester resin M was calculated in the same manner as in Synthesis Example 1 and shown in Table 1.

Furthermore, the weight average molecular weight of polyester resin M was measured in the same manner as in Synthesis Example 1. The weight average molecular weight was 125,000.

SYNTHESIS EXAMPLE 24

Synthesis of polyester resin N having repeating structural units represented by the above formulas (1-23), (1-15), (2-34) and (2-24).

Dicarboxylic acid halide (35.4 g) represented by the above formula (6-3) and dicarboxylic acid halide (15.5 g) represented by the above formula (6-2) were dissolved in dichloromethane to prepare an acid halide solution.

Furthermore, separately from the acid halide solution, using diol (23.5 g) having a siloxane structure and represented by the above formula (7-4) and diol (42.0 g) represented by the above formula (8-1), the same operation as in Synthesis Example 1 was performed to obtain polyester resin N (60 g) having repeating structural units represented by the above formulas (1-23), (1-15), (2-34) and (2-24). This is shown in Table 1.

Furthermore, the content of a siloxane moiety in polyester resin N was calculated in the same manner as in Synthesis Example 1 and shown in Table 1.

Furthermore, the weight average molecular weight of polyester resin N was measured in the same manner as in Synthesis Example 1. The weight average molecular weight was 95,000.

SYNTHESIS EXAMPLE 25

Synthesis of polyester resin O having repeating structural units represented by the above formulas (1-24), (1-17), (2-34) and (2-24).

Dicarboxylic acid halide (34.2 g) represented by the above formula (6-3) and dicarboxylic acid halide (15.1 g) represented by the above formula (6-2) were dissolved in dichloromethane to prepare an acid halide solution.

Furthermore, separately from the acid halide solution, using diol (20.6 g) having a siloxane structure and represented by the above formula (7-6) and diol (34.2 g) represented by the above formula (8-1), the same operation as in Synthesis Example 1 was performed to obtain polyester resin O (60 g) having repeating structural units represented by the above formulas (1-24), (1-17), (2-34) and (2-24). This is shown in Table 1.

Furthermore, the content of a siloxane moiety in polyester resin O was calculated in the same manner as in Synthesis Example 1 and shown in Table 1.

Furthermore, the weight average molecular weight of polyester resin O was measured in the same manner as in Synthesis Example 1. The weight average molecular weight was 155,000.

SYNTHESIS EXAMPLE 26

Synthesis of polyester resin P having repeating structural units represented by the above formulas (1-1) and (2-1).

Dicarboxylic acid halide (40.6 g) represented by the following formula (6-4):

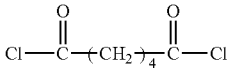

(6-4)

was dissolved in dichloromethane to prepare an acid halide solution.

Furthermore, separately from the acid halide solution, using diol (21.7 g) having a siloxane structure and represented by the above formula (7-1) and diol (55.4 g) represented by the above formula (8-1), the same operation as in Synthesis Example 1 was performed to obtain polyester resin P (65 g) having repeating structural units represented by the above formulas (1-1) and (2-1). This is shown in Table 1.

Furthermore, the content of a siloxane moiety in polyester resin P was calculated in the same manner as in Synthesis Example 1 and shown in Table 1.

Furthermore, the weight average molecular weight of polyester resin P was measured in the same manner as in Synthesis Example 1. The weight average molecular weight was 105,000.

SYNTHESIS EXAMPLE 27

Synthesis of polyester resin Q having repeating structural units represented by the above formulas (1-2) and (2-2)

Dicarboxylic acid halide (42.7 g) represented by the following formula (6-5):

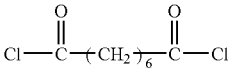

(6-5)

was dissolved in dichloromethane to prepare an acid halide solution.

Furthermore, separately from the acid halide solution, using diol (21.7 g) having an siloxane structure represented by the above formula (7-1) and diol (52.0 g) represented by the above formula (8-1), the same operation as in Synthesis Example 1 was performed to obtain polyester resin Q (60 g) having repeating structural units represented by the above formulas (1-1) and (2-1). This is shown in Table 1.

Furthermore, the content of a siloxane moiety in polyester resin Q was calculated in the same manner as in Synthesis Example 1 and shown in Table 1.

Furthermore, the weight average molecular weight of polyester resin Q was measured in the same manner as in Synthesis Example 1. The weight average molecular weight was 140,000.

SYNTHESIS EXAMPLE 28

Synthesis of polyester resin R having repeating structural units represented by the above formulas (1-1), (1-12), (2-1) and (2-24)

Dicarboxylic acid halide (16.0 g) represented by the above formula (6-4) and dicarboxylic acid halide (31.5 g) represented by the above formula (6-2) were dissolved in dichloromethane to prepare an acid halide solution.

Furthermore, separately from the acid halide solution, using diol (21.7 g) having a siloxane structure and represented by the above formula (7-1) and diol (47.2 g) represented by the above formula (8-1), the same operation as in Synthesis Example 1 was performed to obtain polyester resin R (65 g) having repeating structural units represented by the above formulas (1-1), (1-12), (2-1) and (2-24). This is shown in Table 1.

Furthermore, the content of a siloxane moiety in polyester resin R was calculated in the same manner as in Synthesis Example 1 and shown in Table 1.

Furthermore, the weight average molecular weight of polyester resin R was measured in the same manner as in Synthesis Example 1. The weight average molecular weight was 120,000.

SYNTHESIS EXAMPLE 29

Synthesis of polyester resin S having repeating structural units represented by the above formulas (1-2), (1-12), (2-2) and (2-24)

Dicarboxylic acid halide (15.2 g) represented by the above formula (6-5) and dicarboxylic acid halide (32.4 g) represented by the above formula (6-2) were dissolved in dichloromethane to prepare an acid halide solution.

Furthermore, separately from the acid halide solution, using diol (21.7 g) having a siloxane structure and represented by the above formula (7-1) and diol (46.3 g) represented by the above formula (8-1), the same operation as in Synthesis Example 1 was performed to obtain polyester resin S (60 g) having repeating structural units represented by the above formulas (1-2), (1-12), (2-2) and (2-24). This is shown in Table 1.

Furthermore, the content of a siloxane moiety in polyester resin S was calculated in the same manner as in Synthesis Example 1 and shown in Table 1.

Furthermore, the weight average molecular weight of polyester resin S was measured in the same manner as in Synthesis Example 1. The weight average molecular weight was 130,000.

TABLE 1

| | | Repeating structural unit represented by formula (1) | Repeating structural unit represented by formula (2) | Content (% by mass) of siloxane moiety in polyester resin |
|---|---|---|---|---|
| Synthesis Example 1 | Polyester resin A1 | (1-6)/(1-12) = 5/5 | (2-12)/(2-24) = 5/5 | 20 |
| Synthesis Example 2 | Polyester resin A2 | (1-6)/(1-12) = 7/3 | (2-12)/(2-24) = 7/3 | 20 |
| Synthesis Example 3 | Polyester resin A3 | (1-6)/(1-12) = 3/7 | (2-12)/(2-24) = 3/7 | 20 |
| Synthesis Example 4 | Polyester resin A4 | (1-6)/(1-12) = 9/1 | (2-12)/(2-24) = 9/1 | 20 |
| Synthesis Example 5 | Polyester resin A5 | (1-6)/(1-12) = 5/5 | (2-12)/(2-24) = 5/5 | 25 |
| Synthesis Example 6 | Polyester resin A6 | (1-6)/(1-12) = 5/5 | (2-12)/(2-24) = 5/5 | 30 |
| Synthesis Example 7 | Polyester resin A7 | (1-6)/(1-12) = 5/5 | (2-12)/(2-24) = 5/5 | 10 |
| Synthesis Example 8 | Polyester resin A8 | (1-6)/(1-12) = 5/5 | (2-12)/(2-24) = 5/5 | 5 |
| Synthesis Example 9 | Polyester resin B1 | (1-7)/(1-13) = 5/5 | (2-12)/(2-24) = 5/5 | 20 |
| Synthesis Example 10 | Polyester resin B2 | (1-7)/(1-13) = 5/5 | (2-12)/(2-24) = 5/5 | 30 |
| Synthesis Example 11 | Polyester resin B3 | (1-7)/(1-13) = 5/5 | (2-12)/(2-24) = 5/5 | 10 |
| Synthesis Example 12 | Polyester resin B4 | (1-7)/(1-13) = 5/5 | (2-12)/(2-24) = 5/5 | 5 |
| Synthesis Example 13 | Polyester resin C | (1-8)/(1-14) = 5/5 | (2-9)/(2-21) = 5/5 | 20 |
| Synthesis Example 14 | Polyester resin D | (1-9)/(1-15) = 5/5 | (2-15)/(2-27) = 5/5 | 20 |
| Synthesis Example 15 | Polyester resin E | (1-10)/(1-16) = 5/5 | (2-7)/(2-19) = 5/5 | 20 |
| Synthesis Example 16 | Polyester resin F | (1-11)/(1-17) = 5/5 | (2-12)/(2-24) = 5/5 | 20 |
| Synthesis Example 17 | Polyester resin G | (1-26)/(1-27) = 5/5 | (2-12)/(2-24) = 5/5 | 20 |
| Synthesis Example 18 | Polyester resin H | (1-21) | (2-33) | 20 |
| Synthesis Example 19 | Polyester resin I | (1-22) | (2-33) | 20 |
| Synthesis Example 20 | Polyester resin J | (1-23) | (2-33) | 20 |
| Synthesis Example 21 | Polyester resin K | (1-24) | (2-33) | 20 |
| Synthesis Example 22 | Polyester resin L | (1-21)/(1-12) = 7/3 | (2-34)/(2-24) = 7/3 | 20 |
| Synthesis Example 23 | Polyester resin M | (1-22)/(1-13) = 7/3 | (2-34)/(2-24) = 7/3 | 20 |
| Synthesis Example 24 | Polyester resin N | (1-23)/(1-15) = 7/3 | (2-34)/(2-24) = 7/3 | 20 |
| Synthesis Example 25 | Polyester resin O | (1-24)/(1-17) = 7/3 | (2-34)/(2-24) = 7/3 | 20 |
| Synthesis Example 26 | Polyester resin P | (1-1) | (2-1) | 20 |
| Synthesis Example 27 | Polyester resin Q | (1-2) | (2-2) | 20 |

TABLE 1-continued

| | | Repeating structural unit represented by formula (1) | Repeating structural unit represented by formula (2) | Content (% by mass) of siloxane moiety in polyester resin |
|---|---|---|---|---|
| Synthesis Example 28 | Polyester resin R | (1-1)/(1-12) = 3/7 | (2-1)/(2-24) = 3/7 | 20 |
| Synthesis Example 29 | Polyester resin S | (1-2)/(1-12) = 3/7 | (2-2)/(2-24) = 3/7 | 20 |

The charge transport layer serving as the surface layer of the electrophotographic photosensitive member of the present invention contains as a binder resin a polyester resin having a repeating structural unit represented by the above formula (1) and a repeating structural unit represented by the above formula (2). Another resin may be blended and put in use.

Examples of the binder resin that may be blended include an acrylic resin, a styrene resin, a polyester resin, a polycarbonate resin, polysulfone resin, a polyphenyleneoxide resin, an epoxy resin, a polyurethane resin, an alkyd resin and an unsaturated resin. Of these, a polyester resin or a polycarbonate resin is preferable. These may be used alone or as a mixture or a copolymer of one or two or more types.

When another polyester resin is used in combination, a polyester resin having a repeating structural unit represented by the above formula (2) can be used. Of them, polyester resins having repeating structural units represented by the above formulas (2-1) to (2-40) are preferable. Furthermore, a polyester resin having repeating structural unit represented by the above formula (2-1), (2-2), (2-8), (2-9), (2-10), (2-12), (2-17), (2-20), (2-21), (2-22), (2-24), (2-29), (2-33), (2-34) or (2-35) is preferable.

Specific examples of the repeating structural unit of the polycarbonate resin that may be used in combination are shown below.

(9-1)

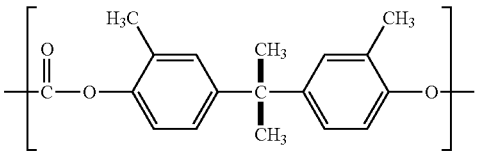

(9-2)

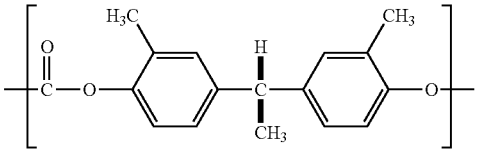

(9-3)

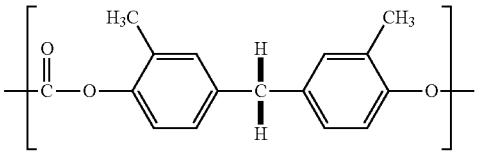

(9-4)

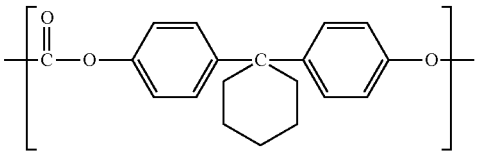

-continued (9-5)

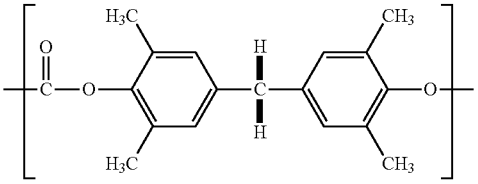

(9-6)

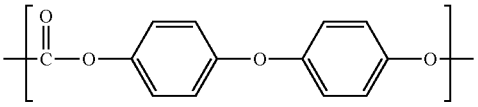

Of these, the repeating structural units represented by the above formulas (9-1), (9-4) and (9-6) are preferable.

In the present invention, since the polyester resin having a repeating structural unit represented by the above formula (1) and a repeating structural unit represented by the above formula (2) in a content of not less than 60% by mass relative to the total mass of the whole binder resin constituting the charge transport layer of the electrophotographic photosensitive member, the effect of mitigating the contact stress can be obtained.

Furthermore, to satisfy mitigation of the contact stress and potential stability during repeated use in balance, it is preferable that the content of a siloxane moiety in a polyester resin having a repeating structural unit represented by the above formula (1) and a repeating structural unit represented by the above formula (2) in the charge transport layer of the electrophotographic photosensitive member is preferably not less than 5% by mass and not more than 30% by mass relative to the total mass of the whole binder resin of the charge transport layer, and more preferably not less than 10% by mass and not more than 25% by mass.

As a charge transporting material contained in the charge transport layer serving as the surface layer of the electrophotographic photosensitive member of the present invention, for example, a triarylamine compound, a hydrazone compound, a styryl compound, a stilbene compound, a pyrazoline compound, an oxazole compound, a thiazole compound and a triarylmethane compound may be mentioned. These charge transporting materials may be used alone or as a mixture of two types or more. Furthermore, of these, a triarylamine compound is preferably used as a charge transporting material in order to improve electrophotographic characteristics. Moreover, of the triarylamine compounds, it is preferred to use a compound represented by the following formula (4):

(4)

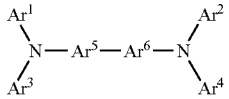

<In formula (4), $Ar^1$ to $Ar^4$ each independently represent a substituted or unsubstituted aryl group; and Ar5 and Ar6 each independently represent a substituted or unsubstituted arylene group>.

In the above formula (4), $Ar^1$ to $Ar^4$ each independently represent a substituted or unsubstituted aryl group. As the aryl group, for example, a phenyl group and naphthyl group may be mentioned. Of these, a phenyl group is preferable. As a substituent that the aryl group may have, for example, an alkyl group, an aryl group, an alkoxy group and a monovalent group having an unsaturated bond may be mentioned.

In the above formula (4), $Ar^5$ and $Ar^6$ each independently represent a substituted or unsubstituted arylene group. As the arylene group, for example, a phenylene group and a naphthylene group may be mentioned. Of these, a phenylene group is preferable.

Examples of the compound represented by the above formula (4) are shown below.

(4-1)

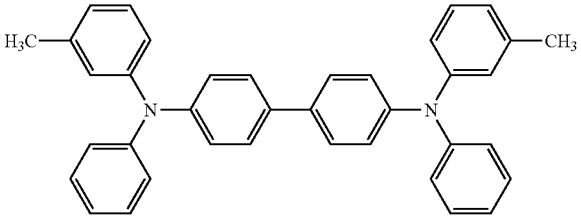

(4-2)

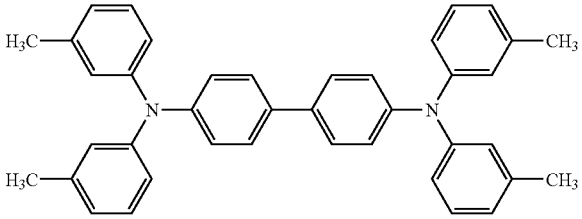

(4-3)

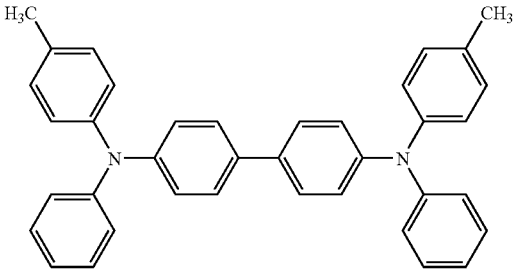

(4-4)

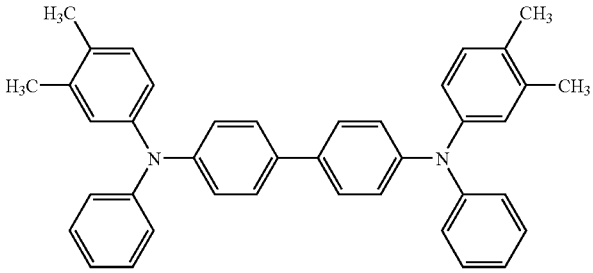

(4-5)

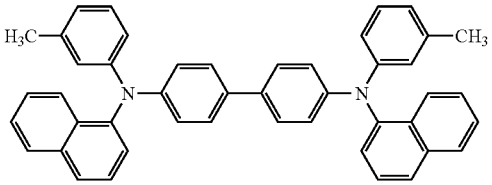

(4-6)

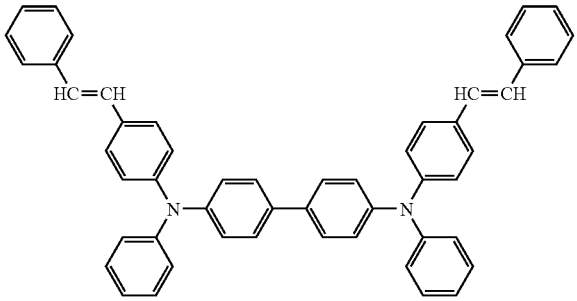

(4-7)

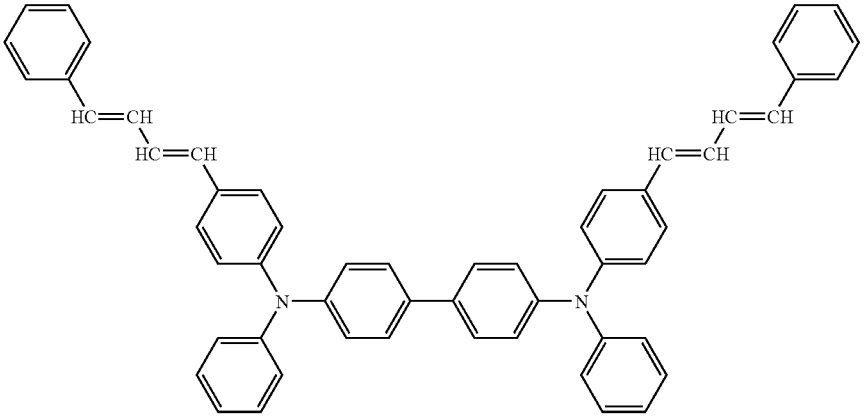

Of these, (4-1) or (4-7) is preferable.

Since the charge transport layer serving as the surface layer of the electrophotographic photosensitive member of the present invention contains a polyester resin having a repeating structural unit represented by the above formula (1) and a repeating structural unit represented by the above formula (2) in a predetermined content, as a binder resin, persistent mitigation of contact stress and satisfactory electrophotographic characteristics can be obtained in balance with each other.

A compound represented by the above formula (4) advantageously has a high charge transporting ability; however, sometimes compatibility becomes a problem depending upon the composition of the binder resin constituting the charge transport layer. Particularly, in the case of using a conventional resin containing a siloxane structure in order to mitigate contact stress, since the compatibility between the siloxane moiety and the charge transporting material tends to be low, in the resin containing a siloxane structure, a charge transporting material is aggregated, with the result that electrophotographic characteristics sometimes deteriorated.

Since the charge transport layer serving as the surface layer of the electrophotographic photosensitive member of the present invention contains a polyester resin having a repeating structural unit represented by the above formula (1) and a repeating structural unit represented by the above formula (2), which is one of the resin containing a siloxane structure, in a predetermined content, even if a compound represented by the above formula (4) is used as a charge transporting material, the effect of mitigating stress can be obtained without damaging the electrophotographic characteristics.

Furthermore, on the surface of the charge transport layer serving as the surface layer of the electrophotographic photosensitive member of the present invention, an unevenness profile (depressions and projections) may be formed. Depending upon the formation of the unevenness profile, the effect of mitigating contact stress can be enhanced. The unevenness profile can be formed by a known method. Specific examples thereof may include; a method of adding organic or inorganic particles to the surface layer, a method of spraying abrasion particles onto the surface of the surface layer of an electrophotographic photosensitive member to form depressions on the surface of the surface layer, a method of bringing a mold having an unevenness profile into contact with the surface of the surface layer of an electrophotographic photosensitive member with application of pressure to form an unevenness profile on the surface of the surface layer, a method of forming liquid droplets on the surface of a film formed of a surface layer coating solution by dew condensation and drying the drops to form depressions on the surface of the surface layer, and a method of forming depressions in the surface of the surface layer by applying laser light to the surface of the surface layer of an electrophotographic photosensitive member surface. Of these, the method of bringing a mold having an unevenness profile into contact with the surface of the surface layer of an electrophotographic photosensitive member with application of pressure to form an unevenness profile on the surface of the surface layer is preferable. Also, the method of forming liquid droplets on the surface of a film surface formed of a surface layer coating solution by dew condensation and drying the drops to form depressions is preferable.

The method of bringing a mold having an unevenness profile into contact with the surface of the surface layer of an electrophotographic photosensitive member with application of pressure to form an unevenness profile on the surface of the surface layer will be described.

The method of bringing a mold having an unevenness profile into contact with the surface of the surface layer of an electrophotographic photosensitive member with application of pressure to form an unevenness profile is a method for forming a surface by bringing a mold having a predetermined shape into contact with the surface of the surface layer of an electrophotographic photosensitive member with application of pressure to transfer the shape.

FIG. 1 is a view schematically illustrating a press-contact shape transfer/processing apparatus making use of a mold.

To a pressure apparatus A which can repeatedly apply and release pressure, a predetermined mold B is attached. Thereafter, the mold is brought into contact with a cylindrical support C having a surface layer formed thereon with application of a predetermined pressure to transfer the shape. Thereafter, application of pressure is once released and the cylindrical support C is rotated and then, pressure is applied again to transfer the shape. By repeating the step, a predetermined shape can be formed over the whole circumference of an electrophotographic photosensitive member.

Figure 2:
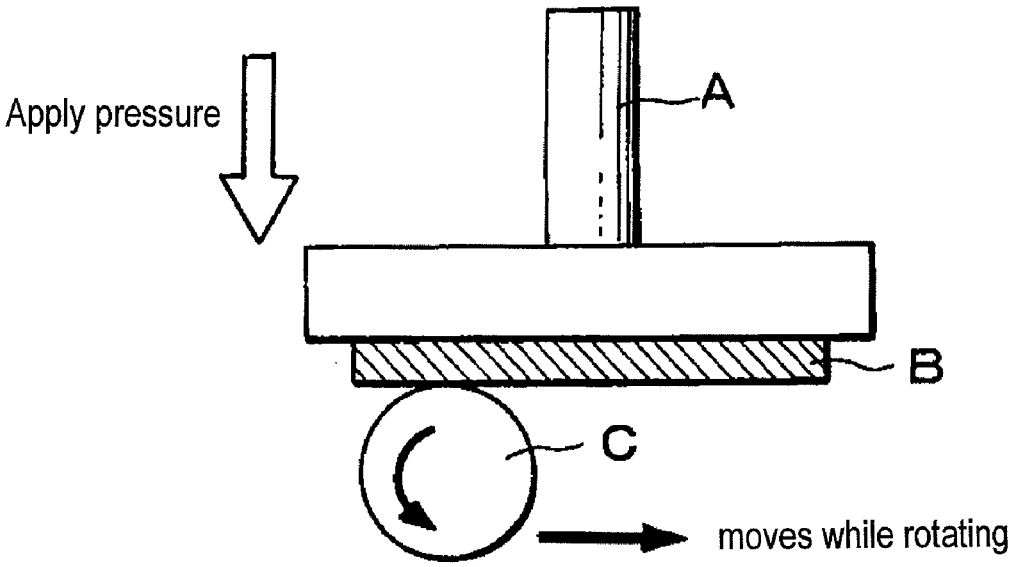
FIG. 2 is a view schematically illustrating another press-contact shape transfer/processing apparatus by a mold.

Furthermore, for example, as shown in FIG. 2, a mold B having a predetermined shape corresponding to the whole round of the surface of the surface layer of the cylindrical support C is attached to a pressure apparatus A. Thereafter, while a predetermined pressure is applied to the cylindrical support C, the cylindrical support C is rotated and moved in the direction pointed by the arrow. In this way, a predetermined unevenness shape may be formed over the whole circumference of an electrophotographic photosensitive member.

Furthermore, it is possible that a sheet-form mold is sandwiched between a roll-form pressure apparatus and the cylindrical support C and the mold sheet is fed to perform surface processing.

Furthermore, in order to transfer a shape efficiently, the mold and the cylindrical support C may be heated. The heating temperature of the mold and the cylindrical support C may be arbitrarily set as long as a predetermined shape can be formed; however, the temperature is preferably set as low as possible in order to form the shape stably.

The material, size and shape of a mold itself can be appropriately selected. As the material for the mold, a metal whose surface is treated with micro processing and a silicon wafer whose surface is pattered by use of a resist, a resin film having microparticles dispersed or having a predetermined micro surface-shape and coated with a metal may be mentioned.

Furthermore, in order to uniformly apply pressure to an electrophotographic photosensitive member, an elastic member may be provided between a mold and a pressure apparatus.

Subsequently, the method of forming liquid droplets on the surface of a film formed of a surface layer coating solution by dew condensation and drying the drops to form depressions in the surface of an electrophotographic photosensitive member, will be described below.

As the method for forming liquid droplets on the surface of a film formed of a surface layer coating solution by dew condensation, a method of holding a support coated with a surface layer coating solution under an atmosphere, in which liquid droplets can be formed on the surface of a coating film by dew condensation, for a predetermined time, and a method of adding an organic compound having a high affinity for water to a surface layer coating solution, may be mentioned.

The dew condensation in the surface formation method refers to formation of liquid droplets by the action of water on the coating film surface. The conditions for forming liquid droplets on the coating film by dew condensation are influenced by a relative humidity of the atmosphere for holding a support and vaporization conditions (e.g., heat of vaporization) of a solvent of a coating solution. Therefore, it is important to select appropriate conditions. Particularly, the conditions mainly depend upon the relative humidity of the atmosphere holding a support. The relative humidity, at which liquid droplets are formed on the coating film surface by dew condensation, is preferably 40% or more and 100% or less, and more preferably 60% or more and 95% or less. A step of forming liquid droplets on the coating film surface by dew condensation is performed for any period of time as long as liquid drops are formed by dew condensation. In view of productivity, the time is preferably 1 second or more and 300 seconds or less, more preferably 10 seconds or more and 180 seconds or less. In the step of forming liquid droplets on the coating film surface, relative humidity is important; however, the atmospheric temperature is preferably 20° C. or more and 80° C. or less.

Furthermore, a surface layer coating solution suitable for a method for forming an unevenness profile in the coating film surface, a solution containing an aromatic organic solvent may be mentioned. The aromatic organic solvent is preferable since it is a solvent having a low affinity for water and the shape is formed stably in a dew condensation step. Specifically, 1,2-dimethylbenzene, 1,3-dimethylbenzene, 1,4-dimethylbenzene, 1,3,5-trimethylbenzene and chlorobenzene may be mentioned. Furthermore, the content of the aromatic organic solvent relative to the mass of the whole solvent of the surface layer coating solution is preferably not less than 50% by mass and not more than 80% by mass.

Furthermore, an aromatic organic solvent is contained in the surface layer coating solution and further an organic compound having a high affinity for water, may be added to the surface layer coating solution. As the organic compound having a high affinity for water, an organic solvent having a high affinity for water may be mentioned. The affinity for water can be determined by the following method.

<Evaluation of Affinity for Water>

In a normal temperature/normal humidity environment (25° C., relative humidity: 55%), first, water (50 ml) was measured by a 50 ml measuring cylinder. Then, a solvent to be used (50 ml) is measured by a 100 ml measuring cylinder. To this, water (50 ml) measured by the previous operation is added and stirred by a glass stick until the whole solution is homogenized. Thereafter, a lid is provided so as not to vaporize the solvent and water and allowed to sufficiently stand still until air bubbles and the interface become stable. Thereafter, the state of the solution mixture in the 100 ml measuring cylinder was observed and the volume of the water phase is measured. If the volume of the water phase is 0 ml or more and 5 ml or less, the solvent can be determined as a hydrophilic solvent.

As the organic solvent having a high affinity with water, for example, 1,2-propanediol, 1,3-butanediol, 1,5-pentanediol, glycerin, 1,2,6-hexanetriol, tetrahydrofuran, diethylene glycol dimethyl ether, propionic acid, butyric acid, γ-butyrolactone, diethylene glycol monoacetate, monoacetin, diacetin, ethylene carbonate, propylene carbonate, triethyl phosphate, β-picoline, γ-picoline, 2,4-lutidine, 2,6-lutidine, quinoline, formamide, N,N-dimethyl formamide, N,N-diethyl formamide, N,N-dimethyl acetamide, N,N,N',N'-tetramethyl urea, 2-pyrrolidone, dimethyl sulfoxide, sulfolane, 2-ethoxy ethanol, tetrahydrofurfuryl alcohol, diethylene glycol, triethylene glycol, tetraethylene glycol, 1-ethoxy-2-propanol, dipropylene glycol, dipropylene glycol monomethyl ether, dipropylene glycol monoethyl ether, tripropylene glycol monomethyl ether, diacetone alcohol, 3-chloro-1,2-propanediol, N-butyldiethanolamine, triethanolamine, 2-methoxyethyl acetate, diethylene glycol monoethyl ether acetate, hexamethylphosphoric triamide, 1,3-dimethyl-2-imidazolidinone and N,N,N',N'-tetramethylethylenediamine may be mentioned. Of these, dimethyl sulfoxide, sulfolane, triethylene glycol and dipropylene glycol are preferable. These organic solvents may be contained alone or in combination with two or more types.

Furthermore, it is preferred that the organic compound having a high affinity for water must be required to have, as a property, not only affinity for water produced by dew condensation but also affinity for a polyester resin having a repeating structural unit represented by the above formula (1) and a repeating structural unit represented by the above formula (2). Such an organic compound having the aforementioned property, for example, a surfactant may be mentioned. As the surfactant, for example, an anionic surfactant, a cationic surfactant, a nonionic surfactant and an amphoteric surfactant may be mentioned. As the anionic surfactant, for example, alkyl benzene sulfonate, α-olefin sulfonate or a phosphate ester may be mentioned. As the cationic surfactant, for example, an amine salt type surfactant or a quaternary ammonium salt cationic surfactant may be mentioned. As the amine salt type surfactant, for example, an alkylamine salt, an amino alcohol fatty acid derivative, a polyamine fatty acid derivative or imidazoline may be mentioned. As the quaternary ammonium salt cationic surfactant, for example, an alkyl trimethyl ammonium salt, a dialkyl dimethyl ammonium salt, an alkyl dimethyl benzyl ammonium salt, a pyridinium salt, an alkyl isoquinolinium salt or benzethonium chloride may be mentioned. As the nonionic surfactant, for example, an aliphatic amide derivative or a polyol derivative may be mentioned. As the amphoteric surfactant, for example, alanine, dodecyl di(aminoethyl)glycine, di(octylaminoethyl)glycine or N-alkyl-N,N-dimethyl ammoniumbetain may be mentioned. Of these, a nonionic surfactant is preferable since it has satisfactory electrophotographic characteristics. Further, a polyhydric alcohol is preferable. Examples of the polyhydric alcohol include high-molecular weight alkyl alcohols such as triethylene glycol, tetraethylene glycol, polyethylene glycol, dipropylene glycol and tridipropylene glycol; high-molecular weight fatty acid esters such as sorbitan fatty acid ester, polyoxyethylene sorbitan fatty acid ester, glycerin fatty acid ester, decaglycerin fatty acid ester, polyglycerin fatty acid ester and polyethylene glycol fatty acid ester; high-molecular weight alkyl ethers such as polyoxyethylene alkyl ether and polyoxyethylene alkylphenyl ether; high-molecular weight alkylamines such as polyoxyethylene alkylamine; high-molecular weight fatty acid amides such as polyoxyethylene alkyl fatty acid amide; high-molecular weight fatty acid salts such as polyoxyethylene alkyl ether acetate; and high-molecular weight alkyl ether phosphates such as polyoxyethylene alkyl ether phosphate.

Of these organic compounds having a high affinity for water, an organic compound having a hydrophile-lipophile balance value (HLB value), calculated by the Davis method) of 6 to 12 is preferable.

After liquid droplets are formed on the coating film surface of the surface layer coating solution by dew condensation, the film is dried. In the dehydration step thereof, heat dry, blow dry and vacuum dry may be mentioned as a dehydration method. Furthermore, these dehydration methods may be used in combination. Particularly, in view of productivity, heat dry and heat/blow dry are preferable. Furthermore, to form depressions highly uniformly, quick dehydration is critical. For this, heat dry is preferable. The dehydration temperature is preferably 100° C. or more and 150° C. or less. As the time period of the hydration step, any time period may be employed as long as the solvent contained in the coating solution applied on a substrate and liquid droplets formed in a dew condensation step are removed. The time period of the dehydration step is preferably 20 minutes or more and 120 minutes or less, and further preferably, 40 minutes or more and 100 minutes or less.

In the shape formation by dew condensation, it is possible to control a shape by controlling production conditions. The depressions can be controlled by changing the type of solvent contained in the surface layer coating solution, the solvent content, the relative humidity in the dew condensation step, the retention time in the dew condensation step and dehydration temperature.

A plurality of depressions and projections can be formed on the surface of the electrophotographic photosensitive member by the aforementioned surface unevenness shape formation methods for an electrophotographic photosensitive member.

As the depression shape formed in the surface of the electrophotographic photosensitive member, a shape formed of straight lines, a shape formed by curved lines and a shape formed of straight lines and curved lines may be mentioned as a top view of the electrophotographic photosensitive member observed. As the shape formed of straight lines, for example, a triangle, a tetragon, a pentagon and a hexagon may be mentioned. As the shape formed by curved lines, for example, a circular shape and an oval shape may be mentioned. As the shape formed of straight lines and curved lines, for example, a tetragon with round corners, a hexagon with round corners and a fan-like shape may be mentioned.

Furthermore, as the depression shape formed in the surface of the electrophotographic photosensitive member, a shape formed of straight lines, a shape formed by curved lines and a shape formed of straight lines and curved lines may be mentioned as a sectional view of an electrophotographic photosensitive member. As the shape formed of straight lines, for example, a triangle, a tetragon and a pentagon may be mentioned. As the shape formed by curved lines, for example, a partially circular shape and a partially oval shape may be mentioned. As the formed of straight lines and curved lines, for example, square with round corners and a fan-like shape may be mentioned. The depressions formed in the surface of the electrophotographic photosensitive member may mutually differ in shape, size and depth. Alternatively, all depressions may have the same shape, size and depth. Furthermore, the surface of the electrophotographic photosensitive member manufactured may have depression different in shape, size and depth and depression having the same shape, size and depth, in combination. Furthermore, these shapes may have an overlapped portion or mutually stacked on each other.

The size of the depression shapes formed on the surface of the electrophotographic photosensitive member will be described.

As an index of a depression shape, the size of the major axis is used. The size of the major axis refers to the longest length of the straight lines crossing the opening portion of each depression; in other words, refers to the maximum length of a surface opening portion of each depression at the level of the peripheral surface of the opening portion of the depression in the surface of an electrophotographic photosensitive member. More specifically, when the surface shape of a depression is a circle, the diameter of the circle is referred. When the surface shape is an oval, the major axis thereof is referred. When the shape is a square, the longer diagonal line is referred. The major axis of a depression shape in the surface of an electrophotographic photosensitive member is preferably 0.5 μm or more and 80 μm or less, furthermore, preferably 1 μm or more and 40 μm or less, and further preferably 20 μm or less.

The depth of a depression formed on the surface of an electrophotographic photosensitive member will be described.

As the index of the above depression, the depth is used. The depth refers to the distance between the deepest portion of each depression and the opening surface, more specifically, refers to the distance between the deepest portion of a depression and the opening surface at the level of the peripheral surface of a depression opening portion on the surface of the electrophotographic photosensitive member. In the surface of the electrophotographic photosensitive member, depth of a depression is preferably 0.1 μm or more and 10 μm or less, more preferably 0.3 μm or more and 7 μm or less, and further preferably 5 μm or less.

The region in a surface of an electrophotographic photosensitive member, in which depressions are formed, may be the whole or part thereof; however, depressions are preferably formed in the whole surface region.

Furthermore, depressions on the surface of an electrophotographic photosensitive member are preferably present at a ratio of 1 or more and 70,000 or less in the unit area (10000 $\mu m^2$ (100 μm squares)) on the surface of the electrophotographic photosensitive member and further preferably, 100 or more and 50,000 or less.

As the projection shape formed on the surface of the electrophotographic photosensitive member, a shape formed of straight lines, a shape formed by curved lines and a shape formed of straight lines and curved lines may be mentioned as a top view of the electrophotographic photosensitive member. As the shape formed of straight lines, for example, a triangle, a tetragon, a pentagon and a hexagon may be mentioned. As the shape formed by curved lines, for example, a circular shape and an oval shape may be mentioned. As the formed of straight lines and curved lines, for example, a tetragon with round corners, a hexagon with round corners and a fan-like shape may be mentioned.

Furthermore, as the projection shape formed on the surface of the electrophotographic photosensitive member, a shape formed of straight lines, a shape formed by curved lines and a shape formed of straight lines and curved lines may be mentioned as a sectional view of an electrophotographic photosensitive member. As the shape formed of straight lines, for example, a triangle, a tetragon and a pentagon may be mentioned. As the shape formed by curved lines, for example, a partially circular shape and a partially oval shape may be mentioned. As the formed of straight lines and curved lines, for example, a tetragon with round corners and a fan-like shape may be mentioned.

The projection shapes formed on the surface of the electrophotographic photosensitive member may mutually differ in shape, size and height. Alternatively, all projections may have the same shape, size and height. Furthermore, these shapes may have an overlapped portion or mutually stacked on each other.

The size of the projection formed on the surface of the electrophotographic photosensitive member will be described.

As an index of a projection, the size of the major axis is used. The size of the major axis refers to the maximum length of a portion at which each projection is in contact with the peripheral surface at the level of the peripheral surface of each projection portion. For example, when the surface shape of the projection is a circle, the diameter of the circle is referred. When the surface shape is an oval, the major axis thereof is referred. When the shape is a tetragon, the longest diagonal line is referred. The major axis of a projection in the surface of the electrophotographic photosensitive member is preferably 0.5 μm or more and 40 μm or less, furthermore, preferably 1 μm or more and 20 μm or less, and further preferably 10 μm or less.

The height of a projection shape formed on the surface of the electrophotographic photosensitive member will be described.

As an index of the above projection, height is used. The height refers to the distance between the top portion of each projection and the peripheral surface. The height of a projection on the surface of an electrophotographic photosensitive member is preferably 0.1 μm or more and 10 μm or less, furthermore, preferably 0.3 μm or more and 7 μm or less, and further preferably 5 μm or less.

The region in the surface of an electrophotographic photosensitive member in which projections are formed may be whole or part of the surface of the electrophotographic photosensitive member; however, projections are preferably formed in the whole surface region. Furthermore, projections on the surface of an electrophotographic photosensitive member are preferably present at a ratio of 1 or more and 70,000 or less in the unit area (10000 $\mu m^2$ (100 μm squares)) in the surface of the electrophotographic photosensitive member, and further preferably, 100 or more and 50,000 or less.

The unevenness shape on the surface of the electrophotographic photosensitive member can be measured by a commercially available microscope, e.g., a laser microscope, an optical microscope, an electron microscope or an interatomic force microscope.

As the laser microscope, for example, instruments such as an ultra-depth profile measuring microscope VK-8550 (manufactured by Keyence Corporation), an ultra-depth profile measuring microscope VK-9000 (manufactured by Keyence Corporation), an ultra-depth profile measuring microscope VK-9500 (manufactured by Keyence Corporation), a surface profile measuring system, Surface Explorer SX-520DR type instrument (manufactured by Ryoka Systems Inc.), a scanning type confocal laser microscope OLS3000 (manufactured by Olympus Corporation) and a real color confocal microscope optics C130 (manufactured by Lasertec Corporation) are available.

As the optical microscope, for example, instruments such as a digital microscope VHX-500 (manufactured by Keyence Corporation), a digital microscope VHX-200 (manufactured by Keyence Corporation) and a 3D digital microscope VC-7700 (manufactured by Omron Corporation) are available.

As the electron microscope, for example, instruments such as a 3D real surface view microscope VE-9800 (manufactured by Keyence Corporation), a 3D real surface view microscope VE-8800 (manufactured by Keyence Corporation), a scanning electron microscope conventional/Variable Pressure SEM (manufactured by SII NanoTechnology Inc.), a scanning electron microscope SUPERSCAN SS-550 (manufactured by Shimadzu Corporation) are available.

As the interatomic force microscope, for example, instruments such as a nano-scale hybrid microscope VN-8000 (manufactured by Keyence Corporation), a scanning probe microscope NanoNavi station (manufactured by SII NanoTechnology Inc.) and a scanning probe microscope SPM-9600 (manufactured by Shimadzu Corporation) are available.

Using a microscope as mentioned above, the major axis, depth and height of the depressions and projections can be measured within a field of vision (to be measured) at a predetermined magnification.

As an example, measurement by a Surface Explorer SX-520DR type instrument using an analysis program will be described.

The electrophotographic photosensitive member to be measured is placed on a work bench and tilt is controlled to level off. The data of a three dimensional shape of the surface of an electrophotographic photosensitive member is loaded in a web mode. At this time, the magnification of an objective lens is set at 50 times and observation may be made in a field of vision 100 μm×100 μm (10,000 $\mu m^2$).

Next, using particle analysis program in data analysis soft, the contour line data of the surface of the electrophotographic photosensitive member is displayed.

Analysis parameters of an unevenness shape such as a shape, major axis, depth and height of depressions and projections can each be optimized depending upon the unevenness shape formed. For example, when an unevenness shape having a major axis of about 10 μm is observed and measured, the upper limit of the major axis may be set at 15 μm; the lower limit of the major axis may be set at 1 μm; the lower limit of the depth may be set at 0.1 μm; and the lower limit of volume may be set at 1 $\mu m^3$ or more. Furthermore, unevenness shapes determined as depressions and projections on an analysis screen are counted and determined as the number of unevenness shapes.

Note that the unevenness shapes having a major axis of about 1 μm or less can be observed by a laser microscope and an optical microscope. However, to improve accuracy in measurement, observation and measurement by an electron microscope are desirably used in combination.

Now, the structure of the electrophotographic photosensitive member of the present invention will be described.

As described in the above, the electrophotographic photosensitive member of the present invention is an electrophotographic photosensitive member having a support, a charge generation layer provided on the support and a charge transport layer provided on the charge generation layer and also is an electrophotographic photosensitive member in which the charge transport layer serves as the surface layer of the electrophotographic photosensitive member (the uppermost layer).

Furthermore, the charge transport layer of the electrophotographic photosensitive member of the present invention contains a charge transporting material and a binder resin. Furthermore, the charge transport layer has a polyester resin having a repeating structural unit represented by the above formula (1) and a repeating structural unit represented by the above formula (2), as the binder resin.

Furthermore, the charge transport layer may be a laminate structure. In the case, a polyester resin having a repeating structural unit represented by the above formula (1) and a repeating structural unit represented by the above formula (2) is incorporated into at least the charge transport layer on the side of the outermost surface. As the electrophotographic photosensitive member, generally a cylindrical electrophotographic photosensitive member having a photosensitive layer formed on a cylindrical support is widely used; however, other shapes of electrophotographic photosensitive member such as belt-shaped or sheet-shaped ones can be used.

As the support, a support having a conductivity (conductive support) is preferred, and a support formed of a metal such as aluminum, an aluminum alloy and stainless steel can also be used.

In the case of a support formed of aluminum or an aluminum alloy, use may be made of an ED tube, an EI tube and these tubes cut out or treated with electropolishing (electrolysis performed by an electrode having an electrolysis function and an electrolytic solution and polishing by a grind stone having a polishing function) and wet or dry honing.

Furthermore, a metal support or a resin support having a film layer formed by vapor deposition of aluminum, an aluminum alloy or an indium oxide-tin oxide alloy can be used.

As the resin support, for example, supports formed of polyethylene terephthalate, polybutylene terephthalate, a phenol resin, polypropylene and a polystyrene resin may be mentioned.

Furthermore, supports formed by impregnating a resin or a paper sheet with conductive particles such as carbon black, tin oxide particles, titanium oxide particles and silver particles and a plastic having a conductive binder resin can be used.

The surface of the support may be applied with a cutting treatment, a surface-roughening treatment or an alumite treatment in order to prevent formation of interference fringe caused by scattering of light such as laser light.

When a layer is provided on the surface of the support in order to impart conductivity, the volume resistivity of the layer is preferably $1\times10^{10}$ Ω·cm or less, and, particularly, more preferably $1\times10^{6}$ Ω·cm or less.

A conductive layer may be provided between the support and intermediate layer (described later) or the charge generation layer in order to prevent interference fringe caused by scattering of light such as laser light or to cover a scratch of the support. This is a layer formed by use of a conductive-layer coating solution having conductive particles dispersed in a binder resin.

As the conductive particle, for example, carbon black, acetylene black, metal powders such as aluminum, nickel, iron, nichrome, copper, zinc and silver; and metal oxide powders such as conductive tin oxide and ITO may be mentioned.

Furthermore, as the binder resin, for example, polystyrene, a styrene-acrylonitrile copolymer, a styrene-butadiene copolymer, a styrene-maleic anhydride copolymer, polyester, polyvinyl chloride, a vinyl chloride-vinyl acetate copolymer, polyvinyl acetate, poly vinylidene chloride, a polyarylate resin, a phenoxy resin, polycarbonate, a cellulose acetate resin, an ethylcellulose resin, polyvinyl butyral, polyvinyl formal, polyvinyltoluene, poly-N-vinylcarbazole, an acrylic resin, a silicone resin, an epoxy resin, a melamine resin, an urethane resin, a phenol resin and an alkyd resin may be mentioned.

As the solvent for the conductive-layer coating solution, for example, ether solvents such as tetrahydrofuran and ethylene glycol dimethyl ether; alcohol solvents such as methanol; ketone solvent such as methyl ethyl ketone; and aromatic hydrocarbon solvents such as toluene may be mentioned.

The film thickness of the conductive layer is preferably 0.2 μm or more and 40 μm or less and, more preferably 1 μm or more and 35 μm or less, and further more preferably 5 μm or more and 30 μm less.

A conductive layer having a conductive particle and a resistivity controlling particle dispersed therein tends to have a rough surface.

Between the support or the conductive layer and the charge generation layer, an intermediate layer having a barrier function and an adhesive function may be provided. The intermediate layer is formed, for example, in order to improve adhesion with a photosensitive layer, improve coating processability, improve a charge injection property from the support, and prevent a photosensitive layer from being electrically damaged.

The intermediate layer can be formed by applying an intermediate-layer coating solution containing a binder resin onto a conductive layer, and drying or hardening it.

As the binder resin of the intermediate layer, for example, a water soluble resin such as polyvinyl alcohol, polyvinyl methyl ether, a polyacrylic acid, methylcellulose, ethylcellulose, polyglutamic acid or casein, a polyamide resin, a polyimide resin, a polyamide imide resin, a polyamic acid resin, a melamine resin, an epoxy resin, a polyurethane resin and a polyglutamate resin may be mentioned.

In order to effectively develop the electric barrier property of the intermediate layer, and furthermore, to optimize coating property, adhesive property, solvent resistance and resistance, the binder resin of the intermediate layer is preferably a thermoplastic resin. More specifically, a thermoplastic polyamide resin is preferable. As the polyamide resin, low crystalline or non-crystalline nylon copolymer, that can be applied in a solution state, is preferable.

The film thickness of the intermediate is preferably 0.05 μm or more and 7 μm or less, and more preferably 0.1 μm or more and 2 μm or less.

Furthermore, in order to prevent charge (carrier) flow from being interrupted in the intermediate layer, the intermediate layer may contain semi-conductive particles or an electron transporting material (electron accepting material such as an acceptor).

On the support, the conductive layer or the intermediate layer, a charge generation layer is provided.

As the charge generating material to be used in the electrophotographic photosensitive member of the present invention, for example, azo pigments such as monoazo, disazo and trisazo; phthalocyanines such as a metallophthalocyanine, a non-metallophthalocyanine; indigo pigments such as indigo and thioindigo; perylene pigments such as perylene acid anhydride and perylene acid imide; polycyclic quinone pigments such as anthraquinone and pyrenequinone; a squarylium coloring matter, a pyrylium salt, a thiapyrylium salt, a triphenyl methane coloring matter, inorganic substances such as selenium, selenium-tellurium and amorphous silicone; a quinacridon pigment, an azulenium salt pigment, a cyanine dye, a xanthene coloring matter, a quinone imine coloring matter and a styryl coloring matter may be mentioned. These charge generating materials may be used alone or as a mixture of two types or more. Of these, particularly, metallophthalocyanines such as oxytitanium phthalocyanine, hydroxygallium phthalocyanine and chlorogallium phthalocyanine are preferable since it is highly sensitive.

As the binder resin for use in the charge generation layer, for example, a polycarbonate resin, a polyester resin, a polyarylate resin, a butyral resin, a polystyrene resin, a polyvinyl acetal resin, a diallylphthalate resin, an acrylic resin, a methacrylic resin, a vinyl acetate resin, a phenol resin, a silicone resin, a polysulfone resin, a styrene-butadiene copolymer resin, an alkyd resin, an epoxy resin, a urea resin and a vinyl chloride-vinyl acetate copolymer resin may be mentioned. Of these, particularly, a butyral resin is preferable. These can be used alone or as a mixture or as a copolymer of two or more types.

The charge generation layer can be formed by applying a charge-generating layer coating solution obtained by dispersing a charge generating material and a binder resin in a solvent and drying it. Furthermore, the charge generation layer may be a deposition film of a charge generating material.

As the dispersion method, for example, methods using a homogenizer, ultrasonic wave, a ball mill, a sand mill, an attritor and a roll mill may be mentioned.

The ratio of the charge generating material to the binder resin preferably fall within the range of 1:10 to 10:1 (mass ratio), and particularly, more preferably within the range of 1:1 to 3:1 (mass ratio).

The solvent to be used in the charge-generating layer coating solution is selected based on the solubility and dispersion stability of the binder resin and the charge generating material to be used. As the organic solvent, for example, an alcohol solvent, a sulfoxide solvent, a ketone solvent, an ether solvent, an ester solvent or an aromatic hydrocarbon solvent may be mentioned.

The film thickness of the charge generation layer is preferably 5 μm or less, and more preferably 0.1 μm or more and 2 μm or less.

Furthermore, to the charge generation layer, various types of sensitizing agents, antioxidants, UV ray absorbers and plasticizers can be optionally added. Furthermore, to keep smooth charge (carrier) flow, the intermediate layer in the charge generation layer, the charge generation layer may contain an electron transporting material (electron accepting material such as an acceptor).

On the charge generation layer, a charge transport layer is provided.

As the charge transporting material to be used in the electrophotographic photosensitive member of the present invention, for example, a triarylamine compound, a hydrazone compound, a styryl compound, a stilbene compound, a pyrazoline compound, an oxazole compound, a thiazole compound and a triallylmethane compound, as described above, may be mentioned. Of these, a compound represented by the above formula (4) is preferable. Furthermore, the content of a compound represented by the above formula (4) in the charge transport layer is preferably not less than 10% by mass relative to the total mass of all charge transporting materials in the charge transport layer.

The charge transport layer serving as the surface layer of the electrophotographic photosensitive member of the present invention contains a polyester resin having a repeating structural unit represented by the above formula (1) and a repeating structural unit represented by the above formula (2), as a binder resin. As described above, another resin may be blended. The binder resin that may be blended is the same as described above.

The charge transport layer can be formed by applying the charge-transporting layer coating solution obtained by dissolving a charge transporting material and a binder resin in a solvent and drying it.

The ratio of the charge transporting material to the binder resin preferably falls within the range of 4:10 to 20:10 (mass ratio), and more preferably falls within the range of 5:10 to 12:10 (mass ratio).

As the solvent to be used in the charge-transporting layer coating solution, for example, ketone solvents such as acetone and methyl ethyl ketone; ester solvents such as methyl acetate and ethyl acetate; ether solvents such as tetrahydrofuran, dioxolane, dimethoxymethane and dimethoxyethane; and aromatic hydrocarbon solvents such as toluene, xylene and chlorobenzene, may be mentioned. These solvents may be used alone or as a mixture of two or more types. Of these solvents, an ether solvent and an aromatic hydrocarbon solvent are preferably used in view of resin solubility.

The film thickness of the charge transport layer is preferably 5 μm or more and 50 μm or less, and more preferably 10 μm or more and 35 μm or less.

Furthermore, to the charge transport layer, an antioxidant, a UV ray absorber and a plasticizer, etc. can be optionally added.

To each of the layers of the electrophotographic photosensitive member of the present invention, various types of additives can be added. As the additives, for example, deterioration preventing agents such as an antioxidant, a UV ray absorber and a stabilizer against light, microparticles such as an organic microparticle and an inorganic microparticle may be mentioned. As the deterioration preventing agent, for example, a hindered phenol antioxidant, a hindered amine stabilizer against light, a sulfur atom-containing antioxidant and a phosphorus atom-containing antioxidant may be mentioned. As the organic microparticle, for example, a fluorine atom-containing resin particle, a polystyrene microparticle, a polymer resin particle such as a polyethylene resin particle may be mentioned. As the inorganic microparticle, for example, a metal oxide such as silica and alumina may be mentioned.

When a coating solution is applied to form each layer, as a coating method, a dip coating method, a spray coating method, a spinner coating method, a roller coating method, Mayer-bar coating method and a blade coating method may be used.

Figure 3:
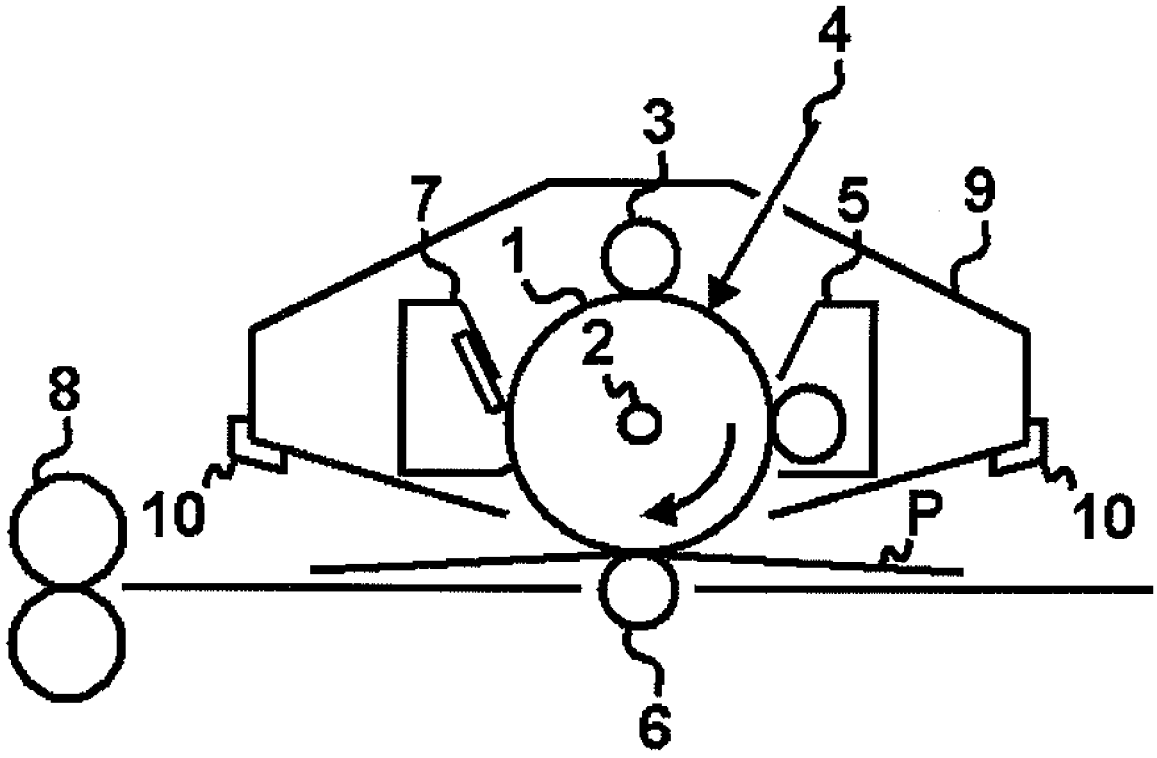
FIG. 3 is a view schematically illustrating a structure of an electrophotographic apparatus provided with a process cartridge having the electrophotographic photosensitive member of the present invention.

FIG. 3 shows a view schematically illustrating a structure of an electrophotographic apparatus equipped with a process cartridge having the electrophotographic photosensitive member of the present invention.

In FIG. 3, a cylindrical electrophotographic photosensitive member 1 is driven and rotated in the direction of an arrow about a shaft 2 at a predetermined circumferential speed.

The surface of the electrophotographic photosensitive member 1 driven and rotated is positively or negatively charged to a predetermined potential uniformly by a charging device (primary charging device: charging roller or the like) 3. Subsequently, it is exposed to light (image exposure light) 4, such as slit exposure light and laser beam scanning exposure light, emitted from a light exposure device (not shown in the drawing). In this way, electrostatic latent images corresponding to desired images are formed sequentially on the surface of the electrophotographic photosensitive member 1.

The electrostatic latent image formed on the surface of the electrophotographic photosensitive member 1 is developed into a toner image by a toner contained in a developer of a developing device 5. Subsequently, the toner image formed and carried on the electrophotographic photosensitive member 1 is sequentially transferred to a transfer material (paper, etc.) P by a transfer bias from a transfer device (transfer roller) 6. Note that, the transfer material P is taken up from a transfer material supply device (not shown) in synchronisms with the ration of the electrophotographic photosensitive member 1 and fed to the contact portion between the electrophotographic photosensitive member 1 and the transfer device 6.

The transfer material P having the toner image transferred thereon is separated from the surface of the electrophotographic photosensitive member 1 and introduced in a fixation device 8, in which the image is fixed. In this way, a material (print, copy) having an image formed thereon is discharged out of the apparatus as a printed matter.

After a toner image is transferred, the surface of the electrophotographic photosensitive member 1 is cleaned by removing the remaining developer (toner) by a cleaning device (cleaning blade) 7. Subsequently, the surface is exposed to pre-exposure light (not shown) emitted from the pre-exposure device (not shown) to remove charges, and thereafter, repeatedly used in image formation. Note that, as shown in FIG. 3, when the charging device 3 is a contact charging device using a charge roller, etc., the pre-exposure light mentioned above is not always necessary.

A plurality of structural elements such as the above electrophotographic photosensitive member 1, the charging device 3, the developing device 5, the transfer device 6 and the charging device 7 is installed in a container and united as one body as a process cartridge. The process cartridge may be detachably provided to an electrophotographic apparatus main body, such as a copying machine and a laser beam printer. In FIG. 3, the electrophotographic photosensitive member 1, the charging device 3, the developing device 5 and the charging device 7 are integrally held in a cartridge and used as a process cartridge 9 detachably provided to the electrophotographic apparatus main body by use of a guide 10 such as a rail of the electrophotographic apparatus main body.

Figure 4:
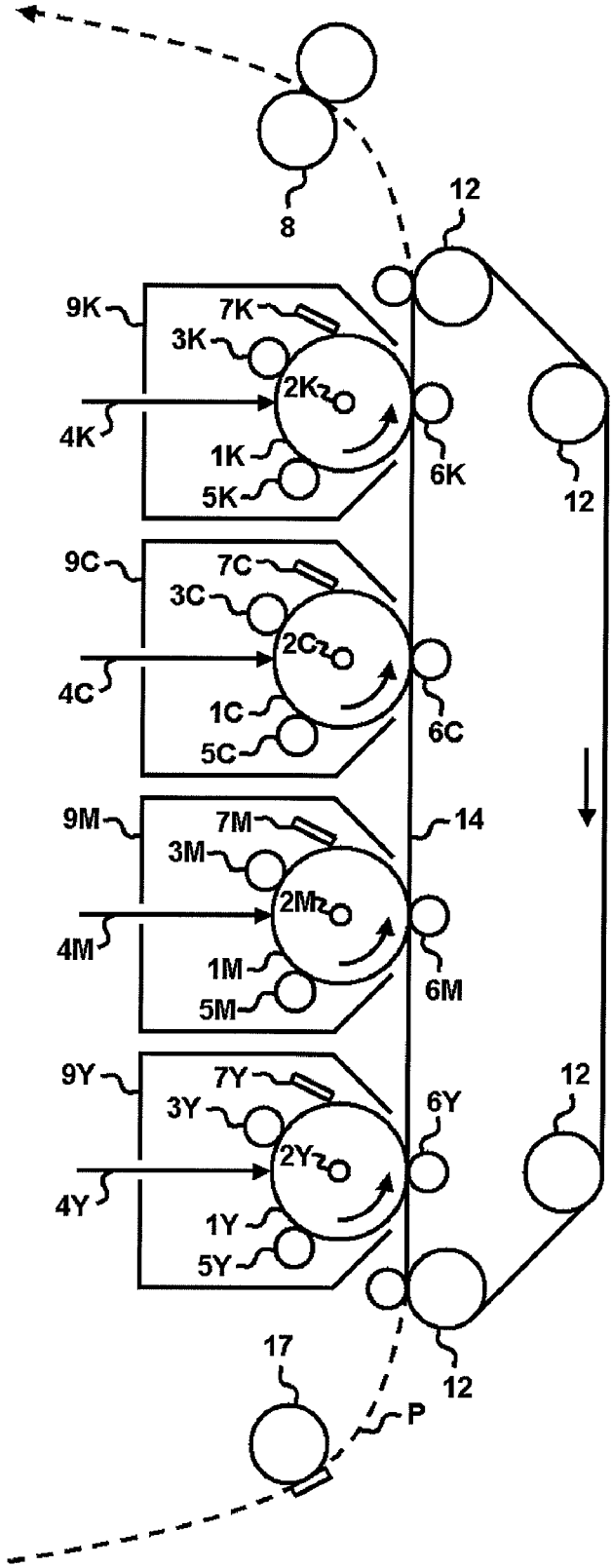
FIG. 4 is a view schematically illustrating a structure of a color electrophotographic apparatus (in-line system) provided with a process cartridge having the electrophotographic photosensitive member of the present invention.

FIG. 4 shows a view schematically illustrating a structure of a color electrophotographic apparatus (in-line system) equipped with process cartridges having the electrophotographic photosensitive member of the present invention.

In FIG. 4, reference symbols 1Y, 1M, 1C and 1K indicate cylindrical electrophotographic photosensitive members (electrophotographic photosensitive members for first to fourth-colors), which are driven and rotated about the axes of 2Y, 2M, 2C and 2K respectively in the direction indicated by an arrow at a predetermined circumference speed.

The surface of the electrophotographic photosensitive member 1Y for the first-color to be driven and rotated is positively or negatively charged to a predetermined potential uniformly by a first-color charging device (primary charging device: charging roller) 3Y. Subsequently, the surface is exposed to exposure light (image exposure light) 4Y emitted from a light exposure device (not shown), such as a slit light exposure and a laser beam scanning light exposure. The exposure light 4Y corresponds to a first-color component image (e.g., a yellow component image) of a desired color image. In this way, on the surface of the first-color electrophotographic photosensitive member 1Y, the first-color component electrostatic latent images (yellow component electrostatic latent image) corresponding to the first-color component images of desired color images are subsequently formed.

A transfer material conveying member (transfer material conveyer belt) 14 stretched by stretching/extending rollers 12 is driven and rotated in the direction indicated by an arrow at almost the same circumference speed as those of the first to fourth-color electrophotographic photosensitive members 1Y, 1M, 1C and 1K (e.g., 97 to 103% of the circumference speeds of the first to fourth-color electrophotographic photosensitive members 1Y, 1M, 1C and 1K). Furthermore, the transfer material (paper sheet, etc.) P fed from a transfer material supply device 17 is electrostatically carried (adsorbed) by a transfer material conveying member 14 and subsequently transferred to the contract portion between the first to fourth-color electrophotographic photosensitive members 1Y, 1M, 1C and 1K and the transfer material conveying member.

The first-color component electrostatic latent image formed on the surface of the first-color electrophotographic photosensitive member 1Y is developed by the toner of the first-color developing device 5Y to form a first-color toner image (yellow toner image). Subsequently, the first-color toner image carried on the surface of the first-color electrophotographic photosensitive member 1Y is sequentially transferred to the transfer material P, which is carried on the transfer material conveying member 14 and passes through the space between the space between the first-color electrophotographic photosensitive member 1Y and the first-color transfer device 6Y, by transfer bias from the first-color transfer device (transfer roller, etc.) 6Y.

After the first-color toner image is transferred, the surface of the first-color electrophotographic photosensitive member 1Y is cleaned by removing the remaining toner by the first-color cleaning device (cleaning blade) 7Y and repeatedly used for formation of the first-color toner image.

The first-color electrophotographic photosensitive member 1Y, the first-color charging device 3Y, the first-color light exposure device for emitting exposure light 4Y corresponding to a first-color component image, the first-color developing device 5Y and the first-color transfer device 6Y are collectively referred to as a first-color image formation section.

A second-color image formation section, which has a second-color electrophotographic photosensitive member 1M, a second-color charging device 3M, a second-color exposure device for emitting exposure light 4M corresponding to a second-color component image, a second-color developing device 5M and a second-color transfer device 6M; a third-color image formation section, which has a third-color electrophotographic photosensitive member 1C, a third-color charging device 3C, a third-color exposure device for emitting exposure light 4C corresponding to a third-color component image, a third-color developing device 5C and a third-color transfer device 6C; and a fourth-color image formation section, which has a fourth-color electrophotographic photosensitive member 1K, a fourth-color charging device 3K, a fourth-color exposure device for emitting exposure light 4K corresponding to a fourth-color component image, a fourth-color developing device 5K and a fourth-color transfer device 6K, are operated in the same manner as in the first-color image formation device. More specifically, to the transfer material P carried by the transfer material conveying member 14 and having the first-color toner image transferred thereon, a second-color toner image (magenta toner image), a third-color toner image (cyan toner image), a fourth-color toner image (black toner image) are sequentially transferred. In this way, on the transfer material P carried by the transfer material conveying member 14, a synthesized toner image corresponding to a desired color image is formed.

The transfer material P having the synthesized toner image formed thereon is separated from the surface of the transfer material conveying member 14 and introduced in the fixation device 8, in which the image is fixed. In this way, a material (print, copy) having a color-image formed thereon is output from the apparatus as a printed matter.

Furthermore, after remaining toner is removed by the first-color to fourth-color charging device 7Y, 7M, 7C and 7K, the charge of the surfaces of the first to fourth-color electrophotographic photosensitive members 1Y, 1M, 1C and 1K may be removed by pre-light exposure from the pre-light exposure device. However, when the first-color to fourth-color charging device 3Y, 3M, 3C and 3K are contact charging device using a charging roller as shown in FIG. 4, pre-light exposure is not always necessary.

Of the structural elements such as the electrophotographic photosensitive member, the charging device, the developing device, the transfer device and the cleaning device, a plurality of structural units is installed in a container and united as a process cartridge. The process cartridge may be detachably provided to an electrophotographic apparatus main body such as a copying machine and a laser beam printer. In FIG. 4, the electrophotographic photosensitive member, the charging device, the developing device and the charging device are integrally united into one body in a cartridge per image formation section and used as a cartridge. Process cartridges 9Y, 9M, 9C and 9K may be detachably provided to the electrophotographic apparatus main body by use of guide (not shown) such as rails of the electrophotographic apparatus main body.

EXAMPLES

The present invention will be described more specifically by way of specific examples. However, the present invention is not limited to these. Note that, the "parts" in the examples refers to "parts by mass".

EXAMPLE 1

An aluminum cylinder having a diameter of 30 mm and a length of 260.5 mm was used as a support.

Next, 10 parts of $SnO_2$-coated barium sulfate (conductive particles), 2 parts of titanium oxide (pigment for controlling resistance), 6 parts of a phenol resin (binder resin), 0.001 part of silicon oil (leveling agent) and a solvent mixture of methanol (4 parts)/methoxy propanol (16 parts) were used to prepare a conductive-layer coating solution.

The conductive-layer coating solution was applied on the support by dipping and hardened by thermal setting at 140° C. for 30 minutes to form a conductive layer having a film thickness of 15 μm.

Next, N-methoxymethylated nylon (3 parts) and a nylon copolymer (3 parts) were dissolved in a solvent mixture of methanol (65 parts)/n-butanol (30 parts) to prepare an intermediate-layer coating solution.

The intermediate-layer coating solution was applied onto the conductive layer by dipping and dried at 100° C. for 10 minutes to obtain an intermediate layer having a film thickness of 0.7 μm.

Next, 10 parts of crystalline hydroxygallium phthalocyanine (charge generating material), which had intensive peaks at a Bragg angle (in CuKα characteristic X-ray diffraction) 2θ±0.2° of 7.5°, 9.9°, 16.3°, 18.6°, 25.1° and 28.3°, was added to a solution obtained by dissolving 5 parts of polyvinyl butyral resin (trade name: SLEC BX-1, a binder resin manufactured by Sekisui Chemical Co., Ltd.) in cyclohexanone (250 parts). The mixture was dispersed by a sand mill apparatus using glass beads having a diameter of 1 mm under an atmosphere of 23±3° C. for one hour. After dispersion, ethyl acetate (250 parts) was added to prepare a charge-generating layer coating solution.

The charge-generating layer coating solution was applied onto the intermediate layer by dipping and dried at 100° C. for 10 minutes to form a charge generation layer having a film thickness of 0.26 μm.

Next, 1 part of a compound (charge transporting material) represented by the above formula (4-1), 9 parts of the compound (charge transporting material) represented by the following formula (CTM-1):

(CTM-1)

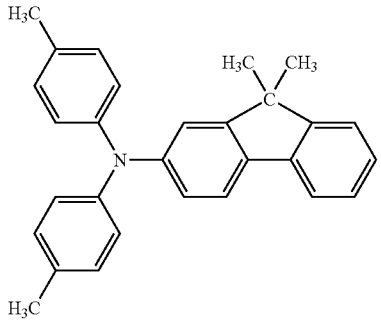

and 10 parts of polyester resin A1 (binder resin) synthesized in Synthesis Example 1, were dissolved in a solvent mixture of dimethoxy methane (20 parts) and monochlorobenzene (60 parts) to prepare a charge-transporting layer coating solution.

The charge-transporting layer coating solution was applied onto the charge generation layer by dipping and dried at 120° C. for one hour to form a charge transport layer having a film thickness of 19 μm.

In this way, an electrophotographic photosensitive member having the charge transport layer as a surface layer was manufactured.

Next, evaluation will be described.

Evaluation was made with respect to variation (potential change) of a light-part potential in the case of repeated use of 2,000 paper sheets, a relative value of initial torque and a relative value of torque in the case of repeated use of 2,000 paper sheets, and observation on the surface of the electrophotographic photosensitive member when torque was measured.

As an evaluation apparatus, a laser beam printer LBP-2510 (charge (primary charge): contact charge system, process speed: 94.2 mm/s) manufactured by Canon Inc. was modified such that the charge potential (dark-portion potential) of an electrophotographic photosensitive member could be adjusted and put in use. Furthermore, the contact angle of a cleaning blade made of polyurethane rubber with respect to the surface of the electrophotographic photosensitive member was set to 25° and the contact pressure thereof was set at 35 g/cm.

Evaluation was made under an environment of a temperature of 23° C. and a relative humidity of 50%.

<Evaluation of Potential Change>

The exposure amount (exposure amount of image) of a laser light source (780 nm) of the evaluation apparatus was set such that the light amount at the surface of the electrophotographic photosensitive member was 0.3 $\mu J/cm^2$.

The surface potential of the electrophotographic photosensitive member (dark-part potential and light-part potential) was measured at the position of a developing device by exchanging the developing device by a jig, which was fixed such that a potential measuring probe is positioned at a distance of 130 mm from the edge of an electrophotographic photosensitive member.

The potential of the dark-part, i.e., unexposed part, of an electrophotographic photosensitive member was set at −450 V, and then laser light was applied. The potential of a light part, which was light-attenuated from the dark-part potential, was measured.

Furthermore, using A4-size regular paper sheets, an image was output continuously on 2,000 sheets. Before and after the operation, variation of light-part potential was evaluated. The results are shown in the column of potential variation in Table 4. Note that, the test chart used herein had a printing ratio of 5%.

<Evaluation of Relative Torque Value>

Under the same conditions as in the above potential change evaluation conditions, the driving current value (current value A) of a rotation motor for an electrophotographic photosensitive member was measured. In this evaluation, the amount of contact stress between an electrophotographic photosensitive member and a cleaning blade is evaluated. The magnitude of the current value obtained indicates the amount of contact stress between an electrophotographic photosensitive member and a cleaning blade.

Furthermore, an electrophotographic photosensitive member, which was to be used as a control to obtain a relative torque value, was manufactured according to the following methods.

An electrophotographic photosensitive member was manufactured in the same manner as in Example 1 except that polyester resin A1 used as a binder resin for the charge transport layer of the electrophotographic photosensitive member of Example 1 was changed to a polyester resin (weight average molecular weight 120,000) having the repeating structural unit represented by the above formula (2-12) and the repeating structural unit represented by the above formula (2-24) in a molar ratio of 5:5. This was used as a control electrophotographic photosensitive member.

Using the control electrophotographic photosensitive member thus manufactured, the driving current value (current value B) of a rotation motor of an electrophotographic photosensitive member was measured in the same manner as in Example 1.

The ratio between the driving current value (current value A) of the electrophotographic photosensitive member using a polyester resin according to the present invention thus obtained and the driving current value (current value B) of the rotation motor of the electrophotographic photosensitive member using no polyester resin according to the present invention was calculated. The resultant numerical value of (current value A)/(current value B) was regarded as a relative torque value for comparison. The numerical value of the relative torque value indicates an increase/decrease of the contact stress amount between an electrophotographic photosensitive member and a cleaning blade. The smaller the numerical value of the relative torque value, the lower the contact stress amount between an electrophotographic photosensitive member and a cleaning blade. The results are shown in the column of relative value of initial torque in Table 4.

Subsequently, using A4-size plain paper sheets, an image was output continuously on 2,000 sheets. Note that, the test chart used herein had a printing ratio of 5%.

Thereafter, the relative torque value after repeated use (2,000 sheets) was determined. The relative torque value after repeated use (2,000 sheets) was evaluated in the same manner as in the relative value of initial torque. In this case, the control electrophotographic photosensitive member was repeatedly used for 2,000 sheets. Using the driving current value at this time, the relative value of torque after repeated use of 2,000 sheets was calculated. The results are shown in the column of relative torque value after 2,000 sheets in Table 4.

EXAMPLES 2 to 8

Electrophotographic photosensitive members were manufactured and evaluated in the same manner as in Example except that the binder resin of the charge transport layer of Example 1 was changed to those shown in Table 2. The results are shown in Table 4.

EXAMPLE 9

The same procedure as in Example 1 was performed until the charge generation layer was formed.

Next, 1 part of a compound (charge transporting material) represented by the above formula (4-1), 9 parts of the compound (charge transporting material) represented by the above formula (CTM-1), 8 parts of polyester resin A1 synthesized in Synthesis Example 1 and 2 parts of a polyester resin (weight average molecular weight 120,000) having the repeating structural unit represented by the above formula (2-12) and the repeating structural unit represented by the above formula (2-24) in molar ratio of 5:5 were dissolved in a solvent mixture of dimethoxy methane (20 parts) and monochlorobenzene (60 parts) to prepare a charge-transporting layer coating solution.

The charge-transporting layer coating solution was applied onto the charge generation layer by dipping and dried at 120° C. for one hour to form a charge transport layer having a film thickness of 19 μm. For the charge transport layer formed, no aggregation of the charge transporting material in the polyester resin (polyester resin A1) according to the present invention having a siloxane moiety was observed.

In this way, an electrophotographic photosensitive member having a charge transport layer as a surface layer was manufactured.

Evaluation was made in the same manner as in Example 1. The results are shown in Table 4.

EXAMPLE 10

An electrophotographic photosensitive member was manufactured and evaluated in the same manner as in Example 1 except that, the mixing ratio of polyester resin A1 relative to a polyester resin (weight average molecular weight 120,000) having the repeating structural unit represented by the above formula (2-12) and the repeating structural unit represented by the above formula (2-24) in a molar ratio of 5:5 in Example 9 was changed to that shown in Table 2. The results are shown in Table 4. In Example 10, for the charge transport layer formed, no aggregation of the charge transporting material in a polyester resin (polyester resin A1) according to the present invention having a siloxane moiety was observed.

EXAMPLE 11

The same procedure as in Example 1 was performed until a charge generation layer was obtained.

Next, 1 part of a compound (charge transporting material) represented by the above formula (4-1), 9 parts of the compound (charge transporting material) represented by the above formula (CTM-1), 8 parts of polyester resin A1 synthesized in Synthesis Example 1, and 2 parts of a polycarbonate resin (weight average molecular weight 120,000) having the repeating structural unit represented by the above formula (9-4) were dissolved in a solvent mixture of dimethoxy methane (20 parts) and monochlorobenzene (60 parts) to prepare a charge-transporting layer coating solution.

The charge-transporting layer coating solution was applied onto the charge generation layer by dipping and dried at 120° C. for one hour to form a charge transport layer having a film thickness of 19 μm. For the charge transport layer formed, no aggregation of the charge transporting material in a polyester resin (polyester resin A1) according to the present invention having a siloxane moiety was observed.

In this way, an electrophotographic photosensitive member having a charge transport layer as a surface layer was manufactured.

Evaluation was made in the same manner as in Example 1. The results are shown in Table 4.

EXAMPLES 12 to 17

Electrophotographic photosensitive members were manufactured and evaluated in the same manner as in Example 1 except that the binder resin of the charge transport layer in Example 1 was changed to those shown in Table 2 and used in mixing ratios shown in Table 2. The results are shown in Table 4. For the charge transport layer formed in Examples 16 and 17, no aggregation of the charge transporting material in a polyester resin (polyester resin B1) according to the present invention having a siloxane moiety was observed.

EXAMPLES 18 to 22

Electrophotographic photosensitive members were manufactured and evaluated in the same manner as in Example 1 except that the binder resin of the charge transport layer in Example 1 was changed to those shown in Table 2, and used in mixing ratios shown in Table 2. However, the electrophotographic photosensitive member used in torque evaluation was manufactured by changing the binder resin of the charge transport layer of the control electrophotographic photosensitive member used in Example 1 to a polyester resin (weight average molecular weight 130,000) having the repeating structural unit represented by the above formula (2-33) and subjected to measurement. The results are shown in Table 4.

EXAMPLES 23 to 29

Electrophotographic photosensitive members were manufactured and evaluated in the same manner as in Example 1 except that the binder resin of the charge transport layer in Example 1 was changed to those shown in Table 2, and used in mixing ratios shown in Table 2, and further the charge transporting material was changed to the compound represented by the above formula (4-7). However, the electrophotographic photosensitive member used in torque evaluation was manufactured by changing the binder resin of the charge transport layer of the control electrophotographic photosensitive member used in Example 1 to a polyester resin (weight average molecular weight 130,000) having the repeating structural unit represented by the above formula (2-33) and further the charge transporting material to the compound represented by the above formula (4-7) and subjected to measurement. The results are shown in Table 4. For the charge transport layers formed in Examples 27 to 29, no aggregation of the charge transporting material in a polyester resin (polyester resin H) according to the present invention having a siloxane moiety was observed.

EXAMPLES 30 to 33

Electrophotographic photosensitive members were manufactured and evaluated in the same manner as in Example 1 except that the binder resin of the charge transport layer in Example 1 was changed to those shown in Table 2, and used in mixing ratios shown in Table 2. However, the electrophotographic photosensitive member used in torque evaluation was manufactured by changing the binder resin of the charge transport layer of the control electrophotographic photosensitive member used in Example 1 to a polyester resin (weight average molecular weight 110,000) having the repeating structural unit represented by the above formula (2-34) and the repeating structural unit represented by the above formula (2-24) in a molar ratio of 7:3 and subjected to measurement. The results are shown in Table 4.

EXAMPLE 34

An electrophotographic photosensitive member was manufactured and evaluated in the same manner as in Example 1 except that the binder resin of the charge transport layer in Example 1 was changed to that shown in Table 2, and used in a mixing ratio shown in Table 2. However, the electrophotographic photosensitive member used in torque evaluation was manufactured by changing the binder resin of the charge transport layer of the control electrophotographic photosensitive member used in Example 1 to a polyester resin (weight average molecular weight 120,000) having the repeating structural unit represented by the above formula (2-1) and subjected to measurement. The results are shown in Table 4.

EXAMPLE 35

An electrophotographic photosensitive member was manufactured and evaluated in the same manner as in Example 1 except that the binder resin of the charge transport layer in Example 1 was changed to that shown in Table 2, and used in a mixing ratio shown in Table 2. However, the electrophotographic photosensitive member used in torque evaluation was manufactured by changing the binder resin of the charge transport layer of the control electrophotographic photosensitive member used in Example 1 to a polyester resin (weight average molecular weight 120,000) having the repeating structural unit represented by the above formula (2-2) and subjected to measurement. The results are shown in Table 4.

EXAMPLE 36

An electrophotographic photosensitive member was manufactured and evaluated in the same manner as in Example 1 except that the binder resin of the charge transport layer in Example 1 was changed to that shown in Table 2, and used in a mixing ratio shown in Table 2. However, the electrophotographic photosensitive member used in torque evaluation was manufactured by changing the binder resin of the charge transport layer of the control electrophotographic photosensitive member used in Example 1 was changed to a polyester resin (weight average molecular weight 110,000) having the repeating structural unit represented by the above formula (2-1) and the repeating structural unit represented by the above formula (2-24) in a molar ratio of 3:7 and subjected to measurement. The results are shown in Table 4.

EXAMPLE 37

An electrophotographic photosensitive member was manufactured and evaluated in the same manner as in Example 1 except that the binder resin of the charge transport layer in Example 1 was changed to that shown in Table 2, and used in a mixing ratio shown in Table 2. However, the electrophotographic photosensitive member used in torque evaluation was manufactured by changing the binder resin of the charge transport layer of the control electrophotographic photosensitive member used in Example 1 was changed to a polyester resin (weight average molecular weight 110,000) having the repeating structural unit represented by the above formula (2-2) and the repeating structural unit represented by the above formula (2-24) in a molar ratio of 3:7 and subjected to measurement. The results are shown in Table 4.

COMPARATIVE EXAMPLE 1

Polyester resin A9 (weight average molecular weight 120,000) having a content of a siloxane moiety (in the total mass of the polyester resin) of 1% by mass was prepared using, as a dicarboxylic acid halide, dicarboxylic acid halide represented by the above formula (6-1) and dicarboxylic acid halide represented by the above formula (6-2) used in Synthesis Example 1 and using, as the diol, the diol compound represented by the above formula (7-1) and the diol compound represented by formula (8-1) used in Synthesis Example 1 while controlling their use amounts in synthesis. This is shown in Table 3.

An electrophotographic photosensitive member was manufactured and evaluated in the same manner as in Example 1 except that the binder resin of the charge transport layer in Example 1 was changed to polyester resin A9. The results are shown in Table 4.

COMPARATIVE EXAMPLE 2

Polyester resin A10 (weight average molecular weight 160,000) having a content of a siloxane moiety (in the total mass of the polyester resin) of 40% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, the diol compound represented by the above formula (7-1) and the diol compound represented by formula (8-1) used in Synthesis Example 1, while controlling their use amounts in synthesis. This is shown in Table 3.

An electrophotographic photosensitive member was manufactured and evaluated in the same manner as in Example 1 except that the binder resin of the charge transport layer in Example 1 was changed to polyester resin A10. The results are shown in Table 4. For the charge transport layer formed, aggregation of the charge transporting material in the resin (polyester resin A10) having a siloxane moiety was observed.

COMPARATIVE EXAMPLE 3

Polyester resin T1 (weight average molecular weight 120,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-8):

(7-8)

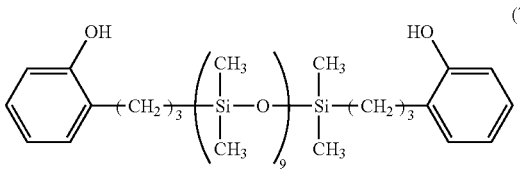

and the diol compound represented by the above formula (8-1), while controlling their use amounts in synthesis. Polyester resin T is a polyester resin containing a repeating structural unit represented by the following formula (P-1):

(P-1)

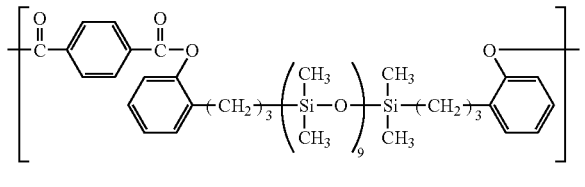

and a repeating structural unit represented by the following formula (P-2):

(P-2)

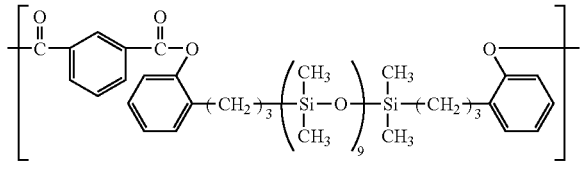

in a molar ratio of 5:5; and the repeating structural unit represented by the above formula (2-12) and the repeating structural unit represented by the above formula (2-24) in a molar ratio of 5:5.

An electrophotographic photosensitive member was manufactured in the same manner as in Example 1 except that the binder resin of the charge transport layer in Example 1 was changed to polyester resin T1. This is shown in Table 3. Evaluation was made in the same manner as in Example 1. The results are shown in Table 4.

COMPARATIVE EXAMPLE 4

Polyester resin T2 (weight average molecular weight 120,000) having a content of a siloxane moiety (in the total mass of the polyester resin) of 20% by mass was synthesized using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-9):

(7-9)

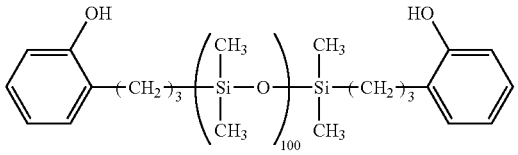

and the diol compound represented by the above formula (8-1), while controlling their use amounts in synthesis. Polyester resin T2 is a polyester resin containing a repeating structural unit represented by the following formula (P-3):

(P-3)

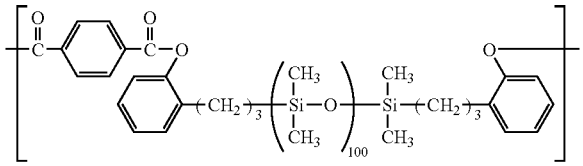

and a repeating structural unit represented by the following formula (P-4):

(P-4)

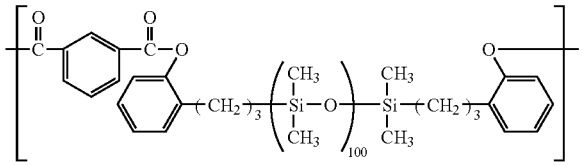

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that the binder resin of the charge transport layer in Example 1 was changed to polyester resin T2. This is shown in Table 3. Evaluation was made in the same manner as in Example 1. The results are shown in Table 4.

For the charge transport layer formed, aggregation of the charge transporting material in the resin (polyester resin T2) having a siloxane moiety was observed.

COMPARATIVE EXAMPLE 5

Polyester resin U (weight average molecular weight 120,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-10):

(7-10)

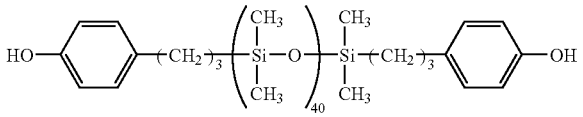

the diol compound represented by the above formula (8-1), while controlling their use amounts in synthesis. Polyester resin U is a polyester resin containing a repeating structural unit represented by the following formula (P-5):

(P-5)

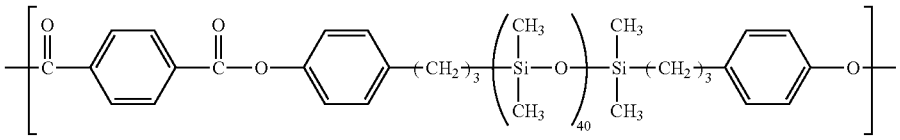

and a repeating structural unit represented by the following formula (P-6):

(P-6)

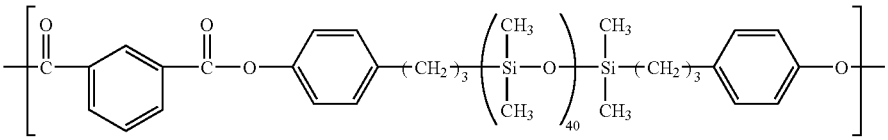

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that the binder resin of the charge transport layer in Example 1 was changed to polyester resin U. This is shown in Table 3. Evaluation was made in the same manner as in Example 1. The results are shown in Table 4.

COMPARATIVE EXAMPLE 6

Polyester resin V (weight average molecular weight 120,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-11):

(7-11)

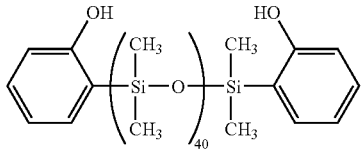

and the repeating structural unit represented by the above formula (8-1), while controlling their use amounts in synthesis. Polyester resin V is a polyester resin containing a repeating structural unit represented by the following formula (P-7):

(P-7)

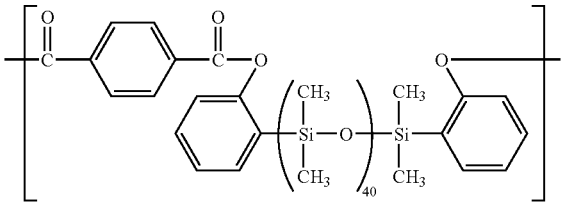

and a repeating structural unit represented by the following formula (P-8):

(P-8)

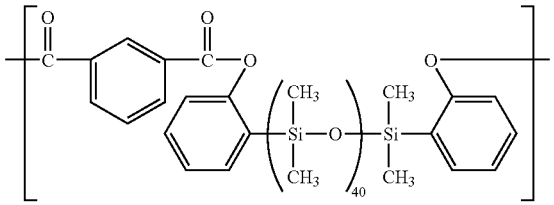

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that the binder resin of the charge transport layer in Example 1 was changed to polyester resin V. This is shown in Table 3. Evaluation was made in the same manner as in Example 1. The results are shown in Table 4.

For the charge transport layer formed, aggregation of the charge transporting material in the resin (polyester resin V) having a siloxane moiety was observed.

COMPARATIVE EXAMPLE 7

Polyester resin W1 (weight average molecular weight 100,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented the following formula (7-10):

(7-12)

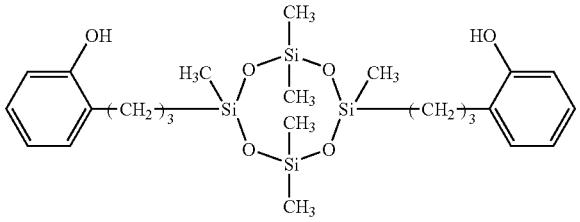

and a diol compound represented by the above formula (8-1), while controlling their use amounts in synthesis. Polyester resin W1 is a polyester resin containing a repeating structural unit represented the following formula (P-9):

(P-9)

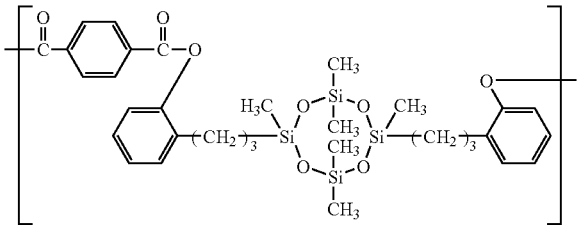

and a repeating structural unit represented the following formula (P-10):

(P-10)

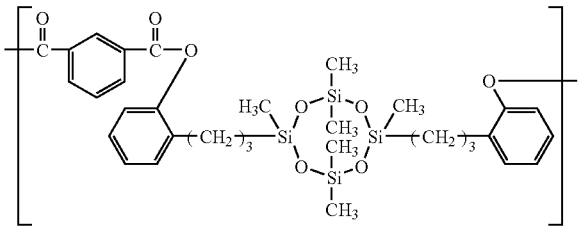

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that the binder resin of the charge transport layer in Example 1 was changed to polyester resin W1. This is shown in Table 3. Evaluation was made in the same manner as in Example 1. The results are shown in Table 4.

COMPARATIVE EXAMPLE 8

Polyester resin W2 (weight average molecular weight 80,000) having a content of a siloxane moiety (in the total mass of the polyester resin) of 20% by mass was prepared using, as a dicarboxylic acid halide, dicarboxylic acid halide represented by the above formula (6-1) and dicarboxylic acid halide represented by the above formula (6-2) used in Synthesis Example 1 and using, as a diol, a diol compound represented by the following formula (7-13):

(7-13)

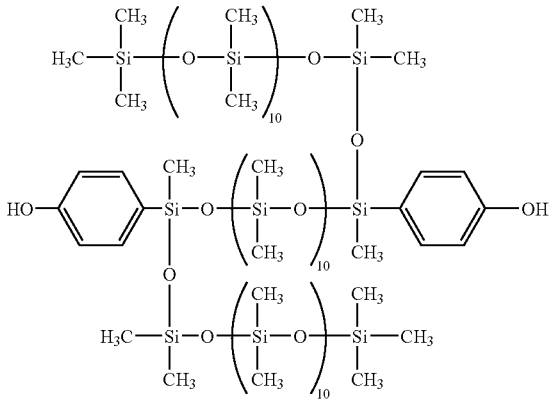

and a diol compound represented by and the above formula (8-1), while controlling their use amounts in synthesis. Polyester resin W2 is a polyester resin containing a repeating structural unit represented by the following formula (P-11):

in a molar ratio of 5:5, and having the repeating structural unit represented by the above formula (2-12) and the repeating structural unit represented by the above formula (2-24) in a molar ratio of 5:5.

An electrophotographic photosensitive member was manufactured in the same manner as in Example 1 except that the binder resin of the charge transport layer in Example 1 was changed to polyester resin W2. This is shown in Table 3. Evaluation was made in the same manner as in Example 1. The results are shown in Table 4.

COMPARATIVE EXAMPLE 9

An electrophotographic photosensitive member was manufactured in the same manner as in Example 1 except that the binder resin of the charge transport layer in Example 1 was changed to polyester resin X described in Japanese Patent Application Laid-Open No. 2003-302780 (which is a poly (P-11)

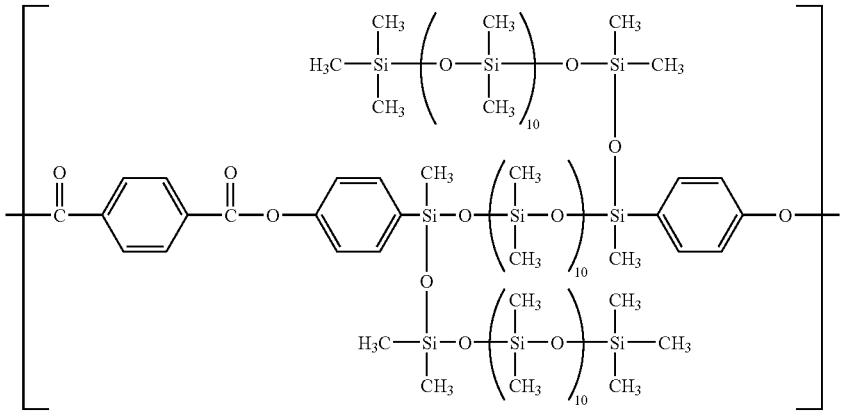

and a repeating structural unit represented the following formula (P-12):

ester resin having a repeating structural unit represented by the following formula (P-13):

(P-12)

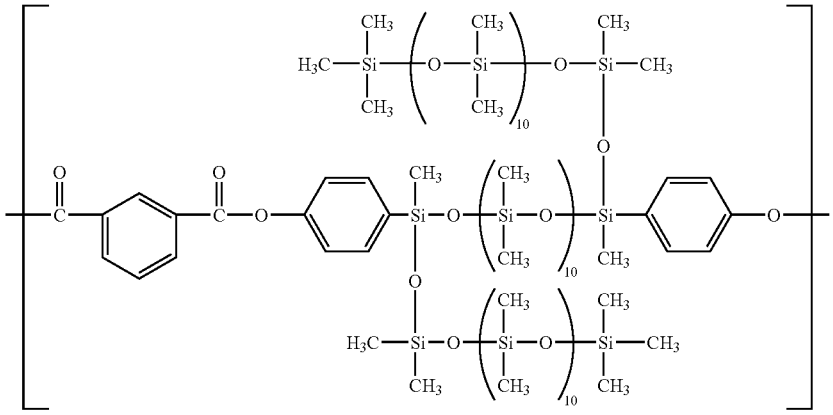

(P-13)

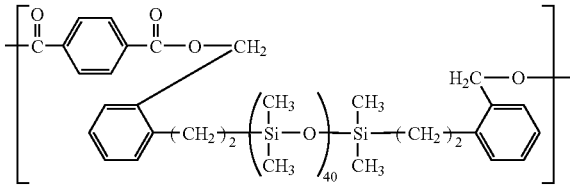

and the repeating structural unit represented by the above formula (2-15) in a molar ratio of 15:85). This is shown in Table 3. Evaluation was made in the same manner as in Example 1. The results are shown in Table 4.

COMPARATIVE EXAMPLE 10

As the binder resin of the charge transport layer in Example 1, polyester resin Y was synthesized having a repeating structural unit represented by the following formula (P-14):

(P-14)

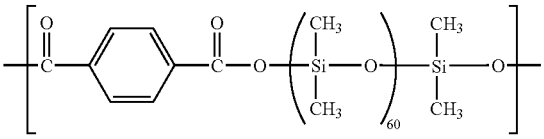

and a repeating structural unit represented by the following formula (P-15):

(P-15)

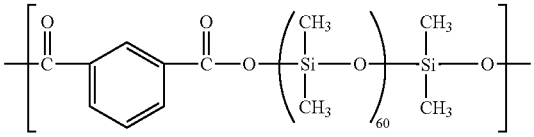

in a molar ratio of 5:5, and having the repeating structural unit represented by the above formula (2-12) and the repeating structural unit represented by the above formula (2-23) in a molar ratio of 5:5. The content of the siloxane moiety in the resin synthesized was 30% by mass.

An electrophotographic photosensitive member was manufactured in the same manner as in Example 1 except that the binder resin of the charge transport layer in Example 1 was changed to polyester resin Y. This is shown in Table 3. Evaluation was made in the same manner as in Example 1. The results are shown in Table 4. For the charge transport layer formed, aggregation of the charge transporting material in the resin (polyester resin Y) having a siloxane moiety was observed.

COMPARATIVE EXAMPLE 11

Polyester resin Z was synthesized having the repeating structural unit represented by the above formula (2-12) and the repeating structural unit represented by the above formula (2-24) and having a structure represented by the following formula (7-14):

(7-14)

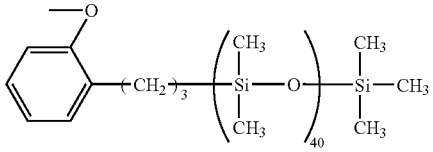

introduced to the end. The content of a siloxane moiety in the synthesized resin was 1.2% by mass.

An electrophotographic photosensitive member was manufactured in the same manner as in Example 1 except that the binder resin of the charge transport layer in Example 1 was changed to polyester resin Z. This is shown in Table 3. Evaluation was made in the same manner as in Example 1. The results are shown in Table 4.

COMPARATIVE EXAMPLE 12

An electrophotographic photosensitive member was manufactured in the same manner as in Example 1 except that polycarbonate resin A, having the repeating structural unit represented by the above formula (9-4) and a repeating structural unit represented by the following formula (P-16):

(P-16)

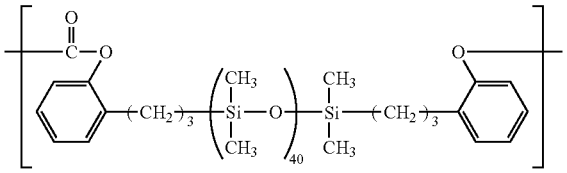

in a molar ratio of 5:5 was synthesized and mixed with a polyester resin having the repeating structural unit represented by the above formula (2-12) and the repeating structural unit represented by the above formula (2-24) in a molar ratio of 5:5, as shown in Table 3. This is shown in Table 3. Evaluation was made in the same manner as in Example 1. The results are shown in Table 4.

TABLE 2

| | Resin A (polyester resin) | Mass ratio A of siloxane (% by mass) | Resin B (resin having a different structure) | Mixing ratio of resin A to resin B | Mass ratio B of siloxane (% by mass) |
|---|---|---|---|---|---|
| Example 1 | Polyester resin A1 | 20 | — | — | 20 |
| Example 2 | Polyester resin A2 | 20 | — | — | 20 |
| Example 3 | Polyester resin A3 | 20 | — | — | 20 |
| Example 4 | Polyester resin A4 | 20 | — | — | 20 |
| Example 5 | Polyester resin A5 | 25 | — | — | 25 |
| Example 6 | Polyester resin A6 | 30 | — | — | 30 |

TABLE 2-continued

| | Resin A (polyester resin) | Mass ratio A of siloxane (% by mass) | Resin B (resin having a different structure) | Mixing ratio of resin A to resin B | Mass ratio B of siloxane (% by mass) |
|---|---|---|---|---|---|
| Example 7 | Polyester resin A7 | 10 | — | — | 10 |
| Example 8 | Polyester resin A8 | 5 | — | — | 5 |
| Example 9 | Polyester resin A1 | 20 | (2-12)/(2-24) = 5/5 | A/B = 8/2 | 16 |
| Example 10 | Polyester resin A1 | 20 | (2-12)/(2-24) = 5/5 | A/B = 6/4 | 12 |
| Example 11 | Polyester resin A1 | 20 | (9-4) | A/B = 8/2 | 16 |
| Example 12 | Polyester resin B1 | 20 | — | — | 20 |
| Example 13 | Polyester resin B2 | 30 | — | — | 30 |
| Example 14 | Polyester resin B3 | 10 | — | — | 10 |
| Example 15 | Polyester resin B4 | 5 | — | — | 5 |
| Example 16 | Polyester resin B1 | 20 | (2-12)/(2-24) = 5/5 | A/B = 8/2 | 16 |
| Example 17 | Polyester resin B1 | 20 | (2-12)/(2-24) = 5/5 | A/B = 6/4 | 12 |
| Example 18 | Polyester resin C | 20 | — | — | 20 |
| Example 19 | Polyester resin D | 20 | — | — | 20 |
| Example 20 | Polyester resin E | 20 | — | — | 20 |
| Example 21 | Polyester resin F | 20 | — | — | 20 |
| Example 22 | Polyester resin G | 20 | — | — | 20 |
| Example 23 | Polyester resin H | 20 | — | — | 20 |
| Example 24 | Polyester resin I | 20 | — | — | 20 |
| Example 25 | Polyester resin J | 20 | — | — | 20 |
| Example 26 | Polyester resin K | 20 | — | — | 20 |
| Example 27 | Polyester resin H | 20 | (2-33) | A/B = 8/2 | 16 |
| Example 28 | Polyester resin H | 20 | (2-33) | A/B = 6/4 | 12 |
| Example 29 | Polyester resin H | 20 | (9-1) | A/B = 8/2 | 16 |
| Example 30 | Polyester resin L | 20 | — | — | 20 |
| Example 31 | Polyester resin M | 20 | — | — | 20 |
| Example 32 | Polyester resin N | 20 | — | — | 20 |
| Example 33 | Polyester resin O | 20 | — | — | 20 |
| Example 34 | Polyester resin P | 20 | — | — | 20 |
| Example 35 | Polyester resin Q | 20 | — | — | 20 |
| Example 36 | Polyester resin R | 20 | — | — | 20 |
| Example 37 | Polyester resin S | 20 | — | — | 20 |

In Table 2, "Resin A (polyester resin)" refers to a polyester resin having a repeating structural unit represented by the above formula (1) and a repeating structural unit represented by the above formula (2).

In Table 2, "Mass ratio A of siloxane (% by mass)" refers to the content (% by mass) of the siloxane moiety in "resin A (polyester resin)".

In Table 2, "Resin B (resin having a different structure)" refers to a resin containing no siloxane moiety.

In Table 2, "Mass ratio B of siloxane (% by mass)" refers to the content (% by mass) of the siloxane moiety in "resin A (polyester resin)" relative to the total mass of the whole binder resin contained in the charge transport layer.

TABLE 3

| | Resin A | Mass ratio A of siloxane (% by mass) | Resin B (resin having a different structure) | Mixing ratio of resin A to resin B | Mass ratio B of siloxane (% by mass) |
|---|---|---|---|---|---|
| Comparative Example 1 | Polyester resin A9 | 1 | — | — | 1 |
| Comparative Example 2 | Polyester resin A10 | 40 | — | — | 40 |
| Comparative Example 3 | Polyester resin T1 | 20 | — | — | 20 |
| Comparative Example 4 | Polyester resin T2 | 20 | — | — | 20 |
| Comparative Example 5 | Polyester resin U | 20 | — | — | 20 |
| Comparative Example 6 | Polyester resin V | 20 | — | — | 20 |
| Comparative Example 7 | Polyester resin W1 | 20 | — | — | 20 |
| Comparative Example 8 | Polyester resin W2 | 20 | — | — | 20 |
| Comparative Example 9 | Polyester resin X | 50 | — | — | 50 |
| Comparative Example 10 | Polyester resin Y | 30 | — | — | 30 |
| Comparative Example 11 | Polyester resin Z | 1.2 | — | — | 1 |
| Comparative Example 12 | Polycarbonate resin A | 84 | (2-12)/(2-24) = 5/5 | A/B = 1/9 | 8 |

In Table 3, "Resin A (polyester resin)" refers to the content of a resin having a siloxane moiety.

In Table 3, "Mass ratio A of siloxane (% by mass)" refers to the content (% by mass) of the siloxane moiety in "resin A".

In Table 3, "Resin B (resin having a different structure)" refers to a resin containing no siloxane moiety.

In Table 3, "Mass ratio B of siloxane (% by mass)" refers to the content (% by mass) of siloxane moiety in "resin A" relative to the total mass of the whole binder resin contained in the charge transport layer.

TABLE 4

| | Potential change (V) | Relative value of initial torque | Relative value of torque after 2,000 sheets |
|---|---|---|---|
| Example 1 | 10 | 0.66 | 0.67 |
| Example 2 | 15 | 0.66 | 0.67 |
| Example 3 | 12 | 0.68 | 0.67 |
| Example 4 | 35 | 0.70 | 0.69 |
| Example 5 | 20 | 0.62 | 0.63 |
| Example 6 | 40 | 0.57 | 0.57 |
| Example 7 | 8 | 0.70 | 0.73 |
| Example 8 | 5 | 0.80 | 0.90 |
| Example 9 | 10 | 0.68 | 0.67 |
| Example 10 | 8 | 0.70 | 0.73 |
| Example 11 | 5 | 0.68 | 0.67 |
| Example 12 | 12 | 0.60 | 0.62 |
| Example 13 | 43 | 0.55 | 0.55 |
| Example 14 | 10 | 0.66 | 0.67 |
| Example 15 | 8 | 0.73 | 0.80 |
| Example 16 | 12 | 0.66 | 0.67 |
| Example 17 | 10 | 0.68 | 0.72 |
| Example 18 | 8 | 0.72 | 0.74 |
| Example 19 | 8 | 0.85 | 0.88 |
| Example 20 | 25 | 0.62 | 0.62 |
| Example 21 | 40 | 0.57 | 0.56 |
| Example 22 | 5 | 0.85 | 0.85 |
| Example 23 | 12 | 0.66 | 0.67 |
| Example 24 | 20 | 0.62 | 0.62 |
| Example 25 | 10 | 0.83 | 0.88 |
| Example 26 | 45 | 0.58 | 0.59 |
| Example 27 | 12 | 0.69 | 0.69 |
| Example 28 | 10 | 0.72 | 0.75 |
| Example 29 | 7 | 0.68 | 0.67 |
| Example 30 | 8 | 0.65 | 0.65 |
| Example 31 | 15 | 0.63 | 0.62 |
| Example 32 | 5 | 0.81 | 0.88 |
| Example 33 | 38 | 0.55 | 0.56 |
| Example 34 | 30 | 0.66 | 0.67 |
| Example 35 | 27 | 0.66 | 0.67 |
| Example 36 | 18 | 0.66 | 0.67 |
| Example 37 | 15 | 0.66 | 0.67 |
| Comparative Example 1 | 8 | 1.00 | 1.00 |
| Comparative Example 2 | 40 | 0.57 | 0.95 |
| Comparative Example 3 | 12 | 0.97 | 0.97 |
| Comparative Example 4 | 220 | 0.53 | 0.53 |
| Comparative Example 5 | 73 | 0.77 | 0.79 |
| Comparative Example 6 | 180 | 0.79 | 0.80 |
| Comparative Example 7 | 28 | 0.92 | 0.92 |
| Comparative Example 8 | 150 | 0.53 | 0.53 |
| Comparative Example 9 | 240 | 0.77 | 0.79 |
| Comparative Example 10 | 200 | 0.66 | 0.68 |
| Comparative Example 11 | 20 | 0.95 | 0.98 |
| Comparative Example 12 | 15 | 0.68 | 0.98 |

The comparison between the Examples and Comparative Example 1 demonstrates that when the mass ratio of siloxane relative to the polyester resin in the charge transport layer and the mass ratio of siloxane relative to the whole binder resin in the charge transport layer are low, a sufficient effect of mitigating the contact stress cannot be obtained.

Furthermore, the comparison between the Examples and Comparative Example 2 demonstrates that when the mass ratio of siloxane relative to the polyester resin in the charge transport layer is high, the compatibility with a charge transporting material becomes insufficient and the charge transporting material is aggregated in the resin having a siloxane moiety, causing a potential change.

Furthermore, the comparison between the Examples and Comparative Example 3 demonstrates that when the polyester resin having a siloxane moiety has a small average number of repetitions of siloxane moieties in the charge transport layer, a sufficient effect of mitigating the contact stress cannot be obtained. This means that the effect of mitigating the contact stress varies depending upon the length of siloxane chain.

However, the comparison between the Examples and Comparative Example 4 demonstrates that when the polyester resin having a siloxane moiety has a large average number of repetitions of siloxane moieties in the charge transport layer, the potential change becomes large, the characteristics of electrophotographic photosensitive member deteriorate. This is because when the siloxane chain length of the siloxane moiety is long, compatibility with a charge transporting material decreases and the charge transporting material aggregates in a resin containing a siloxane moiety.

Accordingly, in order to keep mitigation of contact stress and satisfactory compatibility with a charge transporting material in balance with each other, it is important to have an appropriate average number of repetitions of siloxane moieties (siloxane chain length).

Furthermore, the comparison between the Examples and Comparative Example 5 demonstrates that difference in the characteristics is produced depending upon the binding position of a phenylene moiety, which binds a siloxane moiety and a dicarboxylic acid moiety. In the binding manner of the phenylene moiety shown in Comparative Example 5 (binding at the para position), the siloxane moiety, which is inferior in compatibility with a charge transporting material, is more linearly arranged to a polymer chain. For this reason, it is presumed that compatibility with a charge transporting material decreases and the charge transporting material is aggregated in a resin containing a siloxane moiety. In the binding manner shown in the Examples (binding at the ortho position, it is considered that since a siloxane moiety is arranged not linearly to the polymer chain, the compatibility is higher and characteristics are stabilized.

Furthermore, the comparison between the Examples and Comparative Example 6 demonstrates that characteristic difference occurs depending upon the presence or absence of an alkylene group at both ends of the siloxane moiety. This suggests that in the case where a siloxane moiety and a phenylene moiety are directly bound as shown in Comparative Example 6, compatibility of the siloxane moiety with the charge transporting material significantly decreases; however, when an alkylene group is provided, compatibility deterioration rarely occurs. Since the siloxane moiety has an alkylene group at both ends, the structure can be relatively freely modified, improving compatibility.

Furthermore, comparison between the Examples and Comparative Example 7 demonstrates that when the siloxane moiety forms a cyclic structure, en effect of mitigating contact stress is rarely obtained. It is generally known that the effect of mitigating contact stress is exerted by the presence of a siloxane moiety on the surface. In the case where the siloxane moiety has a straight-chain structure, the glass transition temperature of the siloxane moiety is low and thus the structure of the siloxane moiety is easily changed. Therefore, it is possible to increase the number of siloxane moieties present on the surface.

However, if the siloxane moiety has a cyclic structure, the siloxane structure is rarely changed compared to a straight-chain structure. It is thus considered that the above characteristic difference occurs.

Furthermore, the comparison between the Examples and Comparative Example 8 demonstrates that when the siloxane moiety has a branched structure, satisfactory effect of mitigating contact stress can be obtained; however, the compatibility with a charge transporting material becomes insufficient, giving rise to a potential change. This is, as described above, presumably derived from the fact that the charge transporting material has a structure with an aromatic ring, the affinity for a siloxane moiety is not high although aggregation of a charge transporting material is not clearly observed.

Furthermore, the comparison between the Examples and Comparative Example 9 demonstrates that the potential stability and effect of mitigating contact stress differ due to the difference in the binding manner of a phenylene group to be bound to dicarboxylic acid. The structure of an alkylene group-methylene group (Comparative Example 10) bound at the ortho position of a phenylene group differs from the structure of an alkylene group-an oxygen atom (Examples). Due to its sterical hindrance, it is presumed that the structure may be relatively fixed in the alkylene group-methylene group. As a result, it is considered that the compatibility with a charge transporting material which reflects potential stability differs and the effect of mitigating contact stress caused by free movement of a siloxane chain differs. Furthermore, the resin, which has a high mass ratio of siloxane relative to a polyester resin in a charge transport layer, may conceivably influence characteristic deterioration.

Furthermore, the comparison between the Examples and Comparative Example 10 demonstrates that when a carboxylic acid is directly bound to a siloxane moiety, the compatibility of the siloxane moiety with a charge transporting material significantly deteriorates.

Furthermore, the comparison between the Examples and Comparative Example 11 demonstrates that when the siloxane structure is present only at an end, structurally, the mass ratio of siloxane relative to the polyester resin in a charge transport layer and the mass ratio of siloxane relative to the whole binder resin in a charge transport layer are low, and thus the effect of mitigating contact stress cannot be obtained.

Furthermore, the comparison between the Examples and Comparative Example 12 demonstrates that when a polycarbonate resin having the siloxane structure is used in combination with a polyester resin, the effect of mitigating contact stress does not last. This is considered because the compatibility between the above resins decreases and a polycarbonate resin having the siloxane structure may migrate to the surface.

EXAMPLE 38

Figure 5:
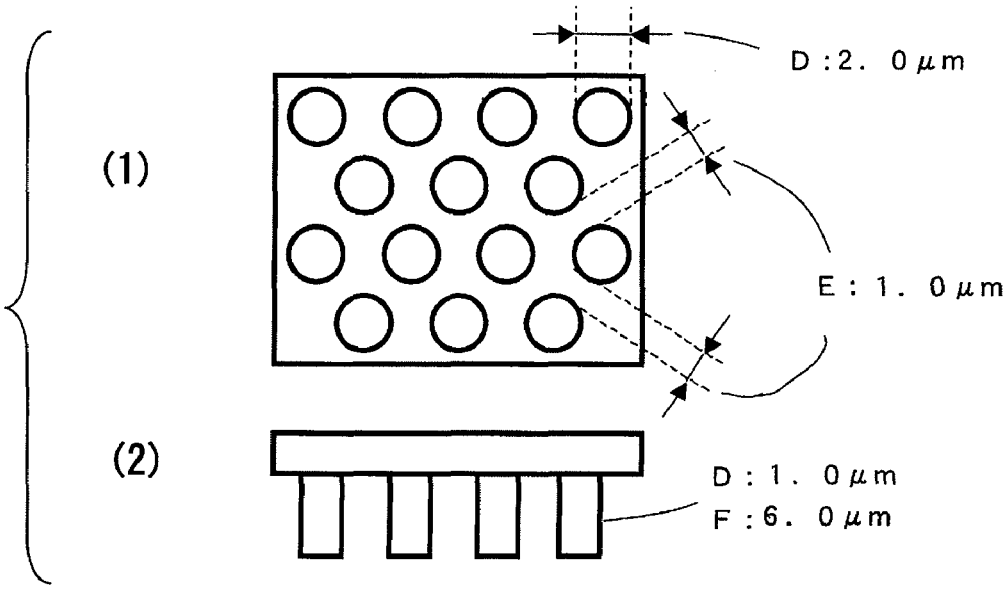
FIG. 5 is a view (partially enlarged view) illustrating the shape of a mold used in Examples 38 to 41, in which (1) is a view of the mold shape as viewed from the top and (2) is a view of the mold shape as viewed from the side.

An electrophotographic photosensitive member manufactured in the same manner as Example 1 was subjected to surface processing by a press contact shape transfer/processing apparatus using a mold, shown in FIG. 2, in which a shape transfer mold shown in FIG. 5 is disposed. During processing, the temperatures of the electrophotographic photosensitive member and the mold were controlled at 110° C. Shape transfer was preformed by rotating the electrophotographic photosensitive member in the circumference direction while pressuring the mold at a pressure of 4 MPa. In FIG. 5, (1) shows a mold shape as viewed from the top and (2) shows a mold shape as viewed from the side. The mold shown in FIG. 5 has a cylindrical shape. The major axis D is 2.0 μm, the height F is 6.0 μm, and the distance E between a mold and a mold is 1.0 μm.

With respect to the electrophotographic photosensitive member manufactured by the above method, the surface was observed by use of an ultra-depth profile measuring microscope VK-9500 (manufactured by Keyence Corporation). The electrophotographic photosensitive member to be measured was placed on a table, which is modified so as to fix the cylindrical support thereof. The surface was observed at a distance of 130 mm upward from the electrophotographic photosensitive member. At this time, measurement was made by setting the magnification of an objective lens at 50 times and setting a region of 100 μm squares (10,000 $\mu m^2$) in the surface of the electrophotographic photosensitive member as a field of vision. The depressions observed in the field of measurement vision were analyzed by use of an analysis program.

Figure 6:
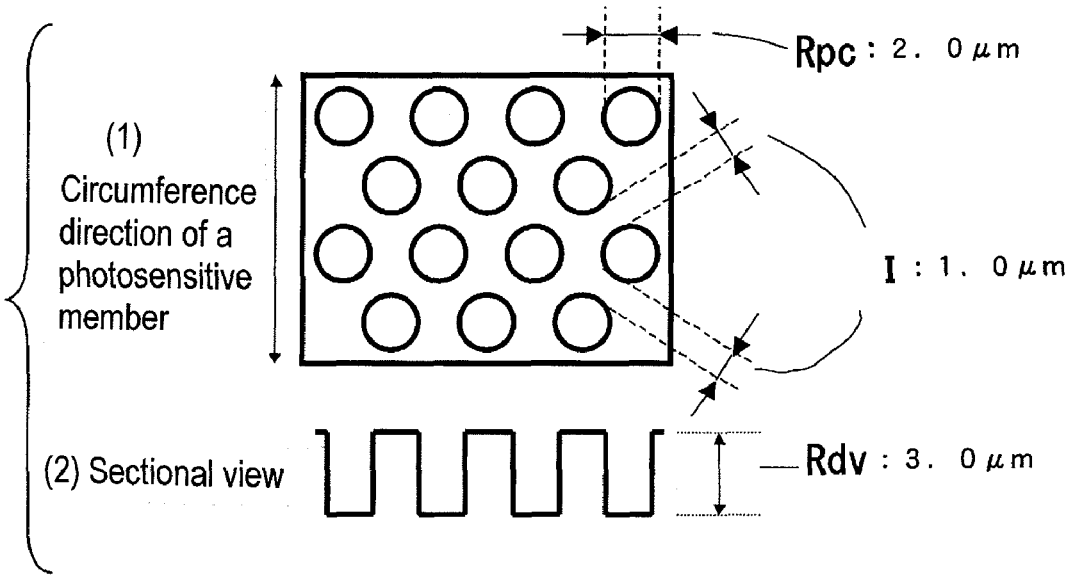
FIG. 6 is a view (partially enlarged view) of an alignment pattern of depressions in the surface of the electrophotographic photosensitive member obtained in Examples 38 to 41, in which (1) shows alignment state of the depressions formed in the surface of the electrophotographic photosensitive member and (2) shows a sectional view of the depressions.

In regard to individual depressions within the field of vision, the shapes of surface portions, major axes (Rpc in FIG. 6) and depths (Rdv in FIG. 6) were measured. It was confirmed that depressions (shown in FIG. 6) having an average major axis of 2.0 μm and an average depth of 1.2 μm are formed. In FIG. 6 illustrating arrangement of depressions, (1) is the view of the surface of an electrophotographic photosensitive member as viewed from the top and (2) is a cross-sectional view of the depressions. Furthermore, the depressions are formed at intervals (I in FIG. 6) of 1.0 μm. When the area ratio thereof was calculated, it was 46%. The composition of the resin in a charge transport layer used in Example 41 is shown in Table 5.

The electrophotographic photosensitive member obtained was evaluated in the same manner as in Example 1. The results are shown in Table 6.

EXAMPLES 39 to 41

Electrophotographic photosensitive members manufactured in the same manner as in Examples 12, 30 and 31, were subjected to surface processing performed in the same manner as in Example 38 except that the pressure applied to the mold was changed. The surfaces were observed in the same manner as in Example 38. As a result, it was confirmed that, the following depressions (as shown in FIG. 6) are formed on the surfaces of the electrophotographic photosensitive members, respectively:

Example 39: average major axis: 2.0 μm, average depth: 1.4 μm,

Example 40: average major axis: 2.0 μm, average depth: 0.8 μm, and

Example 41: average major axis: 2.0 μm, average depth: 0.9 μm. Furthermore, the depressions were formed at intervals I of 1.0 μm. The compositions of the resins used in the charge transport layers of Examples 39 to 41 are shown in Table 5.

The electrophotographic photosensitive members obtained were evaluated in the same manner as in Examples 12, 30 and 31. The results are shown in Table 6.

EXAMPLE 42

A conductive layer, an intermediate layer and a charge generation layer were formed on a support, in the same manner as in Example 1.

Next, a charge-transporting layer coating solution was prepared by dissolving 1 part of the compound (charge transporting material) represented by the above formula (4-1), 9 parts of the compound (charge transporting material) represented by the above formula (CTM-1) and 10 parts of polyester resin A1 (binder resin) synthesized in Synthesis Example 1, in a solvent mixture of dipropylene glycol (2 parts), dimethoxy methane (18 parts) and monochlorobenzene (60 parts).

The charge-transporting layer coating solution was applied onto the charge generation layer by dipping and the charge-transporting layer coating solution was applied onto the support. The step of applying the charge-transporting layer coating solution was performed under the conditions: a relative humidity of 50% and an ambient temperature of 25° C. One hundred and eighty (180) seconds after completion of the coating step, the support having been coated with the charge-transporting layer coating solution was placed in an air-blow dryer previously heated to 120° C. A dehydration step was performed for 60 minutes to form a charge transport layer having a film thickness of 19 μm.

In this way, an electrophotographic photosensitive member was manufactured having a charge transport layer serving as a surface layer and depressions formed on the surface thereof. The resin composition of the charge transport layer used in Example 42 is shown in Table 5.

The surface shape was measured in the same manner as in Example 38. As a result, it was confirmed that depressions having an average major axis of 2.5 μm and an average depth of 1.2 μm were formed in a ratio of 1,500 per unit area of 10,000 $\mu m^2$ (100 μm squares).

The electrophotographic photosensitive member thus obtained was evaluated in the same manner as in Example 1. The results are shown in Table 6.

EXAMPLE 43

An electrophotographic photosensitive member was manufactured in the same manner as in Example 42 except that polyester resin A1 used in Example 42 was changed to polyester resin B1. The composition of the resin of the charge transport layer used in Example 43 is shown in Table 5.

The surface shape was measured in the same manner as in Example 38. As a result, it was confirmed that depressions having an average major axis of 2.0 μm and an average depth of 1.0 μm were formed in a ratio of 1,200 per unit area of 10,000 $\mu m^2$ (100 μm squares).

The electrophotographic photosensitive member obtained was evaluated in the same manner as in Example 1. The results are shown in Table 6.

EXAMPLE 44 and 45

A conductive layer, an intermediate layer and a charge generation layer were formed on a support in the same manner as in Example 1.

Electrophotographic photosensitive members were manufactured in the same manner as in Example 42 except that the resins shown in Table 5 were used as the binder resin of the charge transport layer and the charge transporting material was changed to the compound represented by the above formula (4-7). The compositions of the resins of the charge transport layers used in Example 0.44 and 45 are shown in Table 5.

The surface shapes were measured in the same manner as in Example 38. As a result, it was confirmed that the following depressions were formed on the surfaces of the electrophotographic photosensitive members, in ratios of 1,200 and 1,400 per unit area of 10,000 $mm^2$ (100 μm squares), respectively:

Example 44: average major axis: 2.4 μm, an average depth: 1.5 μm, and

Example 45: average major axis: 1.8 μm, average depth: 1.2 μm.

The electrophotographic photosensitive members thus obtained were evaluated in the same manner as in Examples 32 and 33. The results are shown in Table 6.

EXAMPLES 46 to 49

Electrophotographic photosensitive members were manufactured in the same manner as in Example 42 except that polyester resin A1 used in Example 42 was changed to the resins shown in Table 5. The compositions of the resins of the charge transport layers used in Examples 46 to 49 are shown in Table 5.

The surface shapes were measured in the same manner as in Example 38. As a result, it was confirmed that the following depressions were formed on the surfaces of the electrophotographic photosensitive members, in ratios of 1,200, 1,200, 1,000 and 1,400 per unit area of 10,000 $mm^2$ (100 μm squares), respectively:

Example 46: average major axis: 2.5 μm, average depth: 1.2 μm,

Example 47: average major axis: 2.3 μm, average depth: 1.4 μm,

Example 48: average major axis: 2.8 μm, average depth: 1.5 μm, and

Example 49: average major axis: 1.8 μm, average depth: 1.2 μm.

The electrophotographic photosensitive members were evaluated in the same manner as in Example 1. The results are shown in Table 6.

TABLE 5

| | Resin A (polyester resin) | Mass ratio A of siloxane (% by mass) | Resin B (resin having a different structure) | Mixing ratio of resin A to resin B | Mass ratio B of siloxane (% by mass) |
|---|---|---|---|---|---|
| Example 38 | Polyester resin A1 | 20 | — | — | 20 |
| Example 39 | Polyester resin B1 | 20 | — | — | 20 |
| Example 40 | Polyester resin L | 20 | — | — | 20 |
| Example 41 | Polyester resin M | 20 | — | — | 20 |
| Example 42 | Polyester resin A1 | 20 | — | — | 20 |
| Example 43 | Polyester resin B1 | 20 | — | — | 20 |
| Example 44 | Polyester resin H | 20 | — | — | 20 |

TABLE 5-continued

| | Resin A (polyester resin) | Mass ratio A of siloxane (% by mass) | Resin B (resin having a different structure) | Mixing ratio of resin A to resin B | Mass ratio B of siloxane (% by mass) |
|---|---|---|---|---|---|
| Example 45 | Polyester resin I | 20 | — | — | 20 |
| Example 46 | Polyester resin L | 20 | — | — | 20 |
| Example 47 | Polyester resin M | 20 | — | — | 20 |
| Example 48 | Polyester resin Q | 20 | — | — | 20 |
| Example 49 | Polyester resin S | 20 | — | — | 20 |

In Table 5, "Resin A (polyester resin)" refers to a polyester resin having a repeating structural unit represented by the above formula (1) and a repeating structural unit represented by the above formula (2).

In Table 5, "Mass ratio A of siloxane moiety (% by mass)" refers to the content (% by mass) of siloxane moiety of "resin A (polyester resin)".

In Table 5, "resin B (resin having a different structure)" refers to a resin containing no siloxane moiety.

In Table 5, "Mass ratio B of siloxane (% by mass)" refers to the content of a siloxane moiety (% by mass) of "resin A (polyester resin)" relative to the total mass of the whole binder resin contained in the charge transport layer.

TABLE 6

| | Potential change (V) | Relative value of initial torque | Relative value of torque after 2,000 sheets |
|---|---|---|---|
| Example 38 | 10 | 0.48 | 0.60 |
| Example 39 | 12 | 0.45 | 0.62 |
| Example 40 | 8 | 0.48 | 0.57 |
| Example 41 | 15 | 0.48 | 0.55 |
| Example 42 | 20 | 0.50 | 0.63 |
| Example 43 | 18 | 0.48 | 0.65 |
| Example 44 | 18 | 0.50 | 0.63 |
| Example 45 | 25 | 0.53 | 0.65 |
| Example 46 | 15 | 0.52 | 0.63 |
| Example 47 | 25 | 0.52 | 0.65 |
| Example 48 | 35 | 0.56 | 0.63 |
| Example 49 | 25 | 0.53 | 0.67 |

EXAMPLE 50

An aluminum cylinder having a diameter of 24 mm and a length of 246 mm was used as a support.

Next, the same procedure as in Example 1 was performed until a charge generation layer was formed.

Next, a charge-transporting layer coating solution was prepared by dissolving 4 parts of the compound (charge transporting material) represented by the above formula (4-1), 6 parts of the compound (charge transporting material) represented by the above formula (CTM-1) and 10 parts of polyester resin A1 (binder resin) synthesized in Synthesis Example 1 in a solvent mixture of dimethoxy methane (20 parts) and monochlorobenzene (60 parts).

The charge-transporting layer coating solution was applied onto the charge generation layer by dipping and dried at 120° C. for one hour to form a charge transport layer having a film thickness of 10 μm.

The electrophotographic photosensitive member was evaluated for an image by use of laser jet P1006 printer (manufactured by Hewlett-Packard Development Company). Evaluation was made using a test chart having a printing ratio of 5% in the environment: a temperature of 23° C. and a relative humidity of 50%. Every time a single sheet having an image formed thereon was output, rotary driving of an electrophotographic photosensitive member was terminated. In this manner, 1,000 images were evaluated. As a result, image quality was satisfactory.

EXAMPLES 51 to 53

Electrophotographic photosensitive members were manufactured in the same manner as in Example 50 except that polyester resin A1 used in Example 50 was changed to polyester resin B1 (Example 51) mentioned above, polyester resin H (Example 52) mentioned above and polyester resin L (Example 53) mentioned above.

Evaluation was made in the same manner as in Example 50. The image quality was satisfactory in all cases.

EXAMPLE 54

An aluminum cylinder having a diameter of 30 mm and 357.5 mm was used as a support.

Next, the same procedure as in Example 1 was performed until a charge generation layer was formed.

Next, a charge-transporting layer coating solution was prepared by dissolving 1 part of a compound (charge transporting material) represented by the above formula (4-1), 9 parts of the compound (charge transporting material) represented by the above formula (CTM-1) and 10 parts of polyester resin A1 (binder resin) synthesized in Synthesis Example 1 in a solvent mixture of dimethoxy methane (20 parts) and monochlorobenzene (60 parts).

The charge-transporting layer coating solution was applied onto the charge generation layer by dipping and dried at 120° C. for one hour to form a charge transport layer having a film thickness of 30 μm.

The electrophotographic photosensitive member was evaluated for an image by use of iR3045 manufactured by Canon Inc. Evaluation was made using a test chart having a printing ratio of 5% in the environment: a temperature of 23° C. and a relative humidity of 50%. Every time a single sheet having an image formed thereon was output, rotary driving of an electrophotographic photosensitive member was terminated. In this manner, 1,000 images were evaluated. As a result, image quality was satisfactory.

EXAMPLES 55 to 57

Electrophotographic photosensitive members were manufactured in the same manner as in Example 54 except that polyester resin A1 used in Example 54 was changed to polyester resin B1 (Example 55) mentioned above, polyester resin H (Example 56) mentioned above and polyester resin L (Example 57) mentioned above.

Evaluation was made in the same manner as in Example 54. The image quality was satisfactory in all cases.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the priority of Japanese Patent Application No. 2008-187180 filed Jul. 18, 2008, and the content thereof is incorporated by reference as a part of the application.

What is claimed is:

1. An electrophotographic photosensitive member comprising a support, a charge generation layer provided on the support and a charge transport layer containing a charge transporting material and a binder resin formed on the charge generation layer, the charge transport layer serving as a surface layer of the electrophotographic photosensitive member, wherein:

the charge transport layer contains a polyester resin having a repeating structural unit represented by the following formula (1) and a repeating structural unit represented by the following formula (2), as a binder resin;

the content of a siloxane moiety in the polyester resin is not less than 5% by mass and not more than 30% by mass relative to the total mass of the polyester resin, the siloxane moiety is a structure represented by the following formula:

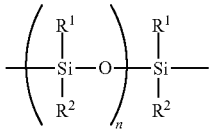

wherein $R^1$ and $R^2$ each independently represent a substituted or unsubstituted alkyl group or a substituted or unsubstituted aryl group; and n represents an average number of repetitions of a structure within the brackets, ranging from 20 or more and 80 or less; and the content of the polyester resin in the charge transport layer is not less than 60% by mass relative to the total mass of the whole binder resin in the charge transport layer, (1)

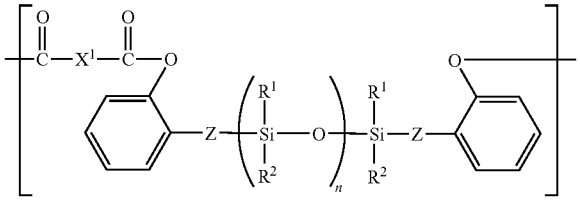

where, in formula (1), $X^1$ represents a divalent organic group; $R^1$ and $R^2$ each independently represent a substituted or unsubstituted alkyl group or a substituted or unsubstituted aryl group; Z represents a substituted or unsubstituted alkylene group having 1 or more and 4 or less carbon atoms; and n represents an average number of repetitions of a structure within the brackets, ranging from 20 or more and 80 or less, (2)

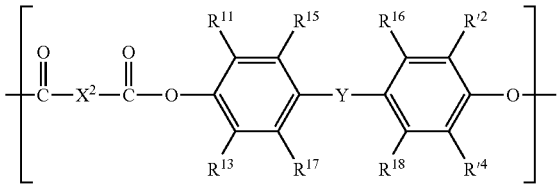

where, in formula (2), $R^{11}$ to $R^{18}$ each independently represent a hydrogen atom, a substituted or unsubstituted alkyl group, a substituted or unsubstituted aryl group or a substituted or unsubstituted alkoxy group; $X^2$ represents a divalent organic group; and Y represents a single bond, a substituted or unsubstituted alkylene group, a substituted or unsubstituted arylene group, an oxygen atom or a sulfur atom.

2. The electrophotographic photosensitive member according to claim 1, wherein the content of the siloxane moiety in the charge transport layer is not less than 5% by mass and not more than 30% by mass relative to the total mass of the whole binder resin in the charge transport layer.

3. The electrophotographic photosensitive member according to claim 1, wherein n in the formula (1) is 25 or more and 70 or less.

4. The electrophotographic photosensitive member according to claim 1, wherein the content of the siloxane moiety in the charge transport layer is not less than 10% by mass and not more than 25% by mass relative to the total mass of the whole binder resin in the charge transport layer.

5. The electrophotographic photosensitive member according to claim 1, wherein $X^1$ in the formula (1) is a structure represented by the following formula (3-12) or (3-13) and $X^2$ in the formula (2) is a structure represented by the following formula (3-12) or (3-13):

(3-12)

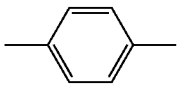

(3-13)

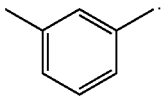

6. The electrophotographic photosensitive member according to claim 1, wherein the charge transport layer contains, as a charge transporting material, a compound represented by the following formula (4):

(4)

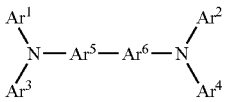

where, in formula (4), $Ar^1$ to $Ar^4$ each independently represent a substituted or unsubstituted aryl group; and $Ar^5$ and $Ar^6$ each independently represent a substituted or unsubstituted arylene group.

7. A process cartridge comprising an electrophotographic photosensitive member according to claim 1 and at least one device selected from the group consisting of a charging device, a developing device, a transfer device and a cleaning device, wherein the electrophotographic photosensitive member and the at least one device are integrally supported and detachably mountable to a main body of an electrophotographic apparatus.

8. An electrophotographic apparatus comprising the electrophotographic photosensitive member according to claim 1, a charging device, an exposure device, a developing device and a transfer device.

* * * * *